US005534399A

United States Patent [19]

Mihayashi

[11] Patent Number: 5,534,399

[45] **Date of Patent: * Jul. 9, 1996**

[54] SILVER HALIDE COLOR PHOTOGRAPHIC PHOTOSENSITIVE MATERIAL

[75] Inventor: Keiji Mihayashi, Kanagawa, Japan

[73] Assignee: Fuji Photo Film Co., Ltd., Kanagawa, Japan

[ * ] Notice: The term of this patent shall not extend beyond the expiration date of Pat. No. 5,112,730.

[21] Appl. No.: 329,135

[22] Filed: Oct. 25, 1994

Related U.S. Application Data

[63] Continuation of Ser. No. 204,889, Mar. 2, 1994, abandoned, which is a continuation of Ser. No. 683,152, Apr. 10, 1991, abandoned.

[30] Foreign Application Priority Data

Apr. 12, 1990 [JP] Japan ..... 2-96757

[51] Int. Cl.[6] ..... G03C 1/035; G03C 7/333

[52] U.S. Cl. ..... 430/553; 430/226; 430/359; 430/549; 430/550; 430/567; 430/600

[58] Field of Search ..... 430/359, 553, 430/549, 226, 567

[56] References Cited

U.S. PATENT DOCUMENTS

| | | | |
|---|---|---|---|
| 3,996,055 | 12/1976 | Minagawa et al. | 430/359 |
| 4,294,900 | 10/1981 | Aono | 430/549 |
| 4,368,260 | 1/1983 | Komamura et al. | 430/226 |
| 4,483,914 | 11/1984 | Naito et al. | 430/545 |
| 4,647,527 | 3/1987 | Ikenoue et al. | 430/549 |
| 4,728,602 | 3/1988 | Shibahara et al. | 430/567 |
| 4,797,354 | 1/1989 | Saitou et al. | 430/567 |
| 4,835,095 | 5/1989 | Ohashi et al. | 430/567 |
| 5,064,260 | 1/1991 | Komamura et al. | 430/226 |
| 5,064,750 | 11/1991 | Naito | 430/430 |
| 5,075,207 | 12/1991 | Langen et al. | 430/549 |
| 5,112,730 | 5/1992 | Ohkawa et al. | 430/549 |
| 5,178,993 | 1/1993 | Fujita et al. | 430/430 |
| 5,266,456 | 11/1993 | Mihayashi et al. | 430/549 |

FOREIGN PATENT DOCUMENTS

| | | |
|---|---|---|
| 0326853 | 9/1989 | European Pat. Off. . |
| 0337370 | 10/1989 | European Pat. Off. . |
| 3815469 | 11/1989 | Germany . |
| 0143332 | 12/1983 | Japan . |
| 0254032 | 12/1983 | Japan . |
| 1221748 | 10/1986 | Japan . |
| 3304442 | 12/1988 | Japan . |

*Primary Examiner*—Richard L. Schilling
*Attorney, Agent, or Firm*—Sughrue, Mion, Zinn, Macpeak & Seas

[57] ABSTRACT

A silver halide color photographic photosensitive material is disclosed, comprising a support having thereon at least one hydrophilic colloid layer, at least one layer of which is a photosensitive silver halide emulsion layer. At least 50% of the total projected area of the silver halide grains constituting the at least one silver halide emulsion layer is accounted for by tabular grains having an average aspect ratio of at least 2:1, and a yellow colored cyan coupler is contained in at least one hydrophilic colloid layer.

15 Claims, No Drawings

SILVER HALIDE COLOR PHOTOGRAPHIC PHOTOSENSITIVE MATERIAL

This is a continuation of application Ser. No. 08/204,889, filed Mar. 2, 1994, now abandoned, which is a continuation of application Ser. No. 07/683,152, filed Apr. 10, 1002, now abandoned.

FIELD OF THE INVENTION

The present invention concerns silver halide color photographic photosensitive materials, and more particularly concerns silver halide color photographic photosensitive materials containing tabular silver halide emulsions and novel yellow colored cyan couplers which, with high photographic speed, have excellent sharpness, color reproduction, graininess, storage properties and desilvering properties.

BACKGROUND OF THE INVENTION

There is a need for silver halide color photographic photosensitive materials having coinstantaneously excellent sharpness and color reproduction properties and high photographic speed, and which photosensitive materials can be subjected to rapid processing. Yellow colored cyan couplers have been proposed in JP-A-61-221748 and JP-A-1-319744 (the term "JP-A" as used herein refers to a "published unexamined Japanese patent application") for improving color reproduction, but the sharpness and graininess of such sensitive materials is inadequate.

Furthermore, the use of tabular silver halide grains having a ratio of the diameter to thickness (aspect ratio) of at least 8:1 has been proposed, for example, in JP-A-58-113934 as a technique for providing sensitive materials having excellent graininess and sharpness and high photographic speed.

However, when tabular silver halide grains are used, it has become clear that the interlayer effect which is essential for improving picture quality is reduced to thereby adversely affect color reproduction. In order to overcome these disadvantages, the use of compounds which release diffusible development inhibitors together with tabular silver halide grains has been proposed in JP-A-59-129849 and JP-A-61-14635. However, the improvement in color reproduction properties with these methods is still unsatisfactory.

Furthermore, the desilvering properties are adversely affected when tabular silver halide grains are used, and the sensitive material storage properties are adversely affected when desilvering accelerators such as those disclosed, for example, in U.S. Pat. No. 4,552,834 are added to overcome these problems.

SUMMARY OF THE INVENTION

An object of the present invention is to provide a silver halide color photographic photosensitive material which coinstantaneously exhibits good sharpness, color reproduction, graininess and storage properties.

A second object is to provide a silver halide color photographic photosensitive material having excellent desilvering properties and which can be rapidly processed.

The above objects of the present invention have been realized by providing a silver halide color photosensitive material comprising a support having thereon at least one hydrophilic colloid layer, at least one layer of which is a photosensitive emulsion layer, wherein at least 50% of the total projected area of the silver halide grains constituting the at least one silver halide emulsion layer is accounted for by tabular grains having an average aspect ratio of at least 2:1, and a yellow colored cyan coupler is contained in at least one hydrophilic colloid layer.

DETAILED DESCRIPTION OF THE INVENTION

The yellow colored cyan coupler of the present invention is described below.

The yellow colored cyan coupler of the present invention is a cyan coupler having an absorption maximum in the visible range between 400 nm and 500 nm, and which couplers with the oxidized form of a primary aromatic amine developing agent to form a cyan dye having an absorption maximum in the visible region between 630 nm and 750 nm.

In a preferred embodiment, the yellow colored cyan coupler of the present invention upon coupling with the oxidized form of a primary aromatic amine developing agent releases a residual compound containing a water-soluble 6-hydroxy-2-pyridon-5-ylazo group, a water-soluble pyrazolon-4-ylazo group, a water-soluble 2-acylaminophenylazo group, a water-soluble 5-aminopyrazol-4-ylazo group or a water-soluble 2-sulfonamidophenylazo group.

The yellow colored cyan coupler of the present invention is represented by formulae (CI) to (CIV) indicated below.

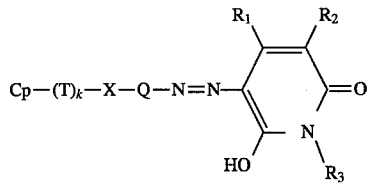

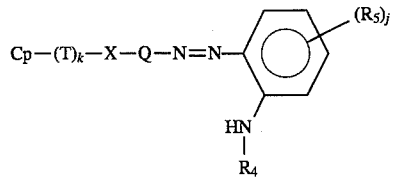

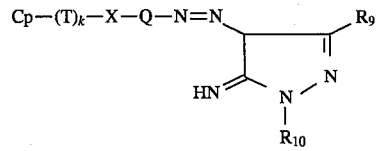

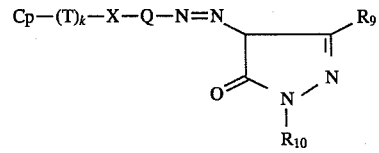

Cp in formulae (CI) to (CIV) represents a cyan coupler residual group (T is bonded to the coupling position of Cp); T represents a timing group; k represents an integer of 0 or 1; X represents a divalent linking group bonded to $(T)_k$ via N, O or S contained in X and connected with Q; and Q represents an arylene group or a divalent heterocyclic group.

In formula (CI), $R_1$ and $R_2$ each independently represents a hydrogen atom, a carboxyl group, a sulfo group, a cyano group, an alkyl group, a cycloalkyl group, an aryl group, a heterocyclic group, a carbamoyl group, a sulfamoyl group, a carboxamido group, a sulfonamido group or an alkylsulfonyl group; and $R_3$ represents a hydrogen atom, an alkyl group, a cycloalkyl group, an aryl group or a heterocyclic group. However, at least one of T, X, Q, $R_1$, $R_2$ and $R_3$ is a group which contains a water-soluble group (for example, hydroxyl, carboxyl, sulfo, amino, ammoniumyl, phosphono, phosphino and hydroxysulfonyloxy).

Moreover,

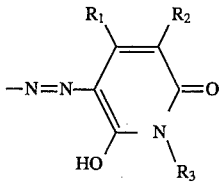

in formula (CI) adopts tautomeric structural forms such as those indicated below, and these tautomeric structures are also included in formula (CI) of the present invention.

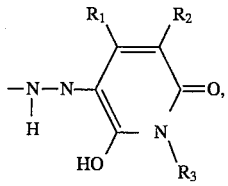

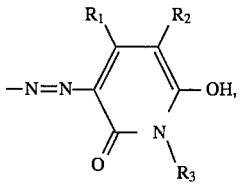

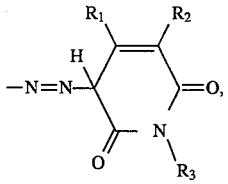

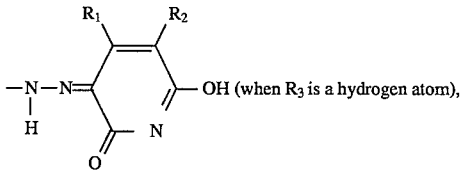

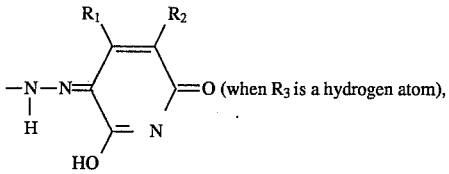

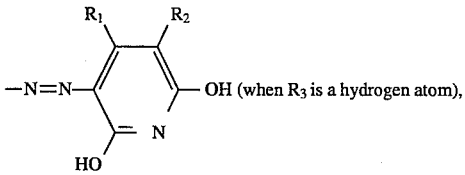

-continued

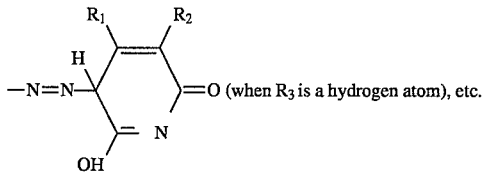

$R_4$ in formula (CII) represents an acyl group or a sulfonyl group; $R_5$ represents a substitutable group, preferably an electron donating group such as an amino group (for example, amino, ethylamino, dimethylamino and diethylamino), an alkoxy group (for example, methoxy, ethoxy and propoxy) and an alkyl group (for example, methyl, ethyl and isopropyl); and j represents an integer of from 0 to 4. When j is 2 or more, the $R_4$ groups may be the same or different. However, at least one of T, X, Q, $R_4$ and $R_5$ contains a water-soluble group (for example, hydroxyl, carboxyl, sulfo, phosphono, phosphino, hydroxysulfonyloxy, amino and ammoniumyl).

In formulae (CIII) and (CIV), $R_9$ represents a hydrogen atom, a carboxyl group, a sulfo group, a cyano group, an alkyl group, a cycloalkyl group, an aryl group, an alkoxy group, a cycloalkoxy group, an aryloxy group, a heterocyclic group, a carbamoyl group, a sulfamoyl group, a carboxamido group, a sulfonamido group, or an alkylsulfonyl group; and $R_{10}$ represents a hydrogen atom, an alkyl group, a cycloalkyl group, an aryl group or a heterocyclic group. However, at least one of T, X, Q, $R_9$ and $R_{10}$ contains a water-soluble group (for example, hydroxyl, carboxyl, sulfo, phosphono, phosphino, hydroxysulfonyloxy, amino and ammoniumyl). Furthermore,

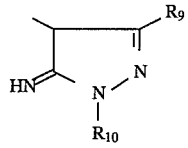

and

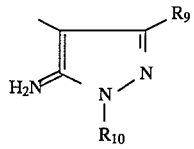

and are related tautomerically and represent the same compound.

The compounds represented by formulae (CI) to (CIV) are described in detail below.

Known cyan coupler residual groups (for example, phenol and naphthol types) can be used as the coupler residual group represented by Cp.

The coupler residual group represented by formulae (Cp-6), (Cp-7) and (Cp-8) indicated below are preferred examples of Cp.

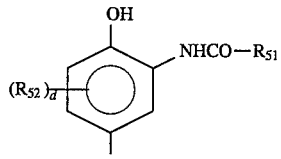

(Cp-6)

-continued (Cp-7)

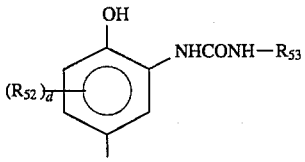

(Cp-8)

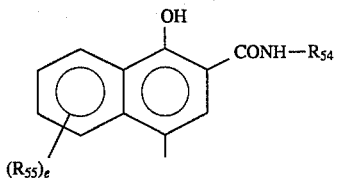

In these formulae, the free bond at the coupling position represents the bonding position of the coupling leaving group.

In these formulae, the total number of carbon atoms in $R_{51}$, $R_{52}$, $R_{53}$, $R_{54}$ and $R_{55}$ when these groups contain a diffusion-resisting group is from 8 to 40, and preferably from 10 to 30, and in other cases the total number of carbon atoms is not more than 15. In the case of bis forms, telomeric and polymeric couplers, any of the above described substituent groups represents a divalent group which connects the repeating units. In this case the number of carbon atoms may be outside the ranges specified above.

Below, $R_{41}$ represents an aliphatic group, an aromatic group or a heterocyclic group; $R_{42}$ represents an aromatic group or a heterocyclic group; and $R_{43}$, $R_{44}$ and $R_{45}$ each represents a hydrogen atom, an aliphatic group, an aromatic group or a heterocyclic group.

$R_{51}$, $R_{52}$, $R_{53}$, $R_{54}$, $R_{55}$, d and e are described in detail below.

$R_{51}$ represents a group selected from those represented by $R_{42}$. $R_{52}$ represents a group selected from those represented by $R_{41}$, an

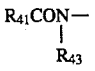

group, an

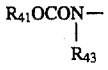

group, an

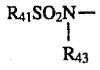

group, an

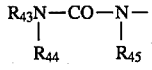

group, an $R_{41}O$— group, an $R_{41}S$— group, a halogen atom, or an

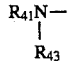

group. Moreover, d represents an integer of from 0 to 3. When d is 2 or 3, the $R_{52}$ groups may be the same or different. Furthermore, the $R_{52}$ groups may be divalent groups which are joined together to form a ring structure having 4- to 7-members, preferably 5- to 6-members. Typical examples of the divalent groups which form a ring structure include the

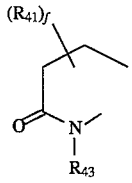

group and the

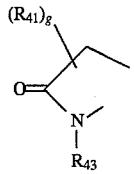

group. Here f represents an integer of from 0 to 4; and g represents an integer of from 0 to 2. $R_{53}$ represents a group selected from those represented by $R_{41}$. $R_{54}$ represents a group selected from those represented by $R_{41}$; and $R_{55}$ represents a group selected from those represented by $R_{41}$; an $R_{41}OCONH$— group, an $R_{41}SO_2NH$— group, an

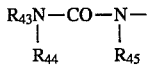

group, an

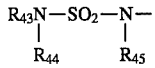

group, an $R_{43}O$— group, an $R_{41}S$— group, a halogen atom (for example, F, Cl, Br) or an

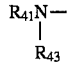

group. When there is a plurality of $R_{55}$ groups, these groups may be the same or different groups.

The aliphatic groups referred to above are saturated or unsaturated, chain like or cyclic, linear chain or branched, substituted or unsubstituted aliphatic hydrocarbyl groups having from 1 to 32, and preferably from 1 to 22, carbon atoms. Typical examples include methyl, ethyl, propyl, isopropyl, butyl, tert-butyl, isobutyl, tert-amyl, hexyl, cyclohexyl, 2-ethylhexyl, octyl, 1,1,3,3-tetramethylbutyl, decyl, dodecyl, hexadecyl and octadecyl.

The aromatic groups are substituted or unsubstituted naphthyl groups or substituted or unsubstituted phenyl groups preferably having from 6 to 20 carbon atoms.

The heterocyclic groups are preferably 3- to 8-membered substituted or unsubstituted heterocyclic groups having from 1 to 20, and preferably from 1 to 7, carbon atoms, the hetero atoms being selected from nitrogen, oxygen and sulfur atoms. Typical examples of the heterocyclic group include 2-pyridyl, 2-thienyl, 2-furyl, 1,3,4-thiadiazol-2-yl, 2,4-dioxo-1,3-imidazolidin-5-yl, 1,2,4-triazol-2-yl and 1-pyrazolyl.

Examples of the substituent groups in those cases where the above described aliphatic groups, aromatic group and heterocyclic group have substituent groups include a halogen atom, an $R_{47}O$— group, an $R_{46}S$— group, an $R_{47}CON(R_{48})$— group, an $R_{47}NCO(R_{48})$— group, an $R_{46}OCON(R_{47})$— group, an $R_{46}SO_2N(R_{47})$— group, an $R_{47}NSO_2(R_{48})$— group an $R_{46}SO_2$— group, an $R_{47}OCO$— group, an $R_{47}N(R_{48})$—CO—$N(R_{49})$— group, groups
selected from those represented by $R_{46}$, an

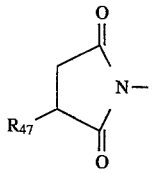

group, an $R_{46}COO$— group, an $R_{47}OSO_2$— group, a cyano group and a nitro group. Here, $R_{46}$ represents an aliphatic group, an aromatic group or a heterocyclic group; and $R_{47}$, $R_{48}$ and $R_{49}$ each represents an aliphatic group, an aromatic group, a heterocyclic group or a hydrogen atom. The aliphatic group, aromatic group and heterocyclic group have the same meaning as defined above.

In formula (Cp-6), $R_{51}$ is preferably an aliphatic group or an aromatic group. $R_{52}$ is preferably a chlorine atom, an aliphatic group or an $R_{41}CONH$— group. Moreover, d is preferably 1 or 2. $R_{53}$ is preferably an aromatic group.

In formula (Cp-7), $R_{52}$ is preferably an $R_{41}CONH$— group. Moreover, d is preferably 1. $R_{54}$ is preferably an aliphatic group or an aromatic group.

In formula (Cp-8), e is preferably 0 or 1. $R_{55}$ is preferably an $R_{41}OCONH$— group, an $R_{41}CONH$— group or an $R_{41}SO_2NH$— group, and these are preferably substituted in the 5-position of the naphthol ring.

The timing group represented by T is a group with which the bond with X is cleaved after the bond with Cp has been cleaved by a coupling reaction of the coupler with the oxidized form of a primary aromatic amine developing agent. The timing group represented by T is used, for example, to control the coupling reactivity, to stabilize the coupler and to control the release timing of X and the rest bonded thereto. The groups indicated below can be used as the timing group represented by T. Here, * signifies the bonding position with Cp and ** signifies the bonding position with X, or * signifies the bonding position with Cp and ** signifies the bonding position with Q.

(T-1)

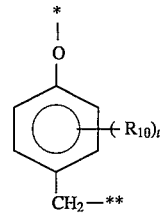

(T-2)

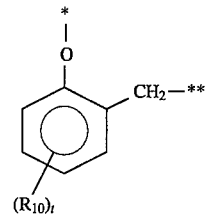

(T-3)

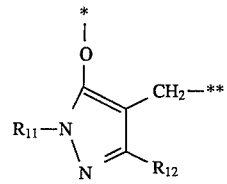

(T-4)

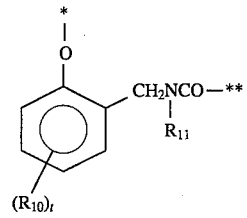

(T-5)

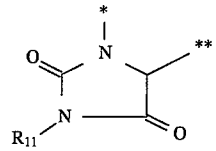

*—$OCH_2$—* (T-6)

*—OC(=O)—** (T-7)

In these formulae, $R_{10}$ represents a substituent group which can be substituted on a benzene ring; $R_{11}$ is selected from those groups represented by $R_{41}$; and $R_{12}$ represents a hydrogen atom or a substituent group. Moreover, t represents an integer of from 0 to 4. Substituent groups represented by $R_{10}$ and $R_{12}$ include $R_{41}$—, a halogen atom, $R_{43}O$—, $R_{43}S$—, $R_{43}(R_{44})NCO$—, $R_{43}OOC$—, $R_{43}SO_2$—, $R_{43}(R_{44})NSO_2$—, $R_{43}CON(R_{43})$—, $R_{41}SO_2N(R_{43})$—, $R_{43}CO$—, $R_{41}COO$—, $R_{41}SO$—, nitro, $R_{43}(R_{44})NCON(R_{45})$—, cyano, $R_{41}OCON(R_{43})$—, $R_{43}OSO_2$—, $R_{43}(R_{44})N$—, $R_{43}(R_{44})NSO_2N(R_{45})$—, and

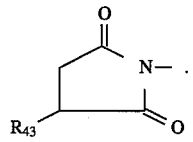

Moreover, k is an integer of 0 or 1 but, in general, k is preferably 0, namely, where Cp is bonded directly to X.

X is a divalent linking group which is bonded to $(T)_k$ via N, O or S, and the preferred divalent linking groups include a heterocyclic group which is bonded with $(T)_k$ via —O—, —S—, $$-\overset{O}{\overset{\|}{C}}-,\ -O\overset{O}{\overset{\|}{C}}O-,\ -O\overset{O}{\overset{\|}{C}}S-,\ -O\overset{O}{\overset{\|}{C}}NH-,$$

$-OSO_2-$, $-OSO_2NH-$ or N (for example, a group derived from pyrrolidine, piperidine, morpholine, piperazine, pyrrole, pyrazole, imidazole, 1,2,4-triazole, benzotriazole, succinimide, phthalimide, oxazolidine-2,4-dione, imidazolin-2,4-dione, 1,2,4-triazolidin-3,5-dione), and complex linking groups of these groups with alkylene groups (for example, methylene, ethylene, propylene), cycloalkylene groups (for example, 1,4-cyclohexylene), arylene groups (for example, o-phenylene, p-phenylene), divalent heterocyclic groups (for example, groups derived from pyridine, thiophene), —CO—, $-SO_2-$, —COO—, —CONH—, $-SO_2NH-$, $-SO_{20}-$, —NHCO—, $-NHSO_2-$, —NHCONH—, $-NHSO_2NH-$ and —NHCOO—. X is most desirably represented by formula (II):

$$*-X_1-(L-X_2)_m-** \qquad \text{(II)}$$

In formula (II), * indicates the bonding position with $(T)_k$; ** indicates the bonding position with Q; $X_1$ represents —O— or —S—; L represents an alkylene group; $X_2$ represents a single bond, —O—, —S—, —CO—, $-SO_2-$, $$-\overset{O}{\overset{\|}{C}}-,\ -\overset{O}{\overset{\|}{C}}-,\ -N\overset{O}{\overset{\|}{C}}-,\ -C\overset{O}{\overset{\|}{N}}H-,\ -SO_2H,\ -NHSO_2-,$$

$$-SO_2O-,\ -OSO_2-,\ -O\overset{O}{\overset{\|}{C}}O-,\ -O\overset{O}{\overset{\|}{C}}NH-,\ -NH\overset{O}{\overset{\|}{C}}O-,$$

$$-NH\overset{O}{\overset{\|}{C}}NH-,\ -NHSO_2NH-,\ -O\overset{O}{\overset{\|}{C}}S-,\ -S\overset{O}{\overset{\|}{C}}O-,$$

$-OSO_2NH-$ or $-NHSO_2-$; and m represents an integer of from 0 to 3. The total number of carbon atoms (referred to hereinafter as the C number) of X is preferably from 0 to 12, and most desirably from 0 to 8. X is most desirably an $-OCH_2CH_2O-$ group.

Q represents an arylene group or a divalent heterocyclic group. Where Q is an arylene group, it may have a condensed ring or it may have substituent groups (for example, a halogen atom, hydroxyl, carboxyl, sulfo, nitro, cyano, amino, ammonium, phosphono, phosphino, alkyl, cycloalkyl, aryl, carboxamido, sulfonamido, alkoxy, aryloxy, acyl, sulfonyl, carboxyl, carbamoyl and sulfamoyl), and the C number is preferably from 6 to 15, and most desirably from 6 to 10. Where Q is a divalent heterocyclic group, the heterocyclic group is a 3- to 8-membered, and preferably a 5- to 7-membered, single ring or condensed ring heterocyclic group with at least one hetero atom selected from among N, O, S, P, Se and Te contained within the ring (for example, groups derived from pyridine, thiophene, furan, pyrrole, pyrazole, imidazole, thiazole, oxazole, benzothiazole, benzoxazole, benzofuran, benzothiophene, 1,3,4-thiadiazole, indole or quinoline) and it may have a substituent group (the same substituent groups as in those cases where Q is an arylene group), and the C number is preferably from 2 to 15, and most desirably from 2 to 10. Q is most desirably a

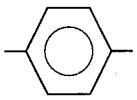

group.

Hence, in the present invention $-(T)_k-X-Q$ most desirably represents $-OCH_2CH_2-O$

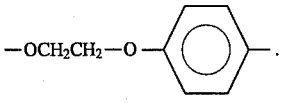

When $R_1$, $R_2$ or $R_3$ is an alkyl group, the alkyl group may be a linear chain or a branched chain alkyl group, it may contain unsaturated bonds, and it may have a substituent group (for example, a halogen atom, hydroxyl, carboxyl, sulfo, phosphono, phosphino, cyano, alkoxy, aryl, alkoxycarbonyl, amino, ammoniumyl, acyl, carboxamido, sulfonamido, carbamoyl, sulfamoyl and sulfonyl).

When $R_1$, $R_2$ or $R_3$ is a cycloalkyl group, the cycloalkyl group has a 3- to 8-membered ring and may be bicyclic. The cycloalkyl group may include unsaturated bonds and it may have a substituent group (the same substituent groups as when $R_1$, $R_2$ or $R_3$ is an alkyl group).

When $R_1$, $R_2$ or $R_3$ is an aryl group, the aryl group may be a condensed ring and it may have a substituent group (for example, an alkyl group and a cycloalkyl group in addition to the substituent groups when $R_1$, $R_2$ or $R_3$ is an alkyl group).

When $R_1$, $R_2$ or $R_3$ is a heterocyclic group, it is a 3- to 8-membered (and preferably 5- to 7-membered) single ring or condensed ring heterocyclic group which has at least one hetero atom selected from among N, S, O, P, Se and Te within the ring (for example, imidazolyl, thienyl, pyrazolyl, thiazolyl, pyridyl, quinolyl), and it may have a substituent group (the same substituent groups as when $R_1$, $R_2$ or $R_3$ is an aryl group).

Here, carboxyl group includes the carboxylate group; sulfo group includes the sulfonate group, phosphino group includes the phosphinate group, and phosphono group includes the phosphonate group, and in such cases the counter ion is, for example, $Li^+$, $Na^+$, $K^+$ or ammonium.

$R_1$ is preferably a hydrogen atom, a carboxyl group, an alkyl group of carbon number 1 to 10 (for example, methyl, t-butyl, sulfomethyl, 2-sulfoethyl, carboxymethyl, 2-carboxyethyl, 2-hydroxymethyl, benzyl, ethyl, isopropyl), or an aryl group of carbon number 6 to 12 (for example, phenyl, 4-methoxyphenyl, 4-sulfophenyl), and $R_1$ is most desirably a hydrogen atom, a methyl group or a carboxyl group.

$R_2$ is preferably a cyano group, a carboxyl group, a carbamoyl group of carbon number 1 to 10, a sulfamoyl group of carbon number 0 to 10, a sulfo group, an alkyl group of carbon number 1 to 10 (for example, methyl, sulfomethyl), a sulfonyl group of carbon number 1 to 10 (for example, methylsulfonyl, phenylsulfonyl), a carboxamido group of carbon number 1 to 10 (for example, acetamido, benzamido), or a sulfonamido group of carbon number 1 to 10 (for example, methanesulfonamido, toluene-sulfonamido), and $R_2$ is most desirably a cyano group, a carbamoyl group or a carboxyl group.

$R_3$ is preferably a hydrogen atom, an alkyl group of carbon number from 1 to 12 (for example, methyl, sulfomethyl, carboxymethyl, 2-sulfoethyl, 2-carboxyethyl, ethyl, n-butyl, benzyl, 4-sulfobenzyl), or an aryl group of carbon number 6 to 15 (for example, phenyl, 4-carboxyphenyl, 3-carboxyphenyl, 4-methoxyphenyl, 2,4-dicarboxyphenyl, 2-sulfophenyl, 3-sulfophenyl, 4-sulfophenyl, 2,4-disulfophenyl, 2,5-disulfophenyl), and $R_3$ is most desirably an alkyl group of carbon number 1 to 7 or an aryl group of carbon number 6 to 10.

$R_4$ represents an acyl group represented by formula (III), or a sulfonyl group represented by formula (IV).

$$R_{11}-\underset{\underset{O}{\|}}{C}- \quad \text{(III)}$$

$$R_{11}SO_2- \quad \text{(IV)}$$

When $R_{11}$ is an alkyl group, it may be either a linear chain or a branched chain form, $R_{11}$ may contain an unsaturated bond, and $R_{11}$ may have a substituent group (for example, a halogen atom, hydroxyl, carboxyl, sulfo, phosphono, phosphino, cyano, alkoxy, aryl, alkoxycarbonyl, amino, ammoniumyl, acyl, carbonamido, sulfonamido, carbamoyl, sulfamoyl and sulfonyl).

When $R_{11}$ is a cycloalkyl group, it is a cycloalkyl group having a 3- to 8-membered ring, $R_{11}$ may have a crosslinking group, $R_{11}$ may have an unsaturated bond, and $R_{11}$ may have a substituent group (the same as the substituent group when $R_{11}$ is an alkyl group).

When $R_{11}$ is an aryl group, it may be a condensed ring aryl group and may have a substituent group (for example, alkyl and cycloalkyl groups in addition to the substituent group when $R_{11}$ is an alkyl group).

When $R_{11}$ is a heterocyclic group, it is a 3- to 8-membered (and preferably a 5-membered to 7-membered) single ring or condensed ring heterocyclic group having at least one hetero atom selected from among N, S, O, P, Se and Te within the ring (for example, imidazolyl, thienyl, pyrazolyl, thiazolyl, pyridyl, quinolyl), and $R_{11}$ may have a substituent group (the same substituent group as when $R_{11}$ is an aryl group).

Here, carboxyl group includes the carboxylate group, sulfo group includes the sulfonate group, phosphino group includes the phosphinate group and phosphono group includes the phosphonate group, and in such cases the counter ion is, for example, $Li^+$, $Na^+$, $K^+$ or ammonium.

$R_{11}$ is preferably an alkyl group of carbon number 1 to 10 (for example, methyl, carboxymethyl, sulfoethyl, cyanoethyl), a cycloalkyl group of carbon number 5 to 8 (for example, cyclohexyl, 2-carboxycyclohexyl), or an aryl group of carbon number 6 to 10 (for example, phenyl, 1-naphthyl, 4-sulfophenyl), and it is most desirably an alkyl group of carbon number 1 to 3, or an aryl group of carbon number 6.

$R_5$ is a substitutable group, preferably an electron donating group, and most desirably an $-NR_{62}R_{63}$ group or an $-OR_{14}$ group. Substitution at the 4-position is preferred. $R_{62}$, $R_{63}$ and $R_{14}$ each represents a hydrogen atom, an alkyl group of carbon number of 1 to 10, a cycloalkyl group of carbon number of 3 to 10, an aryl group of carbon number of 6 to 10 or a heterocyclic group such as piperidino, morpholino and pyrrole groups. Furthermore, a ring can be formed between $R_{62}$ and $R_{63}$, and an alicyclic ring is preferred for the nitrogen-containing heterocyclic ring thus formed.

Moreover, j represents an integer of from 0 to 4, preferably 1 or 2, and most desirably 1.

When $R_9$ or $R_{10}$ is an alkyl group, it may be either a linear chain or a branched chain form, the alkyl group may contain an unsaturated bond, and may have a substituent group (for example, a halogen atom, hydroxyl, carboxyl, sulfo, phosphono, phosphino, cyano, alkoxy, aryl, aryloxycarbonyl, amino, ammoniumyl, acyl, carboxamido, sulfonamido, carbamoyl, sulfamoyl and sulfonyl).

When $R_9$ or $R_{10}$ is a cycloalkyl group, it is a cycloalkyl group having a 3- to 8-membered ring, the cycloalkyl group may have a crosslinking group, may have an unsaturated bond, and may have a substituent group (the same as the substituent group when $R_9$ or $R_{10}$ is an alkyl group).

When $R_9$ or $R_{10}$ is an aryl group, it may be a condensed ring aryl group and may have a substituent group (for example, alkyl and cycloalkyl group in addition to the substituent group when $R_9$ or $R_{10}$ is an alkyl group).

When $R_9$ or $R_{10}$ is a heterocyclic group, it is a 3- to 8-membered (and preferably a 5- to 7-membered) single ring or condensed ring heterocyclic group having at least one hetero atom selected from among N, S, O, P, Se and Te within the ring (for example, imidazolyl, thienyl, pyrazolyl, thiazolyl, pyridyl, quinolyl), and may have a substituent group (the same substituent group as when $R_9$ or $R_{10}$ is an aryl group).

Here, carboxyl group includes a carboxylate group, sulfo group includes the sulfonate group, phosphino group includes the phosphinate group, and phosphono group includes the phosphonate group, and in such cases the counter ion is, for example, $Li^+$, $Na^+$, $K^+$ or ammonium.

$R_9$ is preferably a cyano group, a carboxyl group, a carbamoyl group of carbon number 1 to 10, an alkoxycarbonyl group of carbon number 2 to 10, an aryloxycarbonyl group of carbon number 7 to 11, a sulfamoyl group of carbon number 0 to 10, a sulfo group, an alkyl group of carbon number 1 to 10 (for example, methyl, carboxymethyl, sulfomethyl), a sulfonyl group of carbon number 1 to 10 (for example, methylsulfonyl, phenylsulfonyl), a carboxamido group of carbon number 1 to 10 (for example, acetamido, benzamido), a sulfonamide group of carbon number 1 to 10 (for example, methanesulfonamido, toluenesulfonamido), an alkoxy group (for example, methoxy, ethoxy), or an aryloxy group (for example, phenoxy), and is most desirably a cyano group, a carbamoyl group, an alkoxycarbonyl group, or a carboxyl group.

$R_{10}$ is preferably a hydrogen atom, an alkyl group of carbon number 1 to 12 (for example, methyl, sulfomethyl, carboxymethyl, ethyl, 2-sulfoethyl, 2-carboxyethyl, 3-sulfopropyl, 3-carboxypropyl, 5-sulfopentyl, 5-carboxypentyl, 4-sulfobenzyl) or an aryl group of carbon number 6 to 15 (for example, phenyl, 4-carboxyphenyl, 3-carboxyphenyl, 2,4-dicarboxyphenyl, 4-sulfophenyl, 3-sulfophenyl, 2,5-disulfophenyl, 2,4-disulfophenyl), and is most desirably an alkyl group of carbon number 1 to 7 or an aryl group of carbon number 6 to 10.

Examples of Cp, X, O,

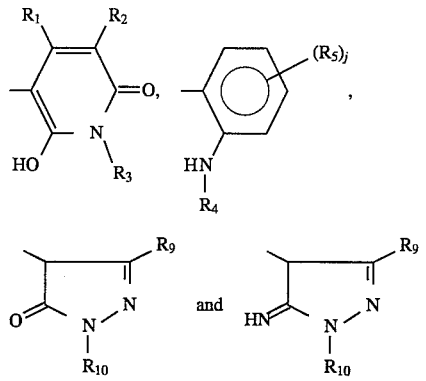

in formulae (CI)

to (CIV) are indicated below.
Examples of Cp:
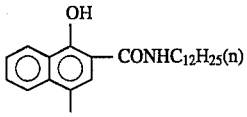
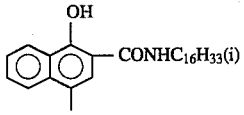
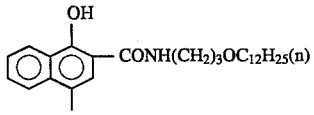
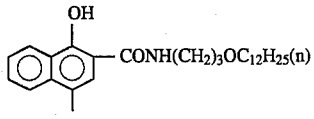
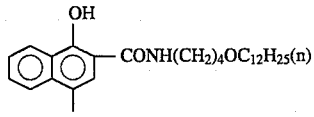
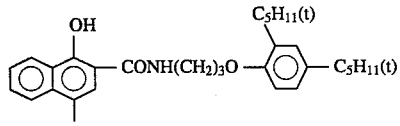
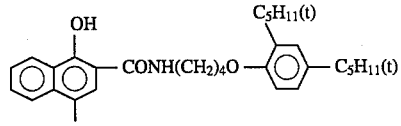
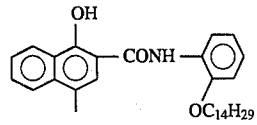
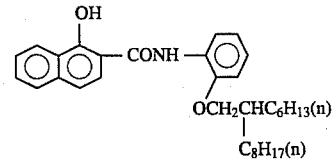
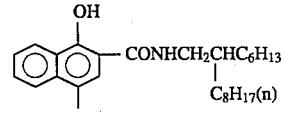
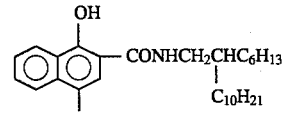
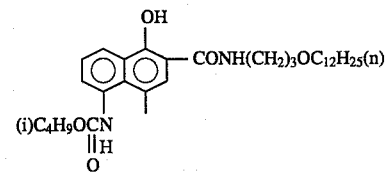
-continued
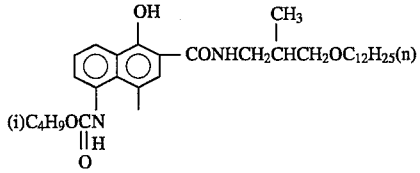
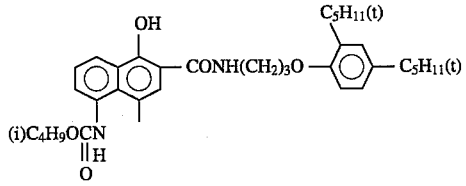
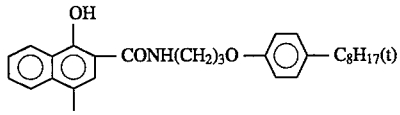
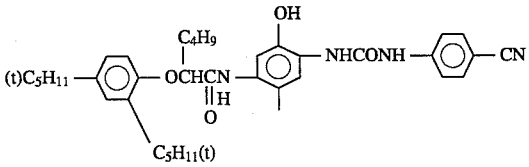
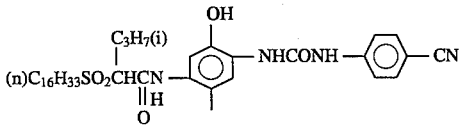
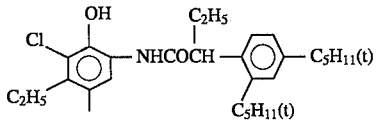
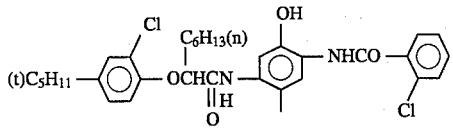
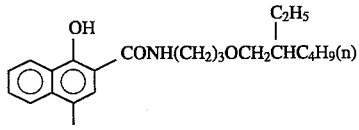
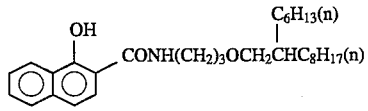
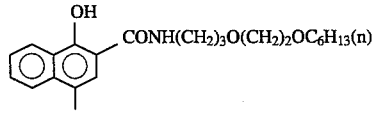
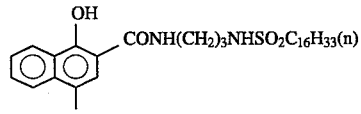

-continued
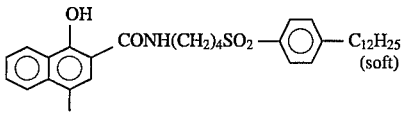
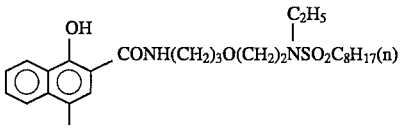
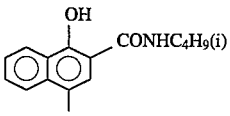
Examples of X:
$-O-$, $-S-$, $-OCH_2-$, $-OCH_2CH_2-$, $-OCH_2CH_2O-$, $-OCH_2CH_2CH_2O-$, $-O(CH_2CH_2O)_2-$, $-OCH_2CH_2S-$, $-OCH_2CH_2NHCO-$, $-OCH_2CH_2NHSO_2-$, $-OCH_2CH_2SO_2-$, $-OCH_2CH_2OCO-$, $-OCH_2CH_2CO-$, $-SCH_2CONH-$,
$-SCH_2COO-$, $-OCH(CH_3)CONH-$,
$-OCH_2CH_2OSO_2-$, $-OCO-$,
$-OCH_2CH(CO_2H)-$, $-OCH_2CH(CO_2H)CH_2-$,
$-OCH_2CH(CO_2H)O-$, $-OCH(CO_2H)CH_2O-$,
$-OCH_2CH(CO_2H)S-$, $-OCH_2CH(SO_3Na)O-$,
Examples of Q:
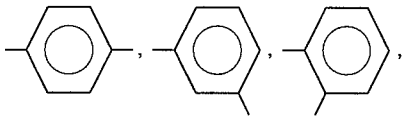
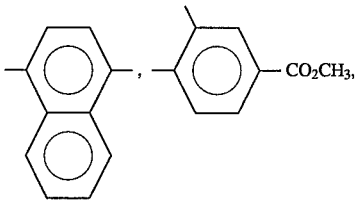
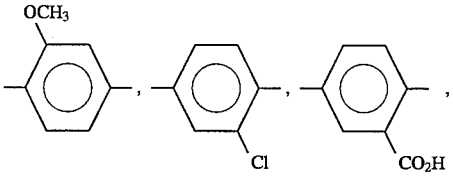
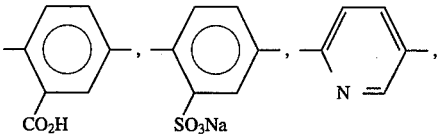
-continued
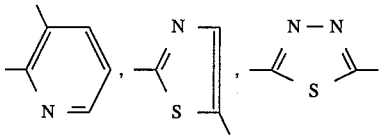
Examples of
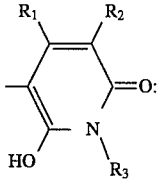
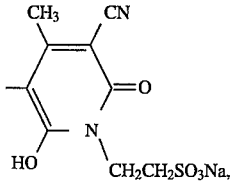
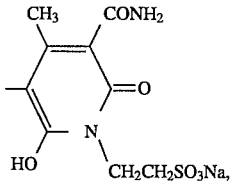
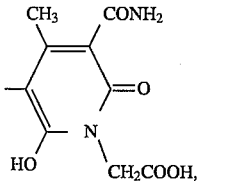
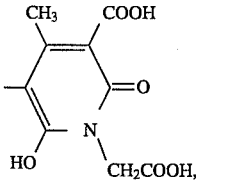
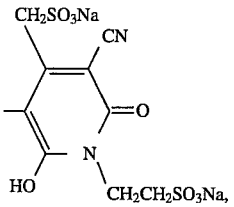
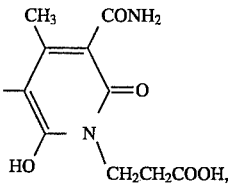

-continued
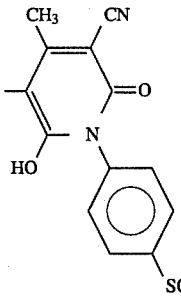
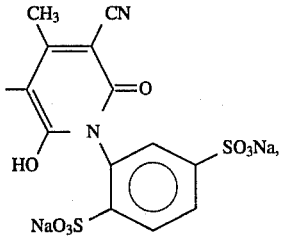
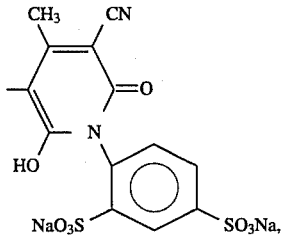
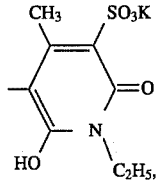
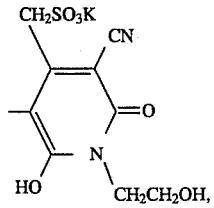
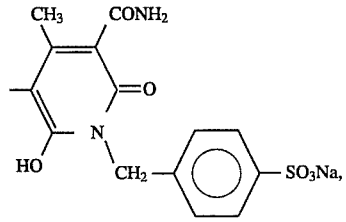
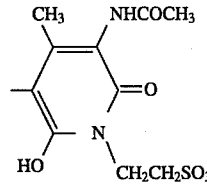
-continued
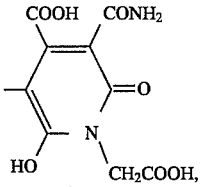
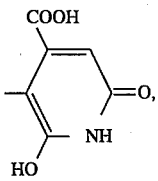
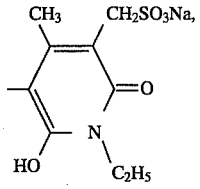
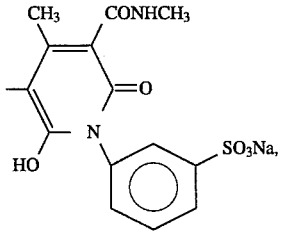
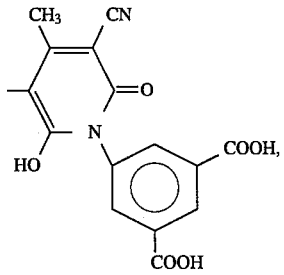
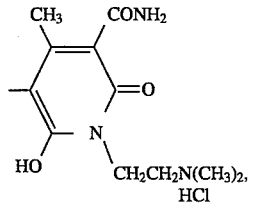
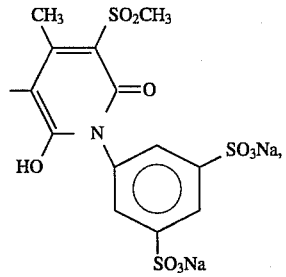

-continued
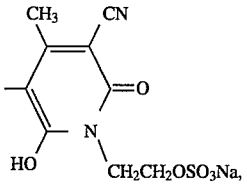
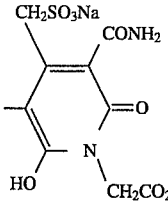
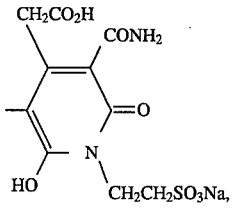
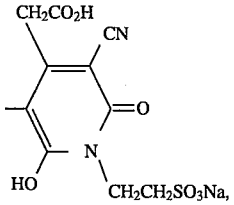
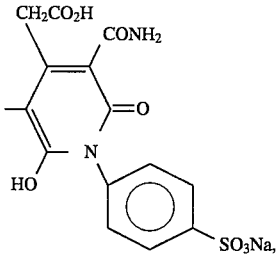
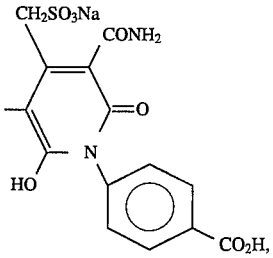
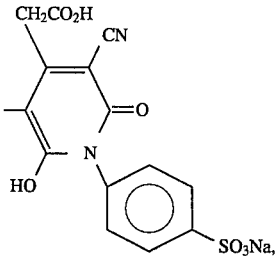
-continued
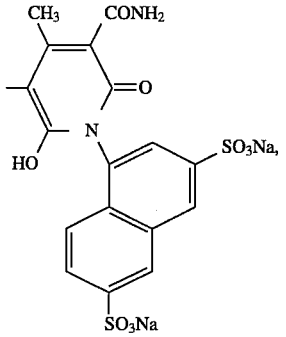
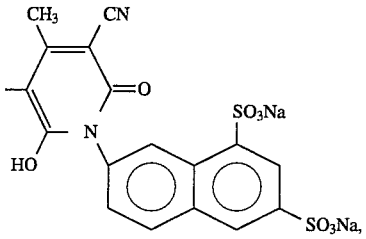
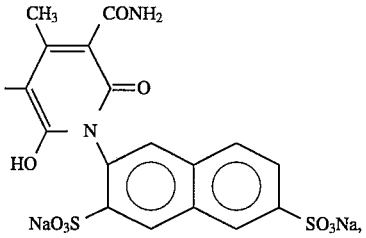
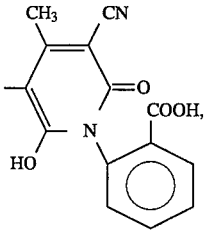
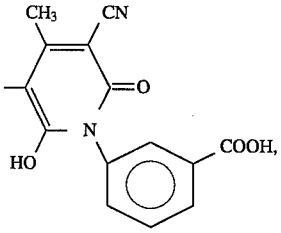
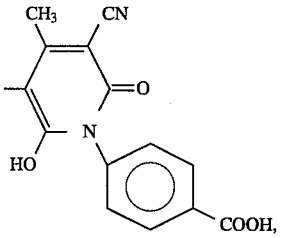

-continued
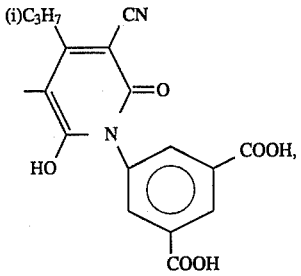
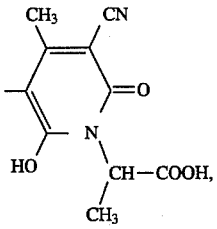
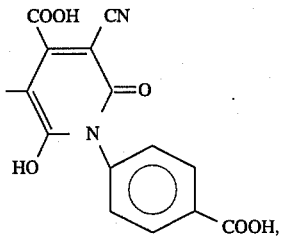
Examples of 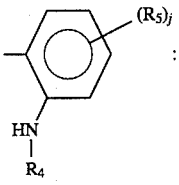 :
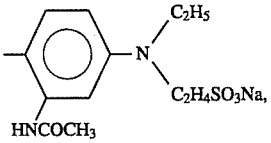
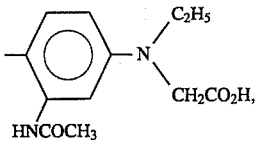
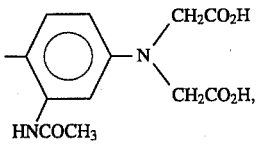
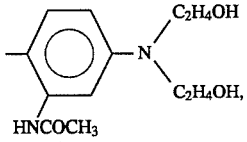
-continued
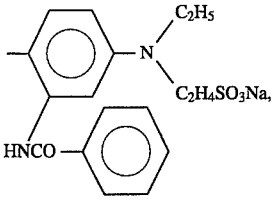
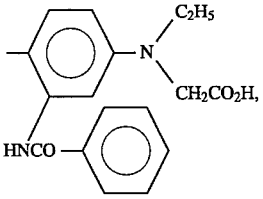
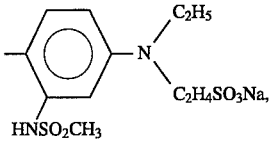
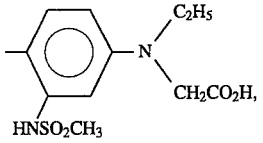
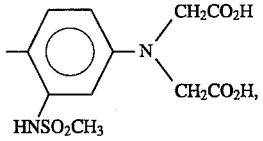
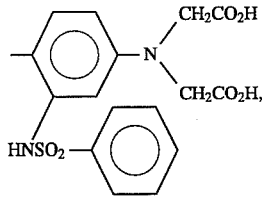
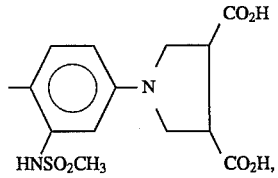
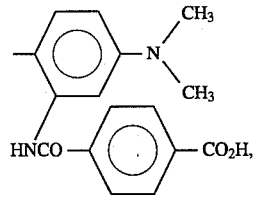
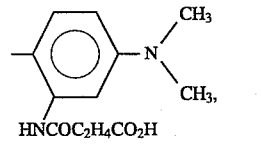

-continued
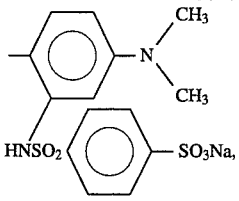
Examples of
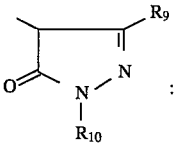
:
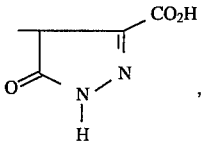
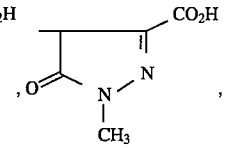
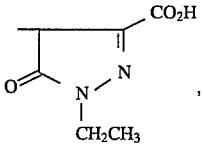
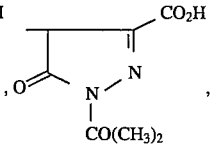
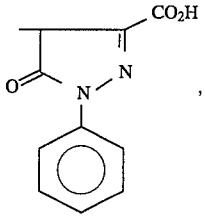
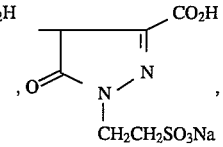
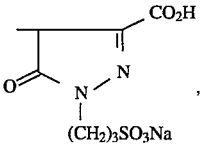
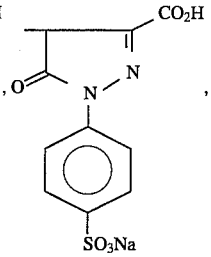
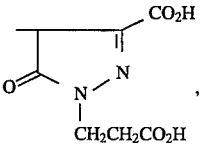
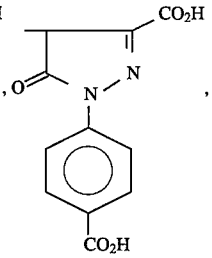
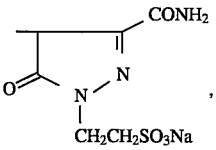
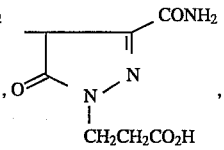
-continued
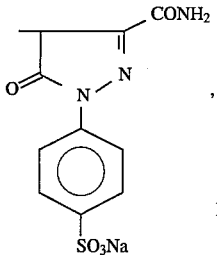
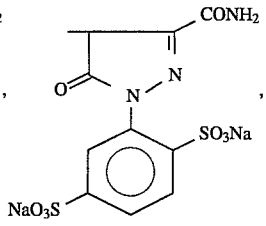
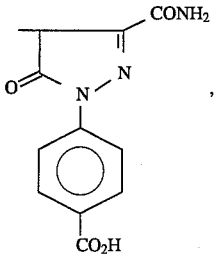
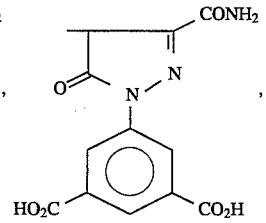
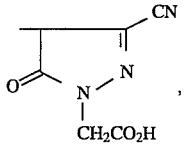
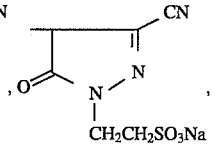
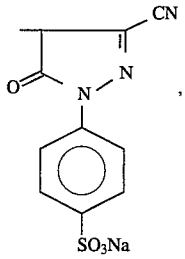
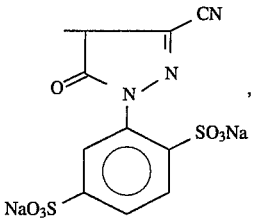
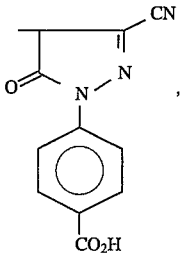
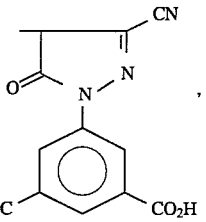
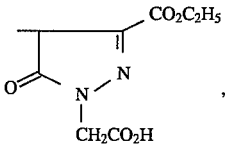
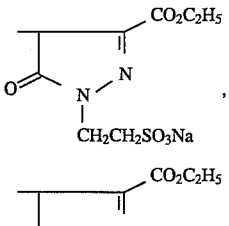
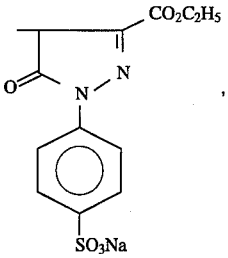
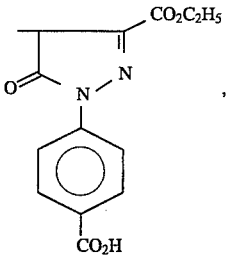

-continued
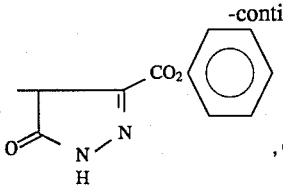
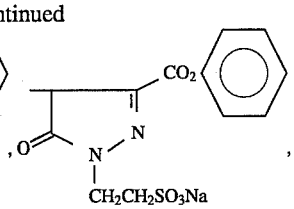
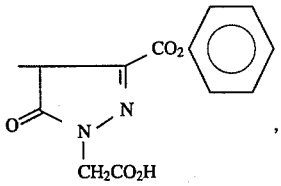
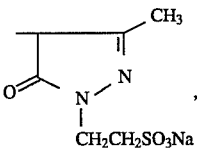
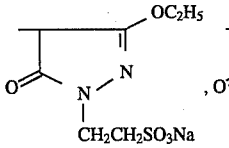
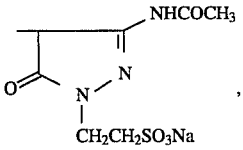
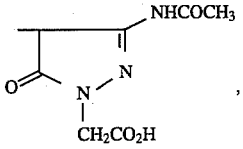
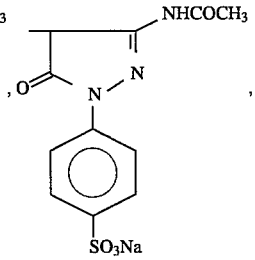
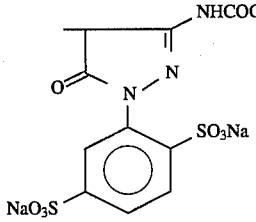
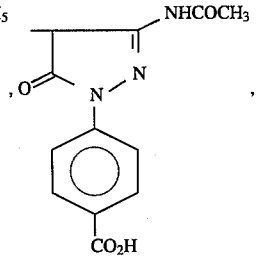
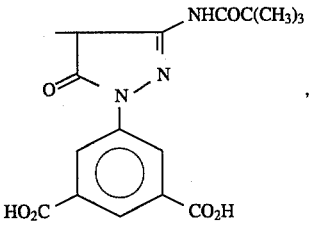
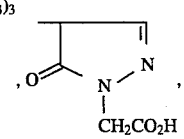
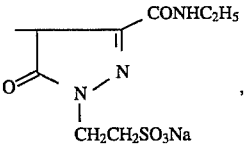
Examples of
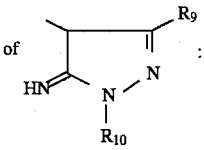
:
-continued
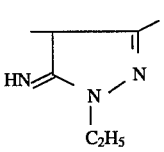
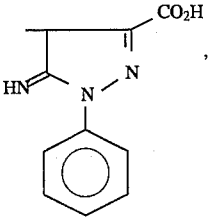
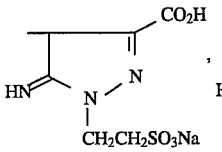
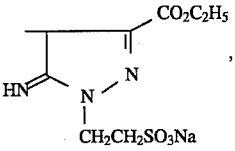
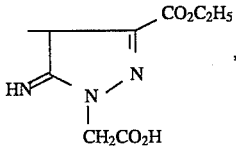
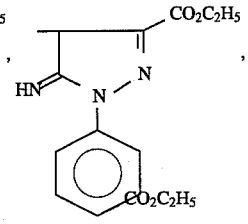
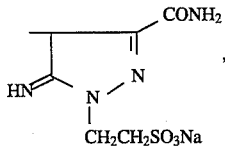
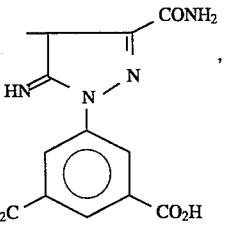
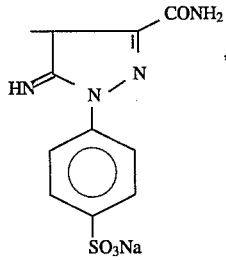
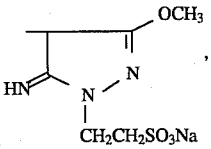
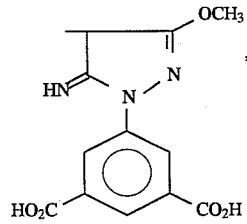
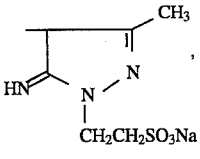
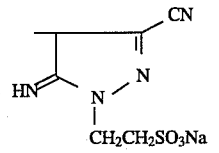
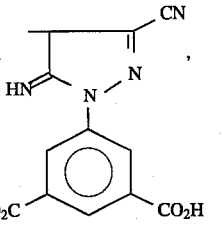

-continued
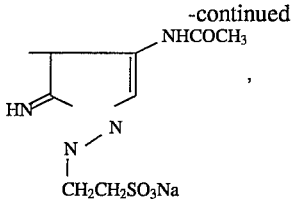
Useful examples of the yellow colored cyan coupler of the present invention are indicated below, but the couplers are not limited by these examples.
(YC-1)
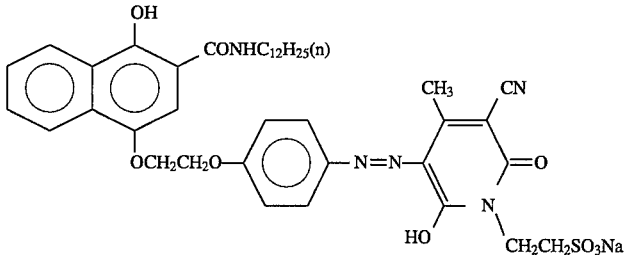
(YC-2)
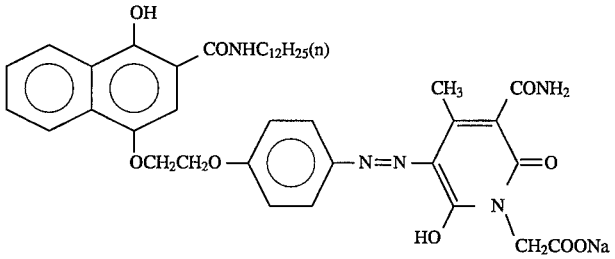
(YC-3)
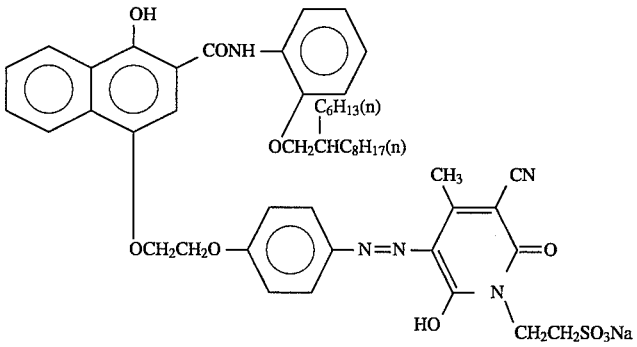
(YC-4)
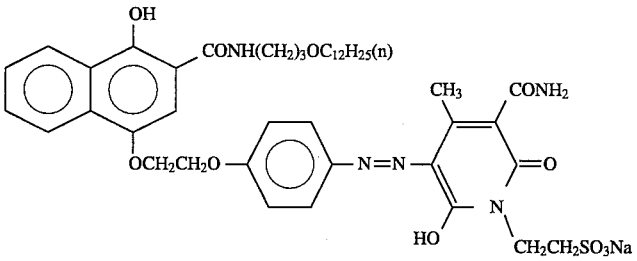
(YC-5)
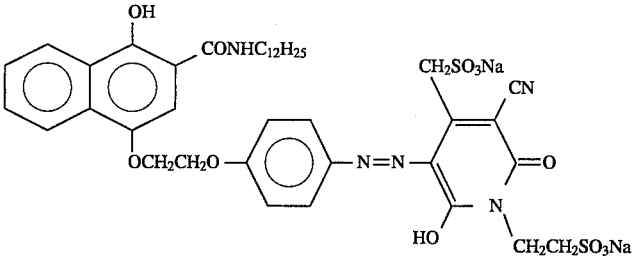

-continued
(YC-6)
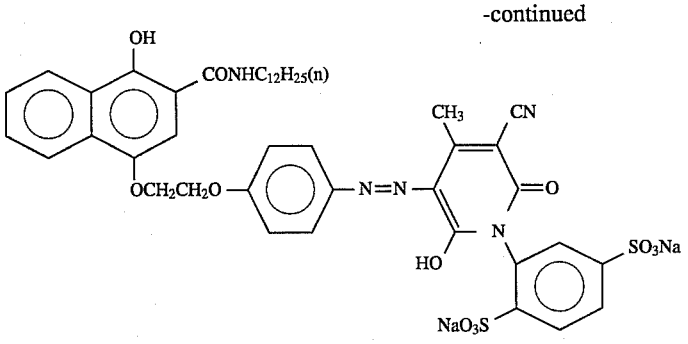
(YC-7)
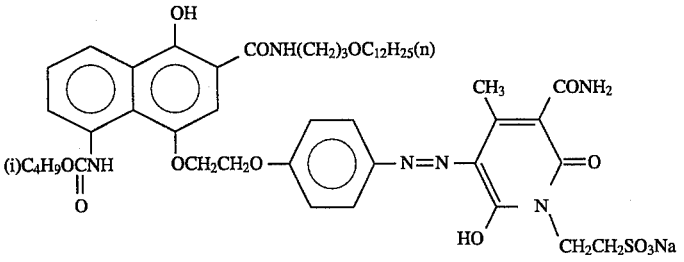
(YC-8)
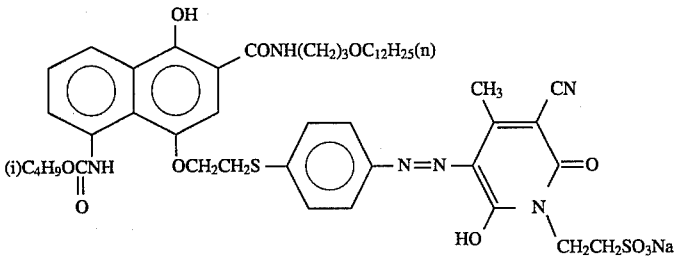
(YC-9)
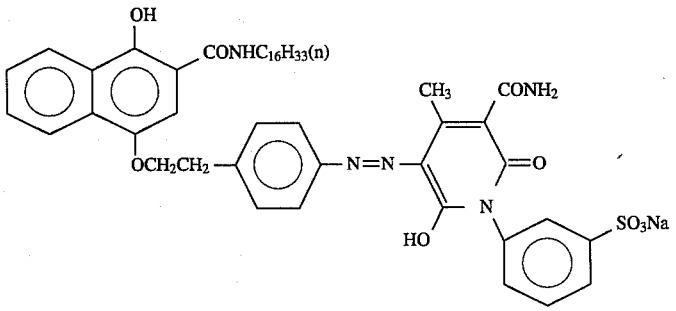
(YC-10)
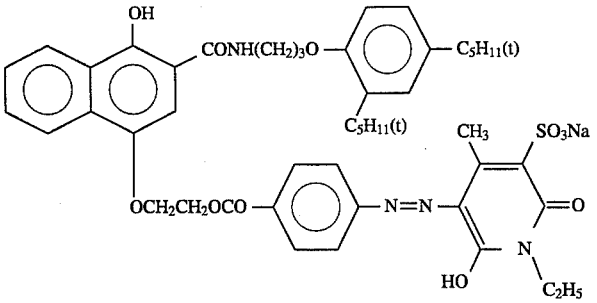

-continued
(YC-11)
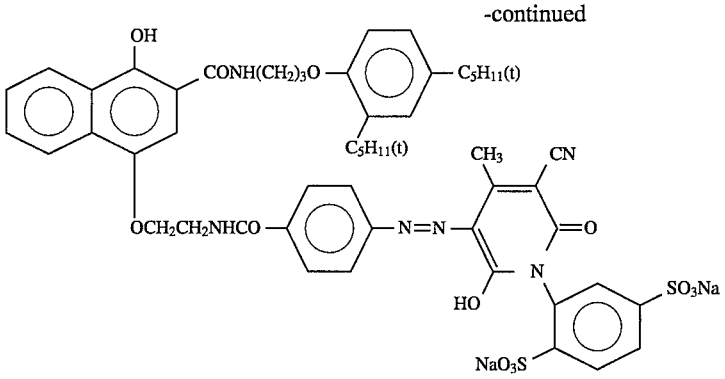
(YC-12)
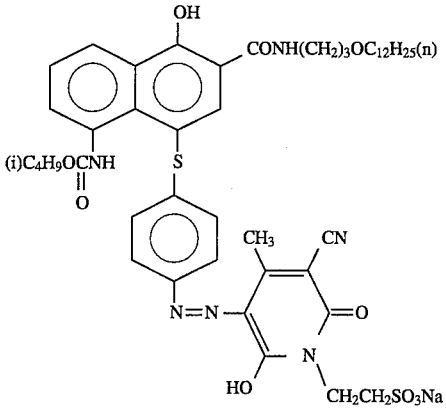
(YC-13)
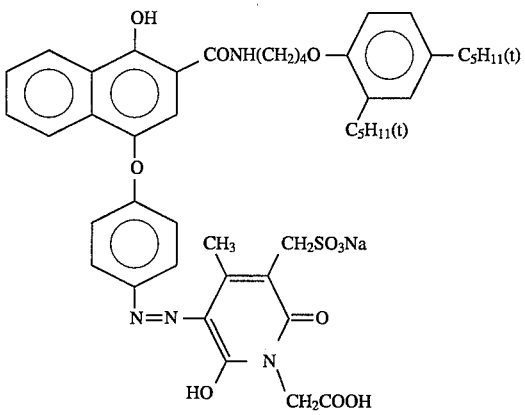
(YC-14)
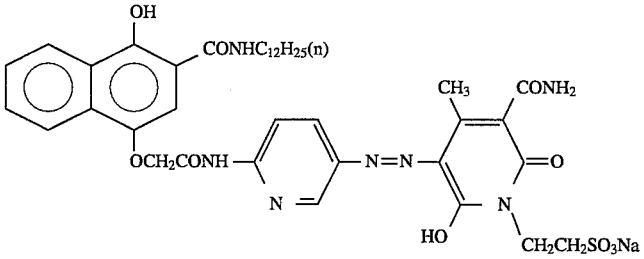
(YC-15)
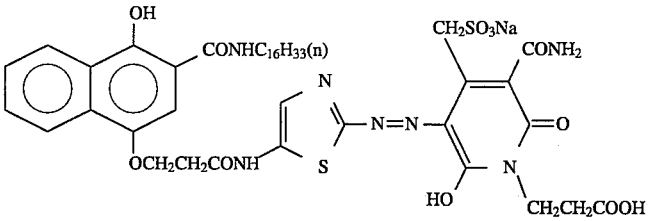

-continued
(YC-16)
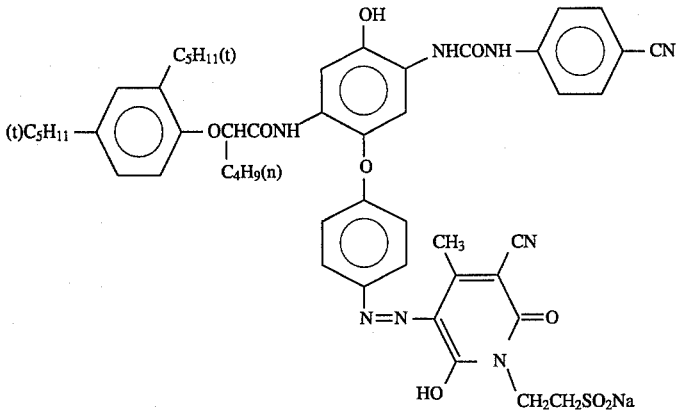
(YC-17)
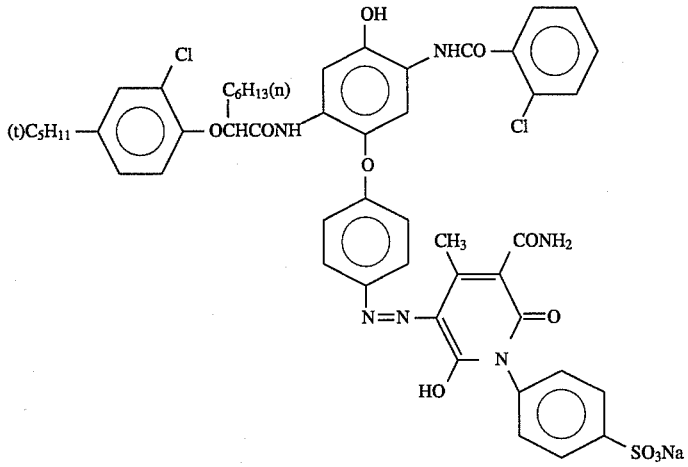
(YC-18)
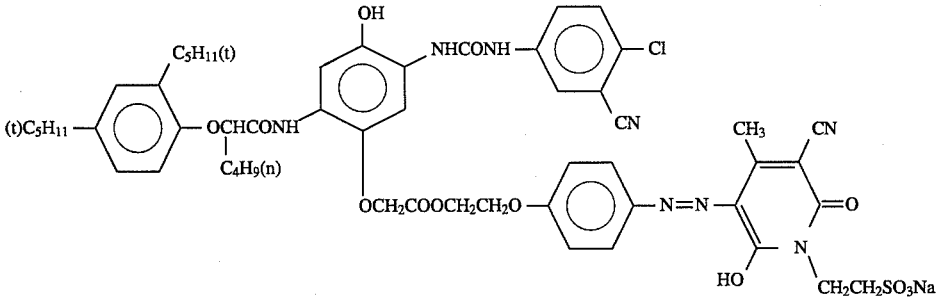
(YC-19)
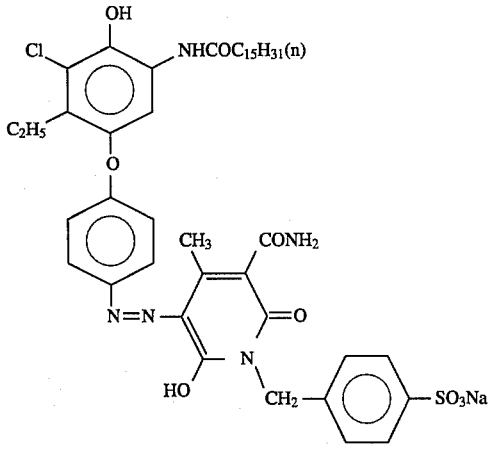

-continued
(YC-20)
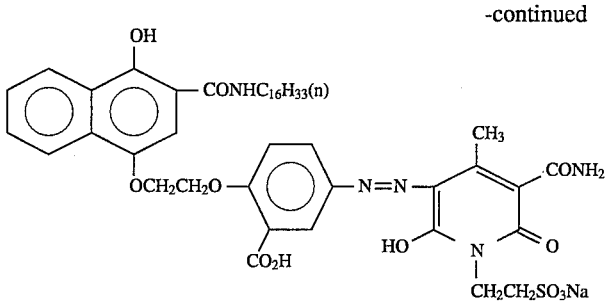
(YC-21)
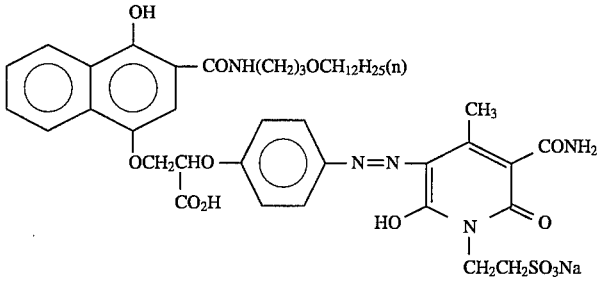
(YC-22)
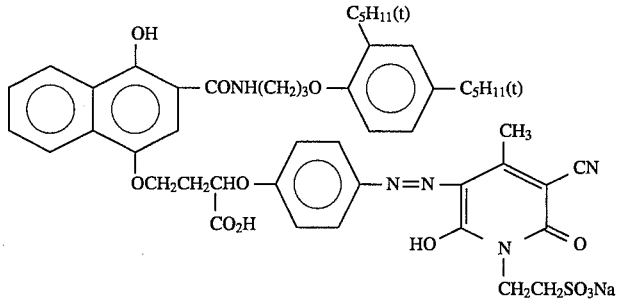
(YC-23)
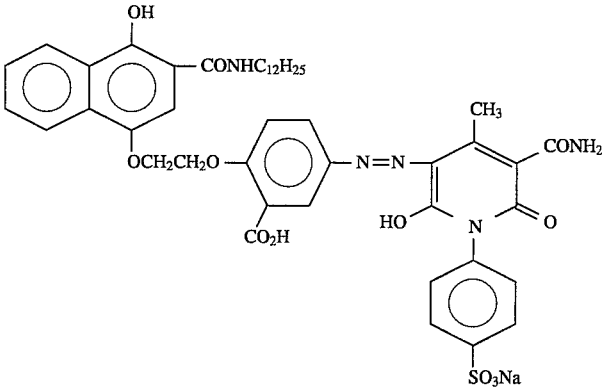
(YC-24)
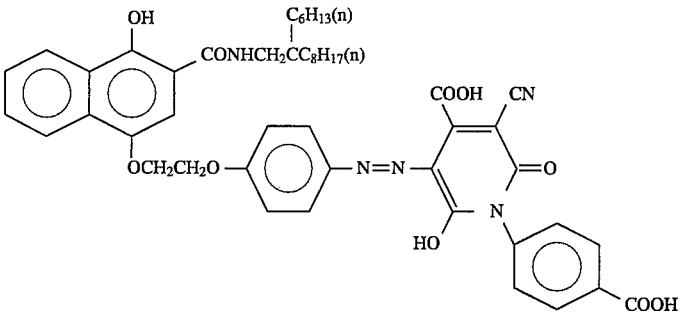

-continued
(YC-25)
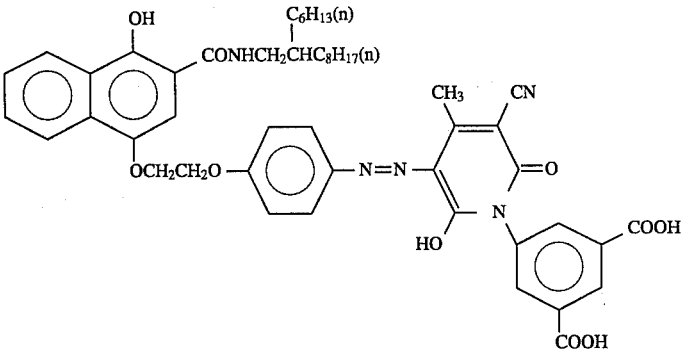
(YC-26)
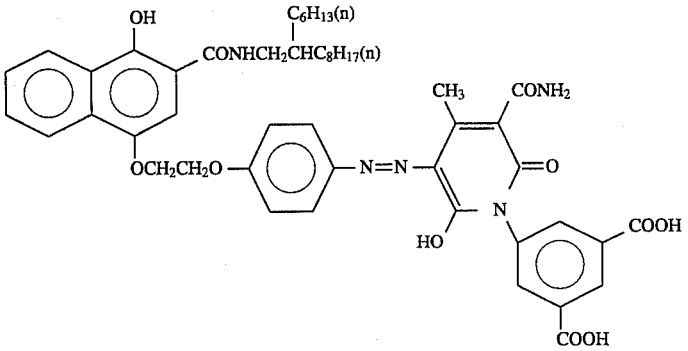
(YC-27)
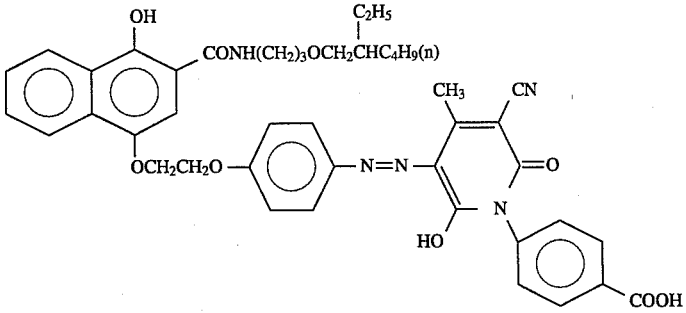
(YC-28)
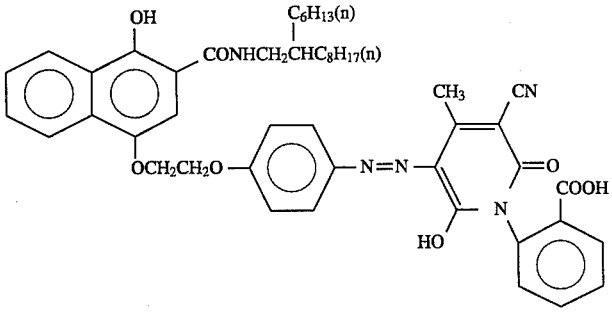
(YC-29)
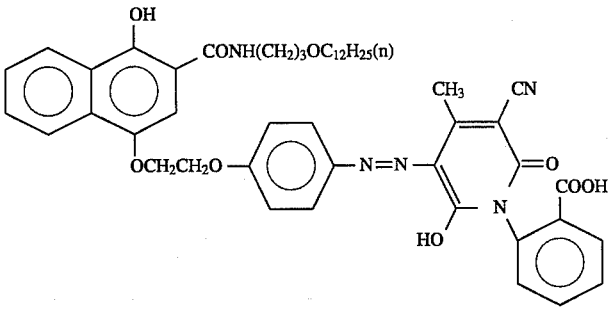

-continued
(YC-30)
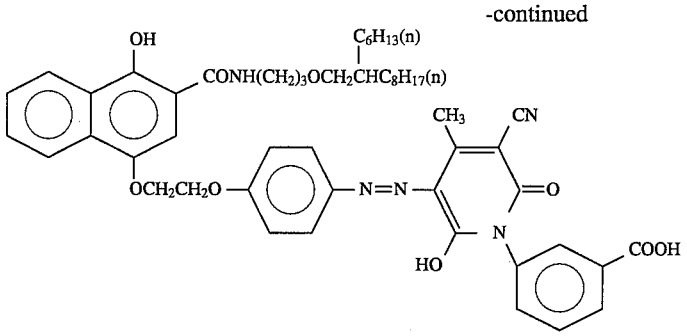
(YC-31)
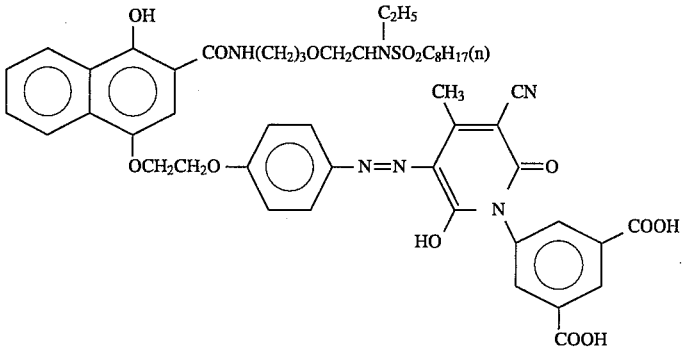
(YC-32)
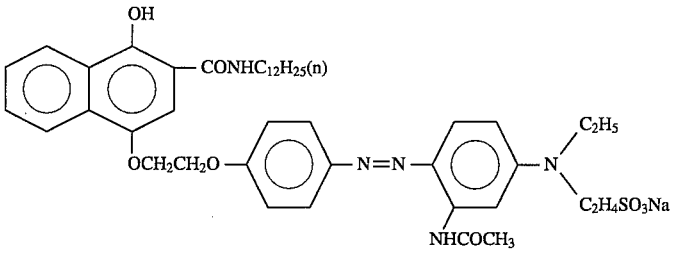
(YC-33)
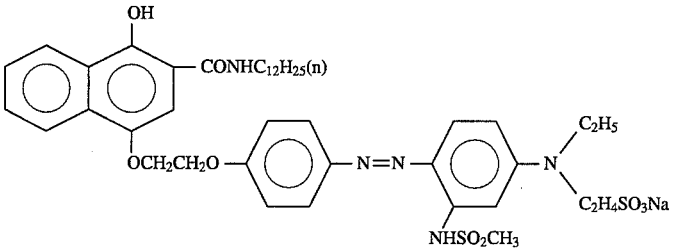
(YC-34)
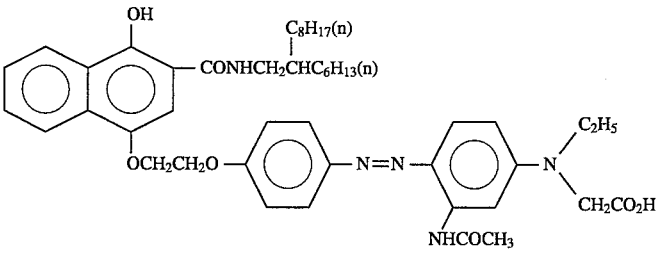
(YC-35)
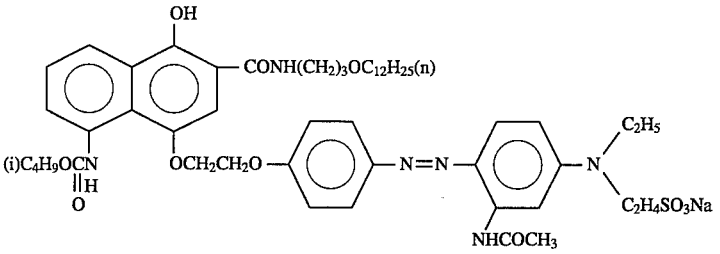

-continued
(YC-36)
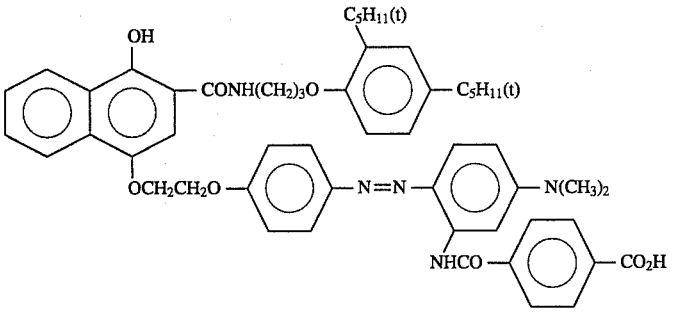
(YC-37)
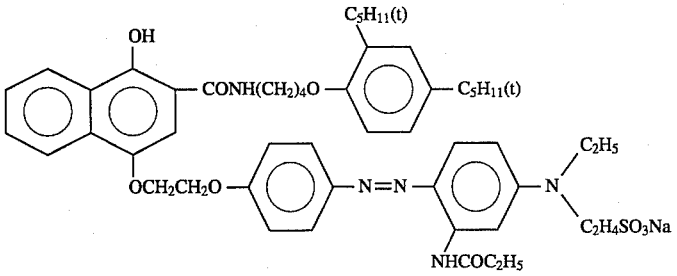
(YC-38)
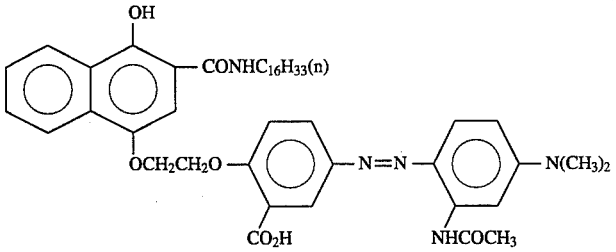
(YC-39)
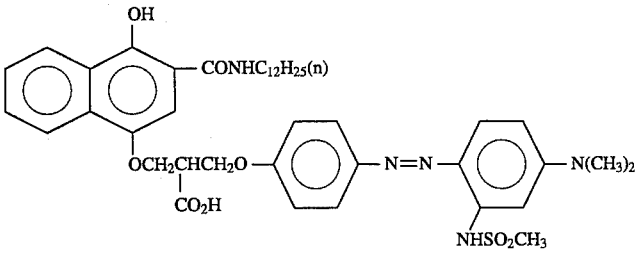
(YC-40)
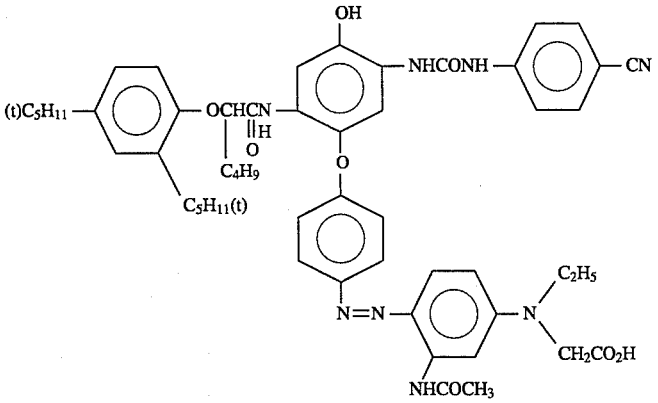

-continued
(YC-41)
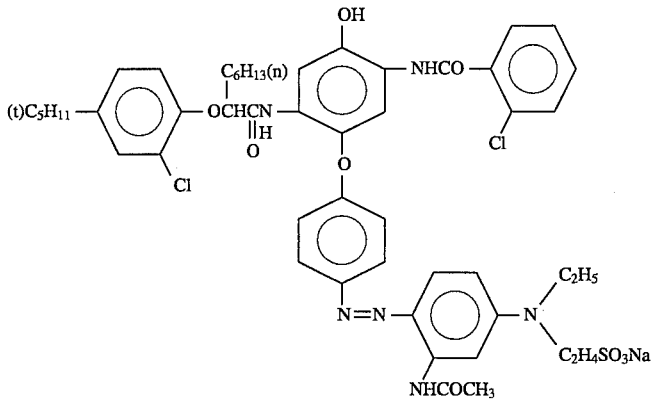
(YC-42)
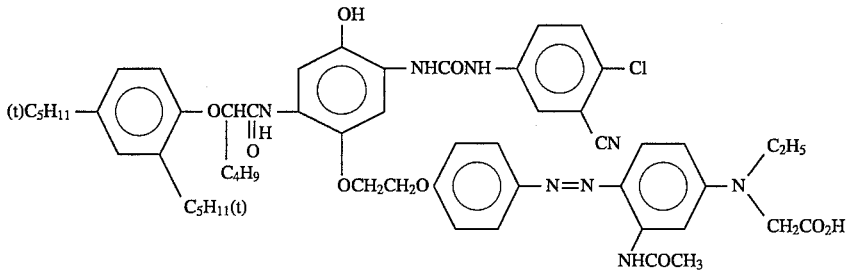
(YC-43)
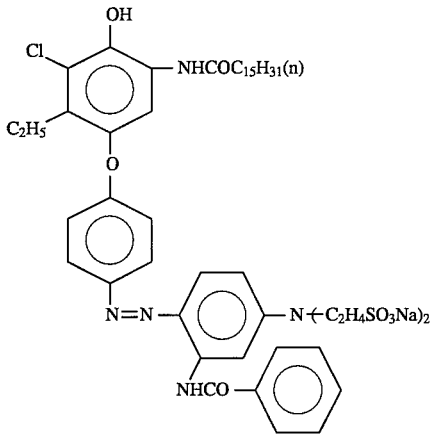
(YC-44)
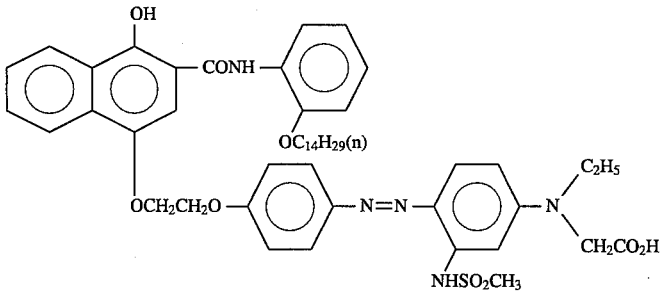

-continued
(YC-45)
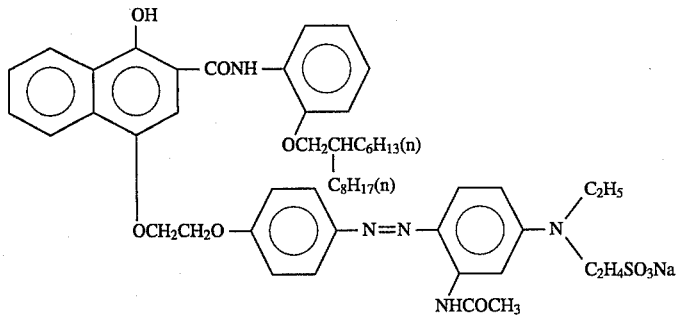
(YC-46)
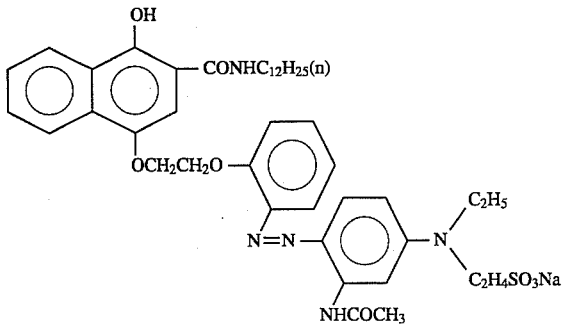
(YC-47)
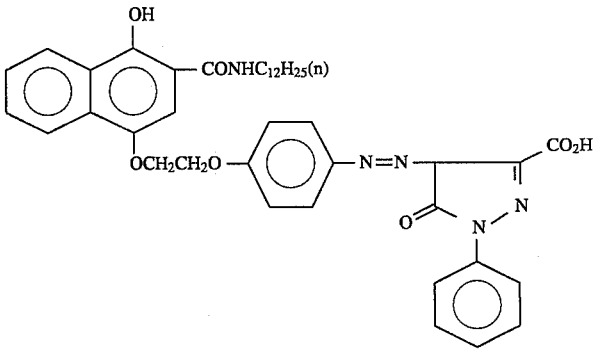
(YC-48)
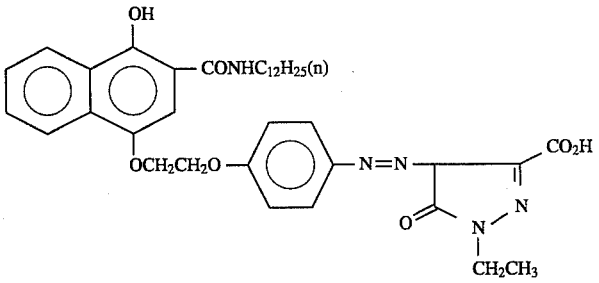
(YC-49)
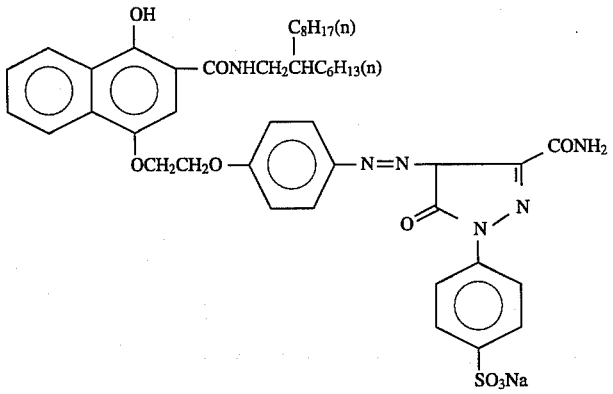

-continued
(YC-50)
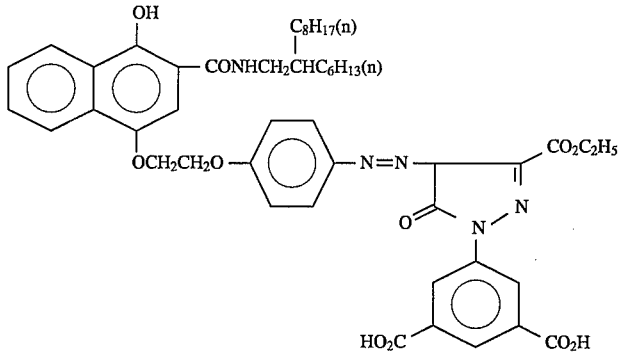
(YC-51)
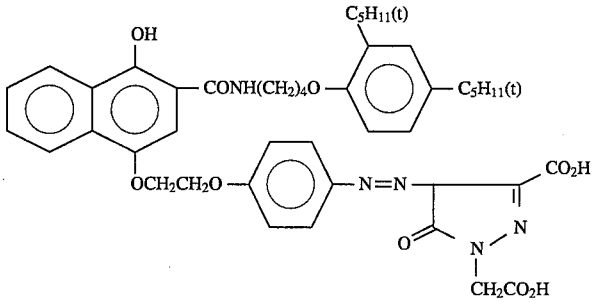
(YC-52)
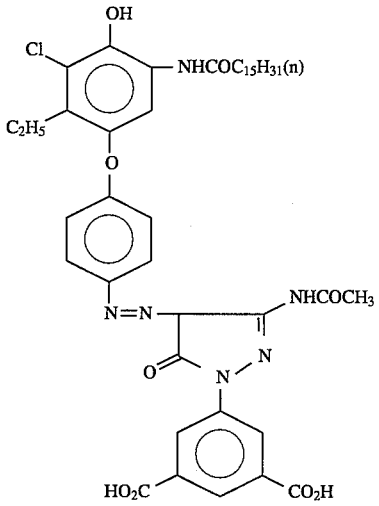
(YC-53)
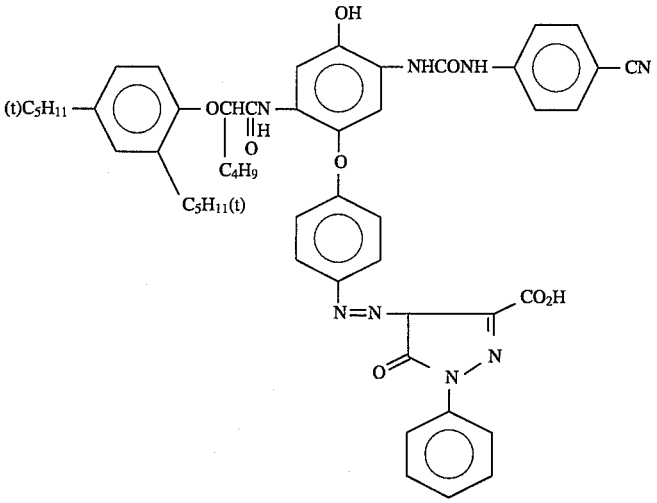

-continued

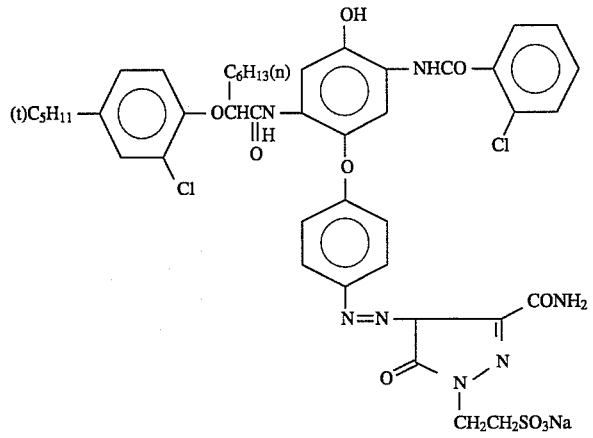

(YC-54)

Yellow colored couplers represented by formula (CI) of the present invention can in general be prepared by means of a diazo coupling reaction between a 6-hydroxy-2-pyridone and an aromatic diazonium salt or heterocyclic diazonium salt which contains the coupler structure.

The 6-hydroxy-2-pyridones can be prepared, for example, using the methods disclosed in *Heterocyclic Compounds Pyridines and Its Derivatives,* Part 3, edited by Grinsberg (Interscience Publishers, 1962), *J. Am. Chem. Soc.,* 1943, Vol. 65, page 449, *J. Chem. Tech. Biotechnol.,* 1986, Vol. 36, page 410, *Tetrahedron,* 1966, Vol. 22, page 455, JP-B-61-52827, West German Patents 2,162,612, 2,349,709 and 2,902,486, and U.S. Pat. No. 3,763,170, for example. (The term "JP-B" as used herein refers to an "examined Japanese patent publication".)

The diazonium salts can be prepared using the methods disclosed, for example, in U.S. Pat. Nos. 4,004,929 and 4,138,258, JP-A-61-72244 and JP-A-61-273543. The diazo coupling reaction between a 6-hydroxy-2-pyridone and a diazonium salt can be carried out in a solvent such as methanol, ethanol, methyl cellosolve, acetic acid, N,N-dimethylformamide, N,N-dimethylacetamide, tetrahydrofuran, dioxane or water, or in a mixture of such solvents. In this reaction, sodium acetate, potassium acetate, sodium carbonate, potassium carbonate, sodium bicarbonate, sodium hydroxide, potassium hydroxide, pyridine, triethylamine, tetramethylurea and tetramethylguanidine, for example, can be used as a base. The reaction temperature is normally between −78° C. and 60° C., and preferably between −20° C. and 30° C.

Examples of the synthesis of yellow colored couplers of the present invention are described below.

SYNTHESIS EXAMPLE 1

Preparation of Illustrative Coupler (YC-1)

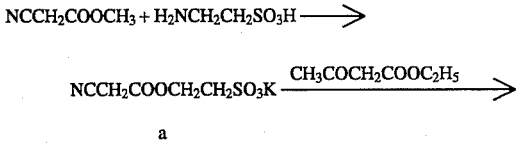

a

-continued

SYNTHESIS EXAMPLE 1

Preparation of Illustrative Coupler (YC-1)

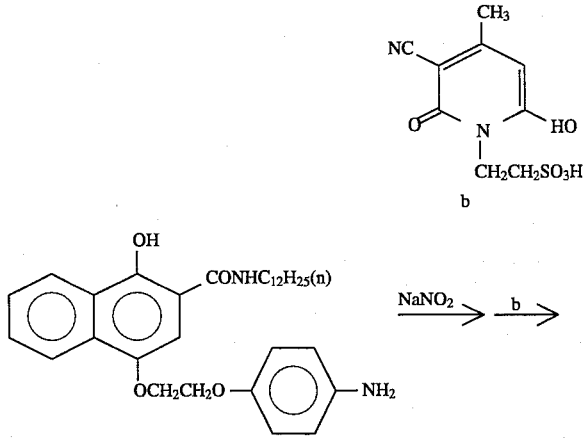

b

Illustrative Coupler (YC-1)

Preparation of Compound a:

Methanol (500 ml) was added to 125.2 g of taurine and 66 g of potassium hydroxide. The mixture was heated and stirred, and 110 g of methyl cyanoacetate was added dropwise over a period of about 1 hour. The mixture was heated under reflux for 5 hours, after which it was left to to stand overnight. The crystals which precipitated out were recovered by filtration, washed with ethanol and dried, whereupon 202.6 g of crystals of Compound a were obtained.

Preparation of Compound b:

Water (11.5 ml) was added to 11.5 g of Compound a and 3.5 g of potassium carbonate and 7.8 g of ethyl acetoacetate was added dropwise while stirring the mixture which was being heated on a steam bath. The mixture was then stirred for a period of 7 hours. After cooling, 9.2 ml of concentrated hydrochloric acid was added and crystals precipitated out on stirring. The crystals were recovered by filtration and washed with methanol and dried, whereupon 10.4 g of crystals of Compound b was obtained.

Preparation of Illustrative Coupler (YC-1):

Compound c (10.1 g) which had been prepared using the method disclosed in U.S. Pat. No. 4,138,258 was dissolved in 60 ml of N,N-dimethylformamide and 60 ml of methyl cellosolve, after which, with ice cooling, 4.3 ml of concentrated hydrochloric acid was added. A solution comprised of 5 ml of water and 1.84 g of sodium nitrite was then added dropwise to obtain a diazonium solution. Next, 60 ml of methyl cellosolve and 20 ml of water were added to 7.8 g of Compound b and 8.2 g of sodium acetate and the above mentioned diazonium solution was added dropwise while stirring and cooling the mixture in ice. After completion of the drip feed, the mixture was stirred for 1 hour and then for 2 hours at room temperature, and the crystals which precipitated out were recovered by filtration. After washing with water and drying, the crystals were dispersed in 500 ml of methanol, heated under reflux for 1 hour and then cooled. The crystals were recovered by filtration, washed with methanol and dried, whereupon 13.6 g of red colored crystals of the target compound illustrative Coupler (YC-1) were obtained. The melting point of this compound was 269° to 272° C. (with decomposition), and its structure was confirmed using $^1$HNMR spectroscopy, mass spectroscopy and elemental analysis. Moreover, the absorption maximum wavelength of this compound in methanol was 457.7 nm and the molecular extinction coefficient was 41,300. The compound exhibited preferred spectral absorbance and a very high molecular extinction coefficient as a yellow colored coupler.

SYNTHESIS EXAMPLE 2
Preparation of Illustrative Coupler (YC-3):

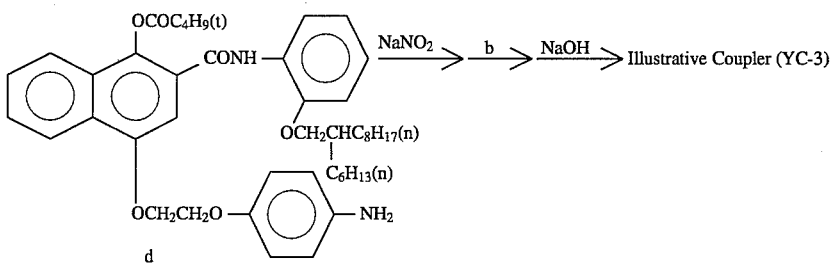

N,N-Dimethylformamide (75 ml) and 75 ml of methyl cellosolve were added to 19.2 g of Compound d which had been prepared using the method disclosed in JP-A-62u85242 and then, while cooling in ice and stirring, 5.6 ml of concentrated hydrochloric acid was added, followed by the dropwise addition of a solution comprised of 5 ml of water and 2.5 g of sodium nitrite. After the dropwise addition, the mixture was stirred for 1 hour and then for 1 hour at room temperature to obtain a diazonium solution.

Methyl cellosolve (75 ml) and 26 ml of water were added to 10.1 g of Compound b and 10.7 g of sodium acetate, and the above prepared diazonium solution was added dropwise while stirring and ice cooling the mixture. After the drip feed, the mixture was stirred for 1 hour and then for 2 hours at at room temperature, and the crystals which precipitated out were recovered by filtration. Next, the crystals were dispersed in 200 ml of methanol, a solution comprised of 10 ml of water and 2.2 g of sodium hydroxide was added dropwise and the mixture was stirred for 3 hours. The mixture was then neutralized with concentrated hydrochloric acid, and the crystals which precipitated out were washed with water and methanol and then dried. The crude crystals obtained were refined with hot methanol in the same way as in Synthesis Example 1, and 14.8 g of the target compound illustrative Coupler (YC-3) were obtained. The melting point of this compound was 246° to 251° C. (with decomposition), and its structure was confirmed using $^1$HNMR spectroscopy, mass spectroscopy and elemental analysis. Moreover, the absorption maximum wavelength of this compound in methanol was 457.6 nm, the molecular extinction coefficient was 42,700, and the compound exhibited good spectral absorption characteristics as a yellow colored coupler.

SYNTHESIS EXAMPLE 3
Preparation of Illustrative Coupler (YC-28):

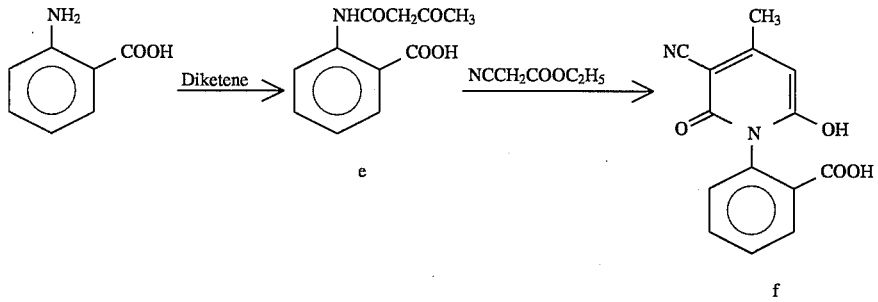

-continued

SYNTHESIS EXAMPLE 3

Preparation of Illustrative Coupler (YC-28):

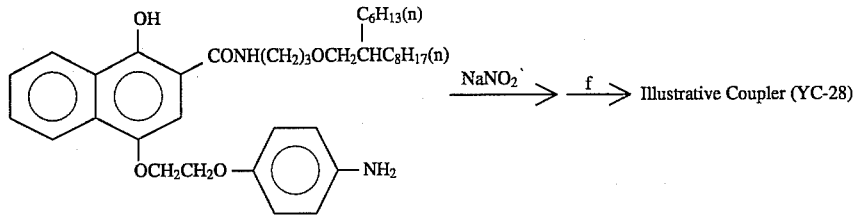

Preparation of Compound e:

Anthranilic acid (137.1 g) was added to 600 ml of acetonitrile and 92.5 g of diketene was added dropwise over a period of about 1 hour while heating and stirring the mixture. After heating under reflux for 1 hour the mixture was cooled to room temperature, the crystals which precipitated out were recovered by filtration, washed with acetonitrile and dried, and 200.5 g of crystals of Compound e were obtained.

Preparation of Compound f:

Compound e (199.1 g), 89.2 g of ethyl cyanoacetate and 344 g of 28% sodium methoxide were added to 0.9 liter of methanol and reacted for 8 hours at 120° C. on an autoclave. After standing overnight, the reaction mixture was concentrated under reduced pressure, 700 ml of water was added and the mixture was rendered acidic with 230 ml of concentrated hydrochloric acid. The crystals which precipitated out were recovered by filtration and the crude crystals obtained were heated and washed in a mixture of ethyl acetate and acetonitrile and 152 g of Compound f were obtained.

Preparation of Illustrative Coupler (YC-28):

Compound g (13.0 g) prepared in accordance with the method disclosed in U.S. Pat. No. 4,138,258 was dissolved in 40 ml of N,N-dimethylformamide, 4.5 ml of concentrated hydrochloric acid was added with ice cooling and then a solution comprised of 5 ml of water and 1.48 g of sodium nitrite was added dropwise to obtain a diazonium solution. Next, 20 ml of N,N-dimethylformamide and 15 ml of water were added to 6.0 g of Compound f and 8 g of sodium acetate, and the above mentioned diazonium solution was added dropwise while stirring and ice cooling the mixture. After completion of the drip feed the mixture was stirred for 30 minutes at room temperature. The mixture was acidified with hydrochloric acid, extracted with ethyl acetate and washed with water, after which the mixture was concentrated under reduced pressure. The concentrate was recrystallized from a mixed ethyl acetate/methanol solvent to obtain 13 g of yellow crystals of illustrative Coupler (YC-28). The melting point of this Coupler (YC-28) was 154° to 156° C. and the structure was confirmed using $^1$HNMR spectroscopy, mass spectroscopy and elemental analysis. Moreover, the absorption maximum wavelength of this compound in methanol was 458.2 nm and the molecular extinction coefficient was 42,800, and the compound exhibited good spectral absorption characteristics as a yellow colored coupler.

Yellow colored couplers represented by formulae (CII) to (CIV) can be prepared using the methods disclosed in JP-B-58-6939 and JP-A-1-197563, and using the methods disclosed in the above noted patents as methods for the preparation of couplers represented by formula (CI).

In the present invention, the use of yellow colored cyan couplers represented by formulae (CI) and (CII) is preferred, and the use of those represented by formula (CI) is especially desirable.

The yellow colored cyan couplers of the present invention are preferably added to a photosensitive silver halide emulsion layer or a layer adjacent thereto in the photosensitive material, and are most desirably added to a red-sensitive silver halide emulsion layer. The total amount added to a photosensitive material is from 0.005 to 0.30 g/m$^2$, preferably from 0.02 to 0.20 g/m$^2$, and most desirably from 0.03 to 0.15 g/m$^2$.

The yellow colored cyan couplers of the present invention can be added to the sensitive material in the same way as conventional couplers as described below.

The tabular silver halide emulsion for use in the present invention is described in detail below.

Regarding the tabular silver halide emulsion for use in the present invention, the average aspect ratio signifies the average value of the ratio of the diameter with respect to the thickness of the silver halide grains. Namely, the aspect ratio is the average value of the values obtained by dividing the diameter of each silver halide grain by its thickness. Here, the diameter is taken as the diameter of a circle which has the same area as the projected area of the grain when the silver halide emulsion is observed using a microscope or an electron microscope. Hence, when the average aspect ratio is at least 2:1, this signifies that the diameter of this circle is at least twice the thickness of the grain.

The tabular silver halide grains for use in the silver halide emulsions of the present invention have a grain diameter of at least twice the grain thickness, but it is preferably from 3 to 20 times, more desirably from 4 to 15 times, and most desirably from 5 to 10 times the grain thickness. Furthermore, the proportion of the projected area of all of the silver halide grains accounted for by tabular silver halide grains is at least 50%, but it is preferably at least 70% and most desirably at least 85%.

It is possible to obtain silver halide photographic photosensitive materials which have excellent sharpness using emulsions of this type. Excellent sharpness is achieved because the light scattering by a tabular emulsion layer is very small when compared with that observed with a conventional emulsion layer. This fact is readily confirmed using methods well known in the industry. The reason why the extent of light scattering in a tabular silver halide emulsion layer is so low is unclear, but it is considered that it may be due to the principal planes in the tabular silver halide emulsion being orientated in a direction parallel with the surface of the support.

Furthermore, the diameter of the tabular silver halide grains of the present invention is from 0.2 to 20 μm, preferably from 0.3 to 10.0 μm, and most desirably from 0.4 to 5.0 μm. The thickness of the grains is preferably not more than 0.5 μm. Here, the tabular silver halide grain diameter is the diameter of a circle of area equal to the projected area of the grain. Furthermore, the grain thickness is represented by the distance between the two parallel surface from which the tabular silver halide grain is constructed.

In the present invention, the preferred tabular silver halide grains have a grain diameter of at least 0.3 μm and not more than 10.0 μm, and a grain thickness of not more than 0.3 μm and, moreover, the average (diameter/thickness) value is at least 5 but not more than 10. If these values are exceeded, anomalies arise in photographic performance when the photosensitive material is folded, wound up tightly or touched with a sharp object, and this is undesirable. Silver halide photographic emulsions containing grains of diameter at least 0.4 μm but not more than 5.0 μm and of average (diameter/thickness) value at least 5, and which grains account for at least 85% of the total projected area of all the grains are most desirable.

The tabular silver halide grains for use in the present invention may be comprised of silver chloride, silver bromide, silver chlorobromide, silver iodobromide or silver chloroiodobromide, but silver bromide, silver iodobromide containing not more than 15 mol % silver iodide or silver chlorobromide or silver chloroiodobromide containing not more than 50 mol % silver chloride and not more than 2 mol % silver iodide are preferred, and the composition distribution in a mixed silver halide may be uniform or localized.

Furthermore, the grain size distribution may be narrow or wide.

The tabular silver halide emulsions for use in the present invention have been disclosed in a report by Cugnac and Chateau, on pages 66 to 72 of *Photographic Emulsion Chemistry,* edited by Duffin (Focal Press, New York, 1966) and by A. P. H. Trivelli and W. D. Smith in *Phot. Journal,* 80 (1940), page 285, and the tabular silver halide emulsions are readily prepared by reference to the methods disclosed in JP-A-58-113927, JP-A-58-113928 and JP-A-58-127921.

For example, the tabular silver halide emulsions can be obtained by forming seed crystals among which tabular grains are present in an amount of at least 40% under conditions of pBr not more than 1.3 at comparatively high pAg values, and growing the seed crystals by adding silver and halogen solutions simultaneously while maintaining a similar pBr value. It is desirable that the soluble silver salt and halide solutions are added in such a way that no new crystal nuclei are formed in the grain growth process.

The size of the tabular silver halide grains can be controlled by controlling the temperature, selecting the type and nature of the solutions and controlling the rate of addition of the silver salt and the halide which are used during grain growth.

The grain size, the form of the grains (diameter/thickness ratio, for example), the grain size distribution and the growth rate of the grains can be controlled by using silver halide solvents, are required, during the preparation of the tabular silver halide grains of the present invention. The amount of solvent used is preferably within the range of from $10^{-3}$ to 1.0 wt %, and most desirably within the range of from $10^{-2}$ to $10^{-1}$ wt %, of the reaction solution. In the present invention, the grain size distribution tends to become monodisperse as the amount of solvent used is increased, and the growth rate can be increased. On the other hand, the thickness of the grains tends to increase as the amount of solvent used is increased.

Known silver halide solvents can be used in the present invention. Frequently used silver halide solvents include, for example, ammonia, thioether, thioureas, thiocyanate and thiazoline thiones. Reference can be made to U.S. Pat. Nos. 3,271,157, 3,574,628 and 3,790,387, for example, with regard to thioether solvents. Furthermore, reference can be made to JP-A-53-82408 and JP-A-55-77737 in connection with thioureas, to U.S. Pat. Nos. 2,222,264, 2,448,534 and 3,320,069 in connection with thiocyanate and to JP-A-53-144319 in connection with thiazoline thione solvents.

As described in U.S. Pat. Nos. 3,890,154, 3,901,711, 4,173,483, 4,269,927 and 4,835,093 and European Patent 264,288, cadmium salts, zinc salts, lead salts, thallium salts, iridium salts and complex salts thereof, rhodium salts and complex salts thereof, and iron salts and complex salts thereof, for example, may be present during the processes of formation or physical ripening of the silver halide grains.

The methods in which the rates of addition of the silver salt solution (for example, aqueous $AgNO_3$ solution) and halide solution (for example, aqueous KBr solution), the amounts added and the addition concentrations are increased in order to speed up grain growth are preferably used when manufacturing the tabular silver halide grains for use in the present invention. Reference can be made, for example, to U.S. Pat. Nos. 1,335,925, 3,650,757, 3,672,900 and 4,242,445, JP-A-55-142329 and JP-A-55-158124 in connection with these methods.

Various compounds can be included in the photographic emulsion for use in the present invention to prevent the occurrence of fogging during the manufacture, storage or photographic processing of the photosensitive material or to stabilize photographic performance. Namely, various compounds which are known as antifoggants and stabilizers, for example, azoles such as benzothiazolium salts, nitroimidazoles, triazoles, benzotriazoles, benzimidazoles (especially nitro or halogen substituted benzimidazoles); heterocyclic mercapto compounds, such as mercaptothiazoles, mercaptobenzothiazoles, mercaptobenzimidazoles, mercaptothiadiazoles, mercaptotetrazoles (especially 1-phenyl-5-mercaptotetrazole), mercaptopyrimidines; heterocyclic mercapto compounds as indicated above which have water solubilizing groups, for example, carboxyl groups or sulfo groups; thioketo compounds such as oxazolinethione, for example; azaindenes, for example, triazaindenes, tetraazaindenes (especially 4-hydroxy-substituted (1,3,3a,7)-tetraazaindene); benzenethiosulfonic acids and benzenesulfinic acid can be added to the photographic emulsion. Reference cab be made to U.S. Pat. Nos. 3,954,474, 3,982,947, 4,021,248 or JP-B-52-28660 for more details of actual examples and methods of using these materials.

The above described emulsions of the present invention are preferably monodisperse emulsions.

A monodisperse emulsion in the context to the present invention is an emulsion having a grain size distribution such that the variation coefficient $S/\bar{r}$ relating to the grain size of the silver halide grains is not more than 0.25. Here, $\bar{r}$ is the average grain size and S is the standard deviation. Thus, if the size of each individual grain is ri and the number of silver halide grains is ni, the average grain size $\bar{r}$ is defined by the following equation:

$$\bar{r} = \frac{\Sigma ni \cdot ri}{\Sigma ni}$$

Moreover, the standard deviation S is defined by the following equation:

$$S=\sqrt{\frac{\Sigma(\bar{r}-ri)^2\cdot ni}{\Sigma ni}}$$

The size of the individual grains in the present invention is the diameter corresponding to the projected area when the silver halide emulsion is subjected to microphotography (usually electron microscope photography) using methods well known in the art as described by T. H. James in *The Theory of the Photographic Process,* third edition, pages 36 to 43. Here, the corresponding projected area of a silver halide grain is defined as the diameter of a circle, the area of which is equal to the projected area of the silver halide grain as indicated in the above noted literature reference. Hence, the average grain size $\bar{r}$ and its standard deviation S as described above can be obtained in cases where the form of the silver halide grains is other than spherical (for example, when the grains are cubic, octahedral, tetradecahedral, tabular or potato shaped).

The variation coefficient of the grain size of the silver halide grains is not more than 0.25, and is preferably not more than 0.20, and most desirably is not more than 0.15.

The monodisperse hexagonal tabular silver halide emulsions disclosed in JP-A-63-151618 are especially desirable as tabular silver halide emulsions of the present invention.

Here, a hexagonal tabular silver halide grain is such that the shape of its {1,1,1} plane is hexagonal, and is characterized by having a ratio of adjacent sides of not more than 2. Here, the ratio of adjacent sides is the ratio of the length of the longest side with respect to the length of the shortest side forming the hexagonal shape. If the ratio of adjacent sides is less than 2, the corners are considered to be rounded. The edge length in cases where the corners are rounded is represented by the distance between the points of intersection of the lines extending from the straight line parts of the adjoining sides with the extension of the straight line part of the side under consideration. Each side of the hexagonal shape of a hexagonal tabular grain of the present invention preferably has at least ½ of its length as a substantially straight line, and most desirably has at least ⅘th of its length as a substantially straight line. A ratio of adjacent sides of from 1 to 1.5 is desirable in the present invention.

Hexagonal tabular silver halide emulsions of the present invention are comprised of a dispersion medium and silver halide grains, and at least 50%, preferably at least 70%, and most desirably at least 90%, of the total projected area of the silver halide grains is accounted for by the above described hexagonal tabular silver halide grains.

In the present invention, the halogen composition of the hexagonal tabular silver halide grains may be silver bromide, silver iodobromide, silver chlorobromide or silver chloroiodobromide, but silver bromide or silver iodobromide is preferred. In the case of silver iodobromide, the silver iodide content is from more than 0 to 30 mol %, preferably from 2 to 15 mol %, and most desirably from 4 to 12 mol %. The distribution of silver iodide within the grains may be uniform throughout the whole grain, or the silver iodide content in the interior part and the surface layer of the grain may be different, or the grain may have a multilayer structure in which there are layers having different silver iodide contents within the grain. Internal iodide type grains in which the silver iodide content at the grain surface is less than that within the grain are preferred.

Reference can be made to U.S. Pat. No. 4,797,354 in connection with methods for the manufacture of hexagonal tabular silver halide emulsions.

The preparation of monodisperse hexagonal tabular silver halide emulsions is divided into the processes of nuclei formation, Ostwald ripening and grain growth. During nuclei formation, the pBr value is maintained at 1.0 to 2.5, and nuclei formation is carried out under supersaturated, conditions (temperature, gelatin concentration, addition rates of the aqueous silver salt solution and the aqueous alkali metal halide solution, the pBr value, the iodine ion content, the stirring rate, the pH, the silver halide solvent content and the salt concentration, etc.) to optimize the formation of nuclei which have parallel twinned crystal planes (tabular grain nuclei). During Ostwald ripening, the temperature, the pBr value, the pH value, the gelatin concentration and the amount of silver halide solvent, etc., are adjusted such that the grains other than the tabular grains which have been formed during nuclei formation are dissolved. Thus, substantially only tabular nuclei are grown, and nuclei having good monodispersivity are obtained. Hexagonal tabular silver halide grains which have the prescribed aspect ratio and grain size can then be obtained by controlling the pBr value and the amounts of silver ion and halogen ion which are added during grain growth. The rate of addition of silver ion and halogen ion during grain growth is preferably from 30% to 100% of the limiting crystal growth rate.

The tabular silver halide emulsions of the present invention are generally subjected to chemical sensitization.

Chemical sensitization can be carried out after silver halide emulsion formation as described above, and the above described emulsion may be washed with water after formation of the silver halide emulsion and before chemical sensitization.

Chemical sensitization is described in *Research Disclosure,* No. 17643 (December, 1978, page 23) and in *Research Disclosure,* No. 18716 (November, 1979, page 648, right hand column, and can be carried out at a pAg of from 5 to 10, a pH of from 5 to 8 and at a temperature of from 30° C. to 80° C. using sulfur, selenium, tellurium, gold, platinum, palladium, iridium or a combination of these sensitizing agents.

Furthermore, the tabular silver halide emulsion of the present invention is preferably chemically sensitized in the presence of a spectral sensitizing dye. Methods of chemical sensitization in the presence of a spectral sensitizing dye are disclosed, for example, in U.S. Pat. Nos. 4,425,426 and 4,442,201, JP-A-59-9658, JP-A-61-103149 and JP-A-61-133941. Spectral sensitizing dyes generally used in silver halide photographic photosensitive materials can be used for this purpose, and useful spectral sensitizing dyes are described on pages 23 and 24 of *Research Disclosure,* No. 17643 and from the right hand column on page 648 to the right hand column on page 649 of *Research Disclosure,* No. 18716.

A single type of spectral sensitizing dye may be used, or combination of such dyes may be used.

The time of the addition of the spectral sensitizing dye may be before the commencement of chemical sensitization (during grain formation, after the completion of grain formation or after washing with water), during chemical sensitization or after the completion of chemical sensitization. Addition of the spectral sensitizing dye after the completion of grain formation and before the commencement of chemical sensitization or after the completion of chemical sensitization is preferred.

The amount of spectral sensitizing dye added depends on the particular application, but from 30 to 100% of the saturation adsorption amount is generally employed, and from 50% to 90% of the saturated adsorption amount is preferable.

The tabular silver halide emulsion of the present invention is normally subjected to spectral sensitization. The spectral sensitizing dyes described above and in the two *Research Disclosures* indicated above can be used as spectral sensitizing dyes. Emulsions prepared wherein a spectral sensitizing dye is present at the time of chemical sensitization, as described above, may be further subsequently subjected to spectral sensitization using the same dye or a different type of dye.

The tabular emulsions of the present invention may be used individually in a photosensitive emulsion layer, or two or more emulsions having a different average grain size or two or more emulsions having a different silver iodide content may be mixed and used in the same photosensitive layer. The use of mixed emulsions, as indicated above, is preferred from the viewpoint of contrast control, control of graininess over a wide exposure range, and control of color developer dependence (dependence on time and the composition in the developer of sodium sulfite salts of the color developing agent, for example, and dependence on pH).

Furthermore, emulsions for use in the present invention have been disclosed in JP-A-60-143332 and JP-A-60-254032, and the relative standard deviation of the silver iodide content between grains is most desirably not more than 20%.

The use of compounds represented by formula (A) indicated below is most desirable in the present invention for improving photographic speed, graininess and desilvering properties.

$$Q—SM^1 \qquad (A)$$

In the above formula, Q represents a heterocyclic group bonded to at least one member selected from the group consisting of $—SO_3M^2$, $—COOM^2$, —OH and $—NR^1R^2$ directly or indirectly through a divalent group such as an alkylene group, $M^1$ and $M^2$ each independently represents a hydrogen atom, an alkali metal, quaternary ammonium or quaternary phosphonium, and $R^1$ and $R^2$ (which may be the same or different) each represents a hydrogen atom or a substituted or unsubstituted alkyl group of carbon number of 1 to 6 (for example, methyl, ethyl, isopropyl).

Useful examples of the heterocyclic group represented by Q in formula (A) include an oxazole ring, a thiazole ring, an imidazole ring, a selenazole ring, a triazole ring, a tetrazole ring, a thiadiazole ring, an oxadiazole ring, a pentazole ring, a pyrimidine ring, a thiazine ring, a triazine ring and a thiadiazine ring, and rings which are bonded with other carbocyclic or heterocyclic rings, such as a benzothiazole ring, a benzotriazole ring, a benzimidazole ring, a benzoxazole ring, a benzoselenazole ring, a naphthoxazole ring, a triazaindolizine ring, a diazaindolizine ring and a tetraazaindolizine ring.

Those compounds represented by formulae (B) and (C) are especially desirable from among the mercapto heterocyclic compounds represented by formula (A).

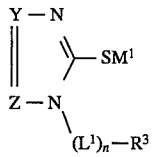

(B)

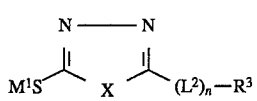

(C)

In formula (B), Y and Z each independently represents a nitrogen atom or $CR^4$ (where $R^4$ represents a hydrogen atom, a substituted or unsubstituted alkyl group, or a substituted or unsubstituted aryl group), and $R^3$ represents an organic residual group which is substituted with at least one species selected from $—SO_3M^2$, $—COOM^2$, —OH and $—NR^1R^2$, and useful examples of $R^3$ include alkyl groups having from 1 to 20 carbon atoms (for example, methyl, ethyl, propyl, hexyl, dodecyl, octadecyl) and aryl groups having from 6 to 20 carbon atoms (for example, phenyl, naphthyl), $L^1$ represents a linking group selected from among —S—, —O—, $$—\overset{|}{N}—,$$

—CO—, —SO— and $—SO_2—$, and n is 0 or 1.

The above noted alkyl groups and aryl groups may be substituted with other substituent groups, such as a halogen atom (for example, F, Cl, Br), an alkoxy group (for example, methoxy, methoxyethoxy), an aryloxy group (for example, phenoxy), an alkyl group (where $R^2$ is an aryl group), an aryl group (when $R^2$ is an alkyl group), an amido group (for example, acetamido, benzoylamino), a carbamoyl group (for example, unsubstituted carbamoyl, phenylcarbamoyl, methylcarbamoyl), a sulfonamido group (for example, methanesulfonamido, phenylsulfonamido), a sulfamoyl group (for example, unsubstituted sulfamoyl, methylsulfamoyl, phenylsulfamoyl), a sulfonyl group (for example, methylsulfonyl, phenylsulfonyl), a sulfinyl group (for example, methylsulfinyl, phenylsulfinyl), a cyano group, an alkoxycarbonyl group (for example, methoxycarbonyl), an aryloxycarbonyl group (for example, phenoxycarbonyl) and a nitro group.

In those cases where there are two or more substituent groups $—SO_3M$, $—COOM^2$, —OH and $—NR^1R^2$ or $R^3$, these groups may be the same or different.

$R^1$, $R^2$, $M^1$ and $M^2$ have the same significance as in formula (A).

In formula (C), X represents a sulfur atom, an oxygen atom or $$—\underset{\underset{R^5}{|}}{N}—,$$

and $R^5$ represents a hydrogen atom, a substituted or unsubstituted alkyl group or a substituted or unsubstituted aryl group selected from those represented by $R^4$ in formula (B).

$L^2$ represents $—CONR^6—$, $—NR^6CO—$, $—SO_2NR^6—$, $NR^6SO_2—$, —OCO—, —COO—, —S—, $—NR^6—$, —CO—, —SO—, —OCOO—, $—NR^6CONR^7—$, $—NR^6COO—$, $—OCONR^6—$ or $—NR^6SO_2NR^7—$, and $R^6$ and $R^7$ each represents a hydrogen atom, a substituted or unsubstituted alkyl group or a substituted or unsubstituted aryl group selected from those represented by $R^4$ in formula (B).

$R^3$ and $M^1$ have the same significance as those in formulae (A) and (B), and n represents 0 or 1.

Moreover, the substituent groups for the substituted alkyl groups and substituted aryl groups represented by $R^5$, $R^6$ and $R^7$ are the same as the substituent groups for $R^4$.

In the above formulae, $R^3$ is most desirably $—SO_3M^2$ or $—COOM^2$.

Useful examples of preferred compounds represented by formula (A) for use in the present invention are indicated below.

(1)
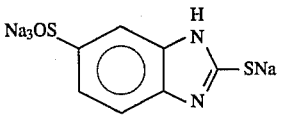
(2)
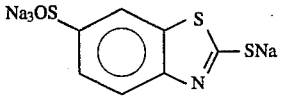
(3)
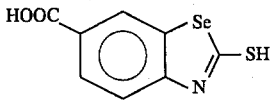
(4)
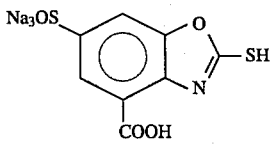
(5)
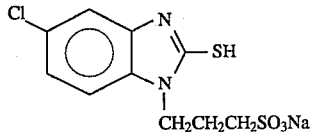
(6)
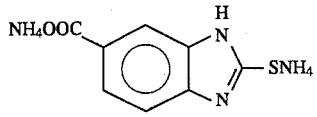
(7)
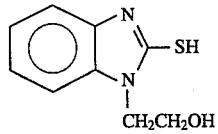
(8)
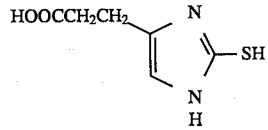
(9)
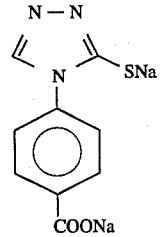
(10)
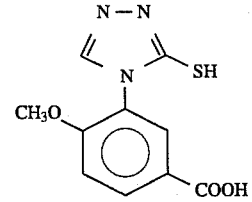
-continued
(11)
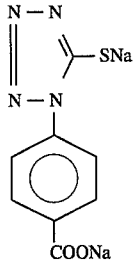
(12)
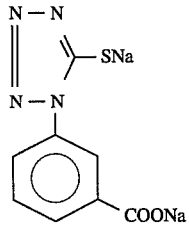
(13)
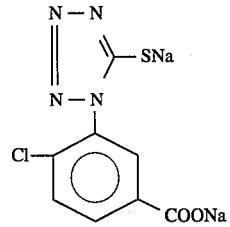
(14)
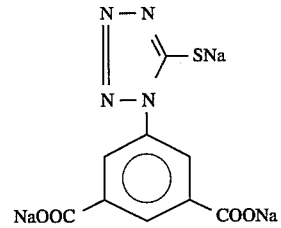
(15)
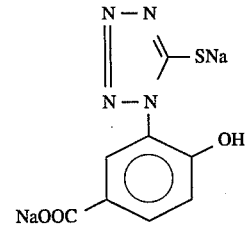
(16)
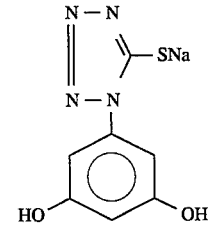
(17)
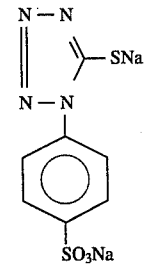

(18)
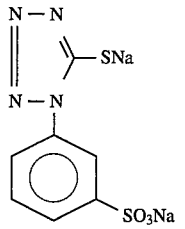
(19)
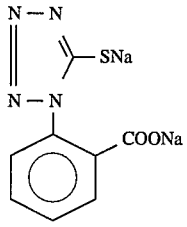
(20)
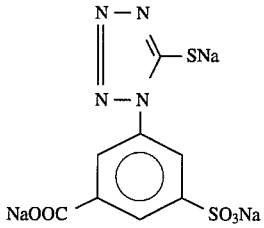
(21)
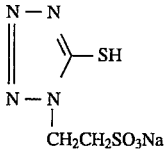
(22)
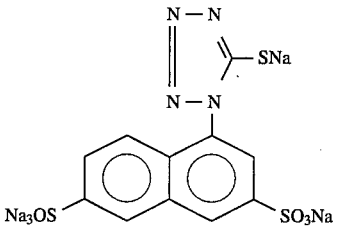
(23)
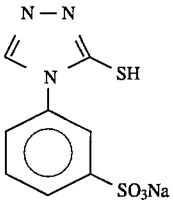
(24)
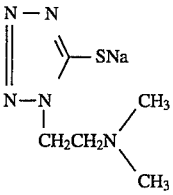
(25)
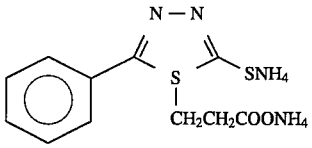
(26)
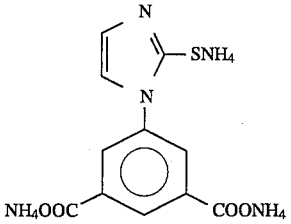
(27)
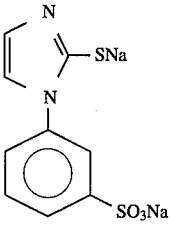
(28)
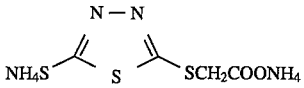
(29)
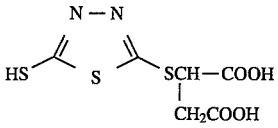
(30)
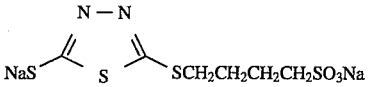
(31)
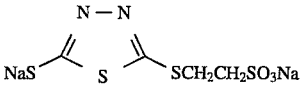
(32)
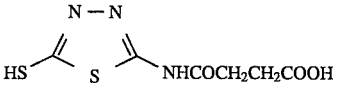
(33)
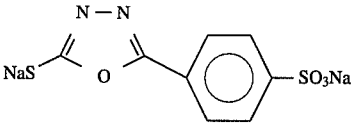
(34)
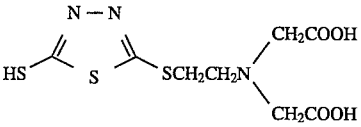
(35)
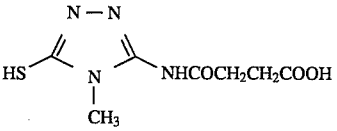
(36)
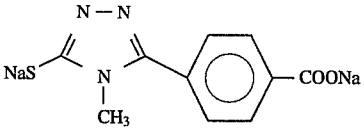
(37)
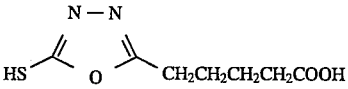

-continued

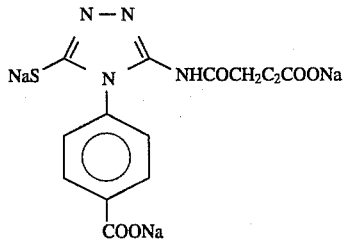

(38)

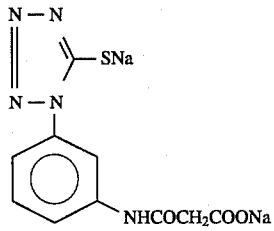

(39)

Compounds represented by formula (A) are known, and can be prepared using the methods disclosed in the literature references and patent publications indicated below.

U.S. Pat. Nos. 2,585,388 and 2,541,924, JP-B-42-21842, JP-A-53-50169, British Patent 1,275,701, D. A. Berges et al., *Journal of Heterocyclic Chemistry,* Vol. 15, No. 981 (1978), *The Chemistry of Heterocyclic Chemistry, Imidazole and Derivatives, Part I,* pages 336 to 339, *Chemical Abstracts,* 58, No. 7921 (1963), page 394, E. Hoggarth, *Journal of the Chemical Society,* pages 1160 to 1167 (1949) and S. R. Sandler and W. Karo, *Organic Functional Group Preparations,* Academic Press, pages 312 to 315 (1968), M. Chamdon et al., *Bulletin de la Societe Chemique de France,* 723 (1954), D. A. Shirley and D. W. Alley, *J. Am. Chem. Soc.,* 79, 4922 (1954), A. Whol and W. Marchwald, *Berichte* (German Chemical Society Journal), Vol. 22, page 568 (1889), *J. Am. Chem. Soc.,* 44, pages 1502 to 1510, U.S. Pat. No. 3,017,270, British Patent 940,169, JP-B-49-8334, JP-A-55-59463, *Advances in Heterocyclic Chemistry,* 9, 165–209 (1968), West German Patent 2,716,707, *The Chemistry of Heterocyclic Compounds, Imidazole and Derivatives,* Vol. 1, page 384, *Organic Syntheses IV,* 569 (1963), *Berichte,* 9, 465 (1976), *J. Am. Chem. Soc.,* 45, 2390 (1923), JP-A-50-89034, JP-A-53-28426, JP-A-55-21007 and JP-A-40-28496.

The compounds represented by formula (A) are included in a silver halide emulsion layer or other hydrophilic colloid layer (for example, an intermediate layer, a surface protective layer, a yellow filter layer, an antihalation layer), but they are preferably included in a silver halide emulsion layer or in a layer adjacent thereto.

Furthermore, the addition amount of the compound represented by formula (A) is from $1\times10^{-7}$ to $1\times10^{-3}$ mol/m$^2$, preferably from $5\times10^{-7}$ to $1\times10^{-4}$ mol/m$^2$, and most desirably from $1\times10^{-6}$ to $3\times10^{-5}$ mol/m$^2$ of the photosensitive material.

A photosensitive material of the present invention may comprise, on a support, at least one blue-sensitive silver halide emulsion layer, at least one green-sensitive silver halide emulsion layer and at least one red-sensitive silver halide emulsion layer, but no particular limitation is imposed upon the number or order of the silver halide emulsion layers and non-photosensitive layers. Typically, a silver halide photographic photosensitive material has, on a support, at least one photosensitive layer comprised of a plurality of silver halide emulsion layers which have substantially the same color sensitivity but different degrees of photosensitivity, the said photosensitive layer being a unit photosensitive layer which is color-sensitive to blue light, green light or red light. In a multilayer silver halide color photographic material, the arrangement of the unit photosensitive layers is generally, in the order from the support side, a red-sensitive unit layer, a green-sensitive unit layer, a blue-sensitive unit layer. However, this order may be reversed, as required, and the layers may be arranged in such a way that a layer having a different color sensitivity is sandwiched between layers having the same color sensitivity.

Various non-photosensitive layers, such as an intermediate layer, may be established between the above described silver halide photosensitive layers, and as uppermost and lowermost layers.

The intermediate layer may contain a coupler and a DIR compound such as those disclosed in JP-A-61-43748, JP-A-59-113438, JP-A-59-113440, JP-A-61-20037 and JP-A-61-20038, and the intermediate layer may also contain an anti-color-mixing agent such as those generally used.

The plurality of silver halide emulsion layers constituting each unit photosensitive layer is preferably a double layer structure comprised of a high speed emulsion layer and a low speed emulsion layer as disclosed in West German Patent 1,121,470 or British Patent 923,045. Generally, an arrangement in which the degree of photosensitivity is lower in the layer closer to the support is preferred, and a non-photosensitive layer may be established between each of the silver halide emulsion layers. Furthermore, the low speed layers may be arranged on the side furthest away from the support, and the high speed layers may be arranged on the side closest to the support as disclosed, for example, in JP-A-57-112751, JP-A-62-200350, JP-A-62-206541 and JP-A-62-206543.

In practical terms, the arrangement may be, from the side farthest from the support, a low speed blue-sensitive layer (BL)/high speed blue-sensitive layer (BH)/high speed green-sensitive layer (GH)/low speed green-sensitive layer (GL)/high speed red-sensitive layer (RH)/low speed red-sensitive layer (RL), or BH/BL/GL/GH/RH/RL, or BH/BL/GH/GL/RL/RH.

Furthermore, the layers can be arranged in the order, from the side farthest from the support, of a blue-sensitive layer/GH/RH/GL/RL as disclosed in JP-B-55-34932. Furthermore, the layers can also be arranged in the order, from the side farthest away from the support, of a blue-sensitive layer/GL/RL/GH/RH as disclosed in JP-A-56-25738 and JP-A-62-63936.

Furthermore, useful arrangements include those in which there are three layers having different speeds with the degree of photosensitivity being lower towards the support with the silver halide emulsion layer of the highest photosensitivity at the top, a silver halide emulsion layer having a lower photosensitivity than the above noted top layer as an intermediate layer, and a silver halide emulsion layer which has an even lower photosensitivity than the intermediate layer as a bottom layer, as disclosed in JP-B-49-15495. In the case of structures of this type having three layers each with different degrees of photosensitivity, the layers in a unit layer of the same color sensitivity may be arranged in the order, from the side farthest from the support, of an intermediate speed emulsion layer/high speed emulsion layer/slow speed emulsion layer, as disclosed in the specification of JP-A-59-202464.

Furthermore, the layers can be arranged in the order of a high speed emulsion layer/low speed emulsion layer/intermediate speed emulsion layer, or a low speed emulsion layer/intermediate speed emulsion layer/high speed emulsion layer, for example.

Furthermore, the arrangement may be varied in a manner as indicated above in cases where there are four or more layers.

As described above, various layer structures and arrangements can be selected respectively depending on the purpose of the photosensitive material.

Silver halide emulsions other than the above described tabular emulsion for use in the present invention are described below.

The preferred silver halides for incorporation in the photographic emulsion layers of a photographic photosensitive material of the present invention are silver iodobromide, silver iodochloride, or silver iodochlorobromide containing not more than about 30 mol % of silver iodide. Most desirably, the silver halide is a silver iodobromide or silver iodochlorobromide containing from about 2 mol % to about 10 mol % of silver iodide.

The silver halide grains in the photographic emulsion may have a regular crystalline form such as a cubic, octahedral or tetradecahedral form, an irregular crystalline form such as a spherical or plate-like form, a form which has crystal defects such as twinned crystal planes, or a form which is a composite of these forms.

The silver halide may be a fine grain silver halide having a grain size of less than about 0.2 μm, or a large grain size having a projected area diameter of up to about 10 μm, and the emulsion may be a polydisperse emulsion or a monodisperse emulsion.

Silver halide photographic emulsions for use in the present invention can be prepared, for example, using the methods disclosed in *Research Disclosure (RD)*, No. 17643 (December, 1978), pages 22 and 23 "I. Emulsion Preparation and Types", *Research Disclosure,* No. 18716 (November, 1979), page 648, and *Research Disclosure*, No. 307105 (November, 1989), pages 863 to 865, by P. Glafkides in *Chimie et Physique Photographique*, published by Paul Montel, 1967, by G. F. Duffin in *Photographic Emulsion Chemistry,* published by Focal Press, 1966, and V. L. Zelikman et al., in *Making and Coating Photographic Emulsions,* published by Focal Press, 1964.

The monodisperse emulsions disclosed, for example, in U.S. Pat. Nos. 3,574,628 and 3,655,394 and British Patent 1,413,748 are also desirable.

Furthermore, tabular grains which have an aspect ratio of at least about 3 can also be used in the present invention. Tabular grains can be readily prepared using the methods described, for example, by Gutoff in *Photographic Science and Engineering,* Vol. 14, pages 248 to 257 (1970), and in U.S. Pat. Nos. 4,434,226, 4,414,310, 4,430,048 and 4,439,520 and British Patent 2,112,157.

The crystal structure may be uniform, or the interior and exterior parts of the grains may be comprised of different halogen compositions, or the grains may have a layer-like structure. Moreover, silver halides which have different compositions may be joined with an epitaxial junction or may be joined with compounds other than a silver halide, such as silver thiocyanate or lead oxide, for example. Furthermore, mixtures of grains which have various crystalline forms may be used.

The above described emulsions may be of the surface latent image type wherein the latent image is formed principally on the surface, or of the internal latent image type wherein the latent image is formed within the grains, or of a type wherein the latent image is formed both at the surface and within the grains, but a negative type emulsion is essential. From among the internal latent image types, the emulsion may be a core/shell internal latent image type emulsion as disclosed in JP-A-63-264740. A method for the preparation of such a core/shell internal latent image type emulsion is disclosed in JP-A-59-133542. The selected thickness of the shell of this emulsion varies depending on the development processing, for example, but is preferably from 3 to 40 nm, and most desirably from 5 to 20 nm.

The silver halide emulsion for use in the present invention is generally subjected to physical ripening, chemical ripening and spectral sensitization. Additives which are used in such processes are disclosed in *Research Disclosure,* Nos. 17643, 18716 and 307105, and the locations of these disclosures are summarized in a table provided below.

Two or more different types of emulsions which differ in terms of at least one of the characteristics of grain size, grain size distribution or halogen composition of the photosensitive silver halide emulsion, the form of the grains and photographic speed can be used in admixture in the same layer in a photosensitive material of the present invention.

The use of the silver halide grains having a fogged grain surface as disclosed in U.S. Pat. No. 4,082,553, silver halide grains having a fogged interior as disclosed in U.S. Pat. No. 4,626,498 and JP-A-59-214852, or colloidal silver is desirable in the photosensitive silver halide emulsion layers and/or substantially non-photosensitive hydrophilic colloid layers. Silver halide grains having a fogged grain interior or surface are silver halide grains which can be developed uniformly (not in the form of the image) irrespective of whether these grains are in an unexposed part or an exposed part of the photosensitive material. Methods for the preparation of silver halide grains having a fogged interior or surface of the grains are disclosed in U.S. Pat. No. 4,626,498 and JP-A-59-214852.

The silver halide which forms the internal nuclei of a core/shell type silver halide grain having a fogged grain interior may have the same halogen composition as the core portion or a different halogen composition. The silver halide having a fogged interior or surface of the grains may be a silver chloride, a silver chlorobromide, a silver iodobromide or a silver chloroiodobromide. No particular limitation is imposed upon the grain size of these fogged silver halide grains, but an average grain size of from 0.01 to 0.75 μm, and especially of from 0.05 to 0.6 μm, is preferred. Furthermore, no particular limitation is imposed upon the form of the grains and they may be regular grains and comprise a polydisperse emulsion, but a monodisperse emulsion (in which at least 95% in terms of the weight or number of silver halide grains have a grain size within ±40% of the average grain size) is preferred.

The use of non-photosensitive fine grained silver halide is desirable in the present invention. Non-photosensitive fine grained silver halides are fine grained silver halides which are not photosensitive at the time of the imagewise exposure for obtaining the dye image and which undergo substantially no development during development processing. Fine grained non-photosensitive silver halides which have not been pre-fogged are preferred.

The fine grained silver halide has a silver bromide content from 0 to 100%, and may contain silver chloride and/or silver iodide as required. Fine grained silver halides having a silver iodide content of from 0.5 to 10 mol % are preferred.

The fine grained silver halide has an average grain size (the average value of the diameters of the circles corresponding to the projected areas) preferably of from 0.01 to 0.5 μm, and most desirably of from 0.02 to 0.2 μm.

The fine grained silver halide can be prepared using the same methods as generally used for the preparation of photosensitive silver halides. In this case, the surface of the silver halide grains does not need to be optically sensitized and there is no need for spectral sensitization. However, the pre-addition of known stabilizers such as triazole, azaindene, benzothiazolium or mercapto compounds or zinc compounds before addition to the coating liquid is desirable. Colloidal silver is also desirably included in the layer containing the fine grained silver halide grains.

The coated weight of all silver contained in the photosensitive material of the present invention is preferably not more than 6.0 g/m$^2$, and most desirably not more than 4.5 g/m$^2$.

Known photographically useful additives for use in the present invention are disclosed in the three *Research Dis-*

*closures* referred to above, and the locations of these disclosures are also indicated in the table below.

| Type of Additive | RD 17643 (December, 1978) | RD 18716 (November, 1979) | RD 307105 (November, 1989) |
|---|---|---|---|
| 1. Chemical Sensitizers | Page 23 | Page 648, right column | Page 866 |
| 2. Speed Increasing Agents | — | Page 648, right column | — |
| 3. Spectral Sensitizers and Supersensitizers | Pages 23–24 | Page 648, right column to page 649, right column | Pages 866–868 |
| 4. Bleaching Agents | Page 24 | Page 647, right column | Page 868 |
| 5. Antifoggants and Stabilizers | Pages 24–25 | Page 649, right column | Pages 868–870 |
| 6. Light Absorbers, Filter Dyes and Ultraviolet Absorbers | Pages 25–26 | Page 649, right column to page 650, left column | page 873 |
| 7. Antistaining Agents | Page 25, right column | Page 650, left to right columns | Page 872 |
| 8. Dye image Stabilizers | Page 25 | Page 650, left column | Page 872 |
| 9. Film Hardening Agents | Page 26 | Page 651, left column | Pages 874–875 |
| 10. Binders | Page 26 | Page 651, left column | Pages 873–874 |
| 11. Plasticizers and Lubricants | Page 27 | Page 650, right column | Page 876 |
| 12. Coating Promoters and Surfactants | Pages 26–27 | Page 650, right column | Pages 875–876 |
| 13. Antistatic Agents | Page 27 | Page 650, right column | Pages 876–877 |
| 14. Matting Agents | — | — | Pages 878–879 |

Furthermore, addition of compounds which react with and fix formaldehyde as disclosed in U.S. Pat. Nos. 4,411,987 and 4,435,503 to the photosensitive material is desirable for preventing deterioration of photographic performance due to formaldehyde gas.

The inclusion of compounds in a photosensitive material of the present invention which release fogging agents, development accelerators, silver halide solvents or precursors of these materials irrespective of the amount of developed silver which is produced by development processing as disclosed in JP-A-l-106052 is desirable.

The inclusion of the dyes dispersed in accordance with the methods disclosed in International Patent Laid Open WO88/04794 and JP-A-1-502912, and the dyes disclosed in EP 317,308A, U.S. Pat. No. 4,420,555 and JP-A-1-259358 in a photosensitive material of the present invention is desirable.

Various color couplers can be used in the present invention, and useful examples are disclosed in the patents cited in the above noted *Research Disclosure*, No. 17643, sections VII-C to G, and No. 307105, sections VII-C to G.

The color couplers disclosed, for example, in U.S. Pat. Nos. 3,933,501, 4,022,620, 4,326,024, 4,401,752 and 4,248,961, JP-B-58-10739, British Patents 1,425,020 and 1,476,760, U.S. Pat. Nos. 3,973,968, 4,314,023 and 4,511,649, and European Patent 249,473A are preferred as yellow couplers.

5-Pyrazolone based compounds and pyrazoloazole based compounds are preferred as magenta couplers, and those disclosed, for example, in U.S. Pat. Nos. 4,310,619 and 4,351,897, European Patent 73,636, U.S. Pat. Nos. 3,061,432 and 3,725,067, *Research Disclosure*, No. 24220 (June, 1984), JP-A-60-33552, *Research Disclosure*, No. 24230 (June, 1984), JP-A-60-43659, JP-A-61-72238, JP-A-60-35730, JP-A-55-118034, JP-A-60-185951, U.S. Pat. Nos. 4,500,630, 4,540,654 and 4,556,630, and International Patent WO88/04795 are especially desirable.

Phenol based and naphthol based couplers are useful as cyan couplers, and those disclosed, for example, in U.S. Pat. Nos. 4,052,212, 4,146,396, 4,228,233, 4,296,200, 2,369,929, 2,801,171, 2,772,162, 2,895,826, 3,772,002, 3,758,308, 4,334,011 and 4,327,173, West German Patent Laid Open 3,329,729, European Patents 121,365A and 249,453A, U.S. Pat. Nos. 3,446,622, 4,333,999, 4,775,616, 4,451,559, 4,427,767, 4,690,889, 4,254,212 and 4,296,199, and JP-A-61-42658 are preferred.

Typical examples of polymerized dye forming couplers are disclosed, for example, in U.S. Pat. Nos. 3,451,820, 4,080,211, 4,367,282, 4,409,320 and 4,576,910, British Patent 2,102,173 and European Patent 341,188A.

The couplers disclosed in U.S. Pat. No. 4,366,237, British Patent 2,125,570, European Patent 96,570 and West German Patent Laid Open 3,234,533 are preferred as couplers the colored dyes of which have a suitable degree of diffusibility.

The colored couplers for correcting the unwanted absorption of colored dyes as disclosed, for example, in section VII-G of *Research Disclosure*, No. 17643, section VII-G of Research Disclosure, No. 307105, U.S. Pat. No. 4,163,670, JP-B-57-39413, U.S. Pat. Nos. 4,004,929 and 4,138,258, and British Patent 1,146,368 are preferred. Furthermore, the use of couplers which correct the unwanted absorption of colored dyes by means of fluorescent dyes which are released on coupling as disclosed in U.S. Pat. No. 4,774,181, and the couplers which have, as leaving groups, dye precursor groups which form dyes on reaction the developing agent, as disclosed in U.S. Pat. No. 4,777,120, are also desirable.

The use of couplers which release photographically useful residual groups on coupling is also desirable in the present invention. The DIR couplers which release development inhibitors disclosed in the patents cited in section VII-F of the aforementioned *Research Disclosure*, No. 17643, section VII-F of *Research Disclosure*, No. 307105, and in JP-A-57-151944, JP-A-57-154234, JP-A-60-184248, JP-A-63-37346, JP-A-63-37350 and U.S. Pat. Nos. 4,248,962 and 4,782,012 are preferred.

The couplers disclosed in British Patents 2,097,140 and 2,131,188, JP-A-59-157638 and JP-A-59-170840 are preferred as couplers which release nucleating agents or development accelerators in the form of the image during development. Furthermore, the compounds which release fogging agents, development accelerators, silver halide solvents, etc., by means of a redox reaction with the oxidized form of a developing agent as disclosed in JP-A-60-107029, JP-A-60-252340, JP-A-1-44940 and JP-A-1-45687 are also desirable.

Other compounds for use in the photosensitive material of the present invention include the competitive couplers disclosed, for example, in U.S. Pat. No. 4,130,427, the multi-equivalent couplers disclosed, for example, in U.S. Pat. Nos. 4,283,472, 4,338,393 and 4,310,618, the DIR redox compound-releasing couplers, DIR coupler-releasing couplers, DIR coupler-releasing redox compounds or DIR redox-releasing redox compounds disclosed, for example, in JP-A-60-185950 and JP-A-62- 24252, the couplers which release dyes the color of which is restored after elimination as disclosed in European Patent 173,302A, the bleach accelerator-releasing couplers disclosed, for example, in *Research Disclosure*, No. 11449, *ibid.*, No. 24241, and JP-A-61-201247, the ligand-releasing couplers disclosed, for example, in U.S. Pat. No. 4,553,477, the leuco dye-releasing couplers disclosed in JP-A-63-75747, and the couplers which release fluorescent dyes disclosed in U.S. Pat. No. 4,774,181.

The couplers for use in the present invention can be introduced into the photosensitive material using various known methods of dispersion.

Examples of high boiling point solvents which can be used in the oil-in-water dispersion method are disclosed, for example, in U.S. Pat. No. 2,322,027.

Actual examples of high boiling point organic solvents which have a boiling point of at least 175° C. at normal pressure for use in the oil-in-water dispersion method include phthalic acid esters (for example, dibutyl phthalate, dicyclohexyl phthalate, di-2-ethylhexyl phthalate, decyl phthalate, bis(2,4-di-tert-amylphenyl)phthalate, bis(2,4-di-tert-amylphenyl)isophthalate, and bis(1,1-diethylpropyl)phthalate), phosphoric acid or phosphonic acid esters (for example, triphenyl phosphate, tricresyl phosphate, 2-ethylhexyl diphenyl phosphate, tricyclohexyl phosphate, tri-2-ethylhexyl phosphate, tridodecyl phosphate, tributoxyethyl phosphate, trichloropropyl phosphate and di-2-ethylhexylphenyl phosphonate), benzoic acid esters (for example, 2-ethylhexyl benzoate, dodecyl benzoate and 2-ethylhexyl-p-hydroxybenzoate), amides (for example, N,N-diethyldodecanamide, N,N-diethyllaurylamide and N-tetradecylpyrrolidone), alcohols or phenols (for example, isostearyl alcohol and 2,4-di-tert-amylphenol), aliphatic carboxylic acid esters (for example, bis(2-ethylhexyl)sebacate, dioctyl azelate, glycerol tributyrate, isostearyl lactate and trioctyl citrate), aniline derivatives (for example, N,N-dibutyl-2-butoxy-5-tert-octylaniline) and hydrocarbons (for example, paraffin, dodecylbenzene and diisopropylnaphthalene). Furthermore, organic solvents which have a boiling point above about 30° C., and preferably of at least 50° C., but below about 160° C. can be used as auxiliary solvents, and typical examples of these solvents include ethyl acetate, butyl acetate, ethyl propionate, methyl ethyl ketone, cyclohexanone, 2-ethoxyethyl acetate and dimethylformamide.

The process and effects of the latex dispersion method and actual examples of latexes for loading purposes are disclosed in U.S. Pat. No. 4,199,363, and in West German Patent Application (OLS) Nos. 2,541,274 and 2,541,230.

The addition to color photosensitive materials of the present invention of various fungicides and biocides such as phenethyl alcohol or 1,2-benzisothiazolin-3-one, n-butyl p-hydroxybenzoate, phenol, 4-chloro-3,5-dimethylphenol, 2-phenoxyethanol and 2-(4-thiazolyl)benzimidazole, for example, as disclosed in JP-A-63-257747, JP-A-62-272248 and JP-A-1-80941, is desirable.

The present invention can be applied to a variety of color photosensitive materials. Typical examples include color negative films for general and cinematographic purposes, color reversal films for slides and television purposes, color papers, color positive films and color reversal papers.

Suitable supports for use in the present invention have been disclosed, for example, on page 28 of the aforementioned *Research Disclosure,* No. 17643, from the right hand column of page 647 to the left hand column of page 648 of *Research Disclosure,* No. 18716, and on page 879 of *Research Disclosure,* No. 307105.

The photosensitive material of the present invention has a total film thickness of all the hydrophilic colloid layers on the side where the silver halide emulsion layers are located of preferably not more than 28 μm, more desirably not more than 23 μm, even more desirably not more than 18 μm, and most desirably not more than 16 μm. Furthermore, the film swelling rate T½ is preferably not more than 30 seconds and most desirably not more than 20 seconds. The film thickness signifies the film thickness measured under conditions of 25° C., 55% relative humidity (stored for 2 days), and the film swelling rate T½ can be measured using the methods well known in the industry. For example, measurements can be made using a swellometer of the type described by A. Green in *Photogr. Sci. Eng.,* Vol. 19, No. 2, pages 124 to 129. T½ is defined as the time taken to reach half the saturated film thickness, taking 90% of the maximum swelled film thickness reached on processing the material for 3 minutes 15 seconds in a color developer at 30° C., as the saturated film thickness.

The film swelling rate T½ can be adjusted by adding film hardening agents for the gelatin which is used as a binder, or by changing the aging conditions after coating. Furthermore, a swelling factor of from 150% to 400% is preferred. The swelling factor can be calculated from the maximum swelled film thickness obtained under the conditions described above using the expression (maximum swelled film thickness minus film thickness)/film thickness.

The establishment of hydrophilic colloid layers (known as backing layers) of total dry film thickness of from 2 μm to 20 μm on the side of the support opposite that having provided thereon the silver halide emulsion layers is desirable in a photosensitive material of the present invention. The inclusion of the above noted light absorbing agents, filter dyes, ultraviolet absorbers, antistatic agents, film hardening agents, binders, plasticizers, lubricants, coating promotors and surfactants, for example, in the backing layers is desirable. The swelling factor of the backing layer is preferably from 150% to 500%.

Color photographic photosensitive material of the present invention can be developed and processed using the general methods disclosed on pages 28 and 29 of the aforementioned *Research Disclosure,* No. 17643, from the left hand column to the right hand column of page 615 of the aforementioned *Research Disclosure,* No. 18716, and on pages 880 and 881 of *Research Disclosure,* No. 307105.

The color developers used for the development processing of the photosensitive material of the present invention are preferably aqueous alkaline solutions which contain a primary aromatic amine based color developing agent as a principal component. Aminophenol based compounds are also useful as color developing agents, but the use of p-phenylenediamine based compounds is preferred, and typical examples include 3-methyl-4-amino-N,N-diethylaniline, 3-methyl-4-amino-N-ethyl-N-β-hydroxyethylaniline, 3-methyl-4-amino-N-ethyl-N-β-methanesulfonamidoethylaniline, 3-methyl-4-amino-N-ethyl-β-methoxyethylaniline, and the sulfate, hydrochloride and p-toluenesulfonate salts of these compounds. From among these compounds, 3-methyl-4-amino-N-ethyl-N-β-hydroxyethylaniline sulfate is especially desirable. Two or more of these compounds can be used in combination according to the intended purpose.

The color developer generally contains pH buffers such as alkali metal carbonates, borates or phosphates, and development inhibitors or antifoggants such as chloride, bromide, iodide, benzimidazoles, benzothiazoles or mercapto compounds. They may also contain, as required, various preservatives such as hydroxylamine, diethylhydroxylamine, sulfite, hydrazines such as N,N-biscarboxymethylhydrazine, phenylsemicarbazides, triethanolamine and catecholsulfonic acids, organic solvents such as ethylene glycol and diethylene glycol, development accelerators such as benzyl alcohol, polyethylene glycol, quaternary ammonium salts and amines, dye forming couplers, competitive couplers, auxiliary developing agents such as 1-phenyl-3-pyrazolidone, thickeners and various chelating agents as typified by the aminopolycarboxylic acids, aminopolyphosphonic acids, alkylphosphonic acids and phosphonocarboxylic acids, typical examples of which include ethylenediaminetetraacetic acid, nitrilotriacetic acid, diethylenetriaminepentaacetic acid, cyclohexanediaminetetraacetic acid, hydroxyethyliminodiacetic acid, 1-hydroxyethylidene-1,1-diphosphonic acid, nitrilo-N,N,N-trimethylenephosphonic acid, ethylenediamine-N,N,N,N-tetramethylenephosphonic acid, ethylenediamine-di(o-hydroxyphenylacetic acid) and salts of these acids.

Furthermore, color development is carried out after regular black-and-white development in the case of reversal processing. Known black-and-white developing agents including dihydroxybenzenes such as hydroquinone, 3-pyrazolidones such as 1-phenyl-3-pyrazolidone, and aminophenols such as N-methyl-p-aminophenol, for example, can be used individually, or in combinations, in the black-and-white developer.

The pH of the color developer and black-and-white developer is generally from 9 to 12. Furthermore, the replenishment rate for these developers depends on the color photographic photosensitive material which is being processed but, in general, it is not more than 3 liters per square meter of photosensitive material, and can be set to not more than 500 ml by reducing the bromide ion concentration in the replenisher. In those cases where the replenishment rate is reduced, it is desirable that evaporation and air oxidation of the liquid is prevented by minimizing the area of contact with the air in the processing tank.

The contact area between the air and the photographic processing bath in a processing tank can be represented by the open factor which is defined below.

$$\text{Open Factor} = \frac{\text{Processing Bath and Air Contact Area (cm}^2\text{)}}{\text{Processing Bath Volume (cm}^3\text{)}}$$

The above noted open factor is preferably not more than 0.1, and is most desirably from 0.001 to 0.05. As well as the establishment of a shielding material such as a floating lid, for example, on the surface of the photographic processing bath in the processing tank, the method employing a movable lid as disclosed in JP-A-1082033 and the method involving the slit development processing disclosed in JP-A-63-216050 can be used as means of reducing the open factor. Reduction of the open factor is preferably applied not only to the processes of color development and black-and-white development, but also to all the subsequent processes, such as the bleaching, bleach-fixing, fixing, water washing and stabilizing processes. Furthermore, the replenishment rate can be reduced by means for suppressing the accumulation of bromide ion in the development bath.

The color development processing time is generally between 2 and 5 minutes, but shorter processing times can be used by increasing the pH or by increasing the concentration of the color developing agent.

The photographic emulsion layer is generally subjected to a bleaching process after color development. The bleaching process may be carried out at the same time as a fixing process (in a bleach-fix process) or may be carried out separately. Moreover, a bleach-fix process can be carried out after a bleaching process in order to speed up processing. Moreover, processing can be carried out in two connected bleach-fix baths, a fixing process can be carried out before a bleach-fixing process, or a bleaching process can be carried out after a bleach-fix process, as required. Compounds of multivalent metals, such as iron(III), for example, peracids, quinones and nitro compounds can be used as bleaching agents. Typical bleaching agents include organic complex salts of iron(III), for example, complex salts with aminopolycarboxylic acids such as ethylenediaminetetraacetic acid, diethylenetriaminepentaacetic acid, cyclohexanediaminetetraacetic acid, methyliminodiacetic acid, 1,3-diaminopropanetetraacetic acid and glycol ether diaminetetraacetic acid, or citric acid, tartaric acid or malic acid. From among these materials, the use of polyaminocarboxylic acid iron(III) complex salts, and principally ethylenediaminetetraacetic acid iron(III) complex salts and 1,3-diaminopropanetetraacetic acid iron(III) salts, is preferred for providing both rapid processing and preventing environmental pollution. Moreover, the aminopolycarboxylic acid iron(III) complex salts are especially useful in both bleach baths and bleach-fix baths. The pH value of the bleach baths and bleach-fix baths in which these aminopolycarboxylic acid iron(III) salts are used is generally from 4.0 to 8, but lower pH values can be used in order to speed up processing.

Bleaching accelerators can be used, as required, in the bleach baths, bleach-fix baths or bleach or bleach-fix prebaths. Actual examples of useful bleach accelerators are disclosed in the following publications: Thus, there are the compounds which have a mercapto group or a disulfide group disclosed, for example, in U.S. Pat. No. 3,893,858, West German Patents 1,290,812 and 2,059,988, JP-A-53-32736, JP-A-53-57831, JP-A-53-37418, JP-A-53-72623, JP-A-53-95630, JP-A-53-95631, JP-A-53-104232, JP-A-53-124424, JP-A-53-141623, JP-A-53-28426, and *Research Disclosure,* No. 17129 (July, 1978); the thiazolidine derivatives disclosed in JP-A-50-140129; the thiourea derivatives disclosed in JP-B-45-8506, JP-A-52-20832, JP-A-53-32735 and U.S. Pat. No. 3,706,561, the iodide salts disclosed in West German Patent 1,127,715 and JP-A-58-16235; the polyoxyethylene compounds disclosed in West German Patents 966,410 and 2,748,430; the polyamine compounds disclosed in JP-B-45-8836; the other compounds disclosed in JP-A-49-40943, JP-A-49-59644, JP-A-53-94927, JP-A-54-35727, JP-A-55-26506 and JP-A-58-163940; and bromide ion. From among these compounds, those which have a mercapto group or a disulfide group are preferred in view of their large accelerating effect, and the compounds disclosed in U.S. Pat. No. 3,893,858, West German Patent 1,290,812 and JP-A-53-95630 are especially desirable. Moreover, the compounds disclosed in U.S. Pat. No. 4,552,834 are also desirable. These bleaching accelerators may be added to the sensitive material. These bleaching accelerators are especially effective for bleach-fixing camera color photosensitive materials.

The inclusion of organic acids as well as the compounds indicated above in the bleach baths and bleach-fix baths is desirable for preventing the occurrence of bleach staining. Compounds which have an acid dissociation constant (pKa) of from 2 to 5 are especially desirable for the organic acids, and, in practice, acetic acid and propionic acid, for example, are preferred.

Thiosulfate, thiocyanate, thioether based compounds, thioureas and large amounts of iodide can be used, for example, as the fixing agent which is used in a fixing bath or bleach-fix bath, but thiosulfate is generally used, and ammonium thiosulfate, in particular, can be used in the widest range of applications. Furthermore, the combined use of thiosulfate and thiocyanate, thioether compounds, thiourea, etc., is also desirable. Sulfite, bisulfite, carbonyl/bisulfite addition compounds or the sulfinic acid compounds disclosed in European Patent 294,769A are preferred as preservatives for fixing baths and bleach-fix baths. Moreover, the addition of various aminopolycarboxylic acids and organophosphonic acids to the fixing baths and bleach-fixing baths is desirable for stabilizing these baths.

The addition of compounds having a pKa from 6.0 to 9.0, and preferably imidazoles such as imidazole, 1-methylimidazole, 1-ethylimidazole and 2-methylimidazole, in amounts of from 0.1 to 10 mol/liter, to the fixing bath or bleach-fixing bath is desirable for pH control in the present invention.

A shorter total desilvering processing time within the range where desilvering failure does not occur is preferred. The desilvering time is preferably from 1 to 3 minutes, and most desirably from 1 to 2 minutes. Furthermore, the processing temperature is from 25° C. to 50° C., and preferably from 35° C. to 45° C. The desilvering rate is increased and the occurrence of staining after processing is prevented effectively within the preferred temperature range.

Agitation as strong as possible during the desilvering process is desirable. Actual examples of methods of strong agitation include the methods in which a jet of processing liquid is directed to impinge on the emulsion surface of the photosensitive material as disclosed in JP-A-62-183460, the method in which the agitation effect is increased using a rotary device as disclosed in JP-A-62-183461, the method in which the photosensitive material is moved with a wiper blade which is established in the bath in contact with the emulsion surface and the agitation effect is increased by the generation of turbulence at the emulsion surface, and the method in which the circulating flow rate of the processing bath as a whole is increased. These means of increasing agitation are effective in bleach baths, bleach-fix baths and fixing baths. It is thought that increased agitation increases the rate of supply of bleaching agent and fixing agent to the emulsion film and consequently increases the desilvering rate. Furthermore, the above described means of increasing agitation are more effective in cases where a bleaching accelerator is being used, and the increased agitation can provide a marked increase in the accelerating effect and eliminate the fixer inhibiting action due to a bleaching accelerator.

The automatic processors for use in processing the photosensitive material of the present invention preferably have photosensitive material transporting devices as disclosed in JP-A-60-191257, JP-A-60-191258 or JP-A-60-191259. With such a transporting device, such as that disclosed in the above noted JP-A-60-191257, the carry-over of processing liquid from one bath to the next is greatly reduced and this is very effective for preventing deterioration in processing bath performance. These effects are especially useful for shortening the processing time in each process and for reducing the replenishment rate of each processing bath.

The silver halide color photographic photosensitive material of the present invention is generally subjected to a water washing process and/or stabilizing process after the desilvering process. The amount of wash water used in the washing process can be selected within a wide range, depending on the application and the nature (e.g., depending on the materials such as couplers contained in the photosensitive material) of the photosensitive material, the wash water temperature, the number of water washing tanks (the number of water washing stages) and the replenishment system, i.e., whether a counterflow or a sequential flow system is used, and various other conditions. The relationship between the amount of water used and the number of washing tanks in a multistage counterflow system can be obtained using the method outlined on pages 248 to 253 of the *Journal of the Society of Motion Picture and Television Engineers,* Vol. 64 (May, 1955).

The amount of wash water used can be greatly reduced by using the multistage counterflow system described in the above noted literature, but bacteria proliferate due to the increased residence time of the water in the tanks. Problems also arise with the attachment of accumulated suspended matter to the photosensitive material. The method in which calcium ion and magnesium ion concentrations are reduced as disclosed in JP-A-62-288838, is very effective as a means of overcoming this problem when processing a color photosensitive material of the present invention. Furthermore, the isothiazolone compounds and thiabendazoles disclosed in JP-A-57-8542, the chlorine based disinfectants such as chlorinated sodium isocyanurate, and benzotriazole, for example, and the disinfectants disclosed in *The Chemistry of Biocides and Fungicides* by Horiguchi (1986, Sankyo Shuppan), in *Killing Microorganisms, Biocidal and Fungicidal Techniques* (1982) published by the Health and Hygiene Technology Society, and in *A Dictionary of Biocides and Fungicides* (1986) published by the Japanese Biocide and Fungicide Society, can also be used for this purpose.

The pH value of the washing water when processing a photosensitive material of the present invention is from 4 to 9, and preferably from 5 to 8. The washing water temperature and the washing time can be set depending on the nature and application of the photosensitive material but, in general, washing conditions of from 20 seconds to 10 minutes at a temperature of from 15° C. to 45° C., and preferably of from 30 seconds to 5 minutes at a temperature of from 25° C. to 40° C., are selected. Moreover, the photosensitive material of the present invention can be processed directly in a stabilizing bath instead of being subjected to a water wash as described above. The known methods disclosed in JP-A-57-8543, JP-A-58-14834 and JP-A-60-220345 can be used as such a stabilization process.

Furthermore, there are also cases in which a stabilization process is carried out following the above described water washing process, and the stabilizing baths which contain dye stabilizing agents and surfactants which are used as final baths for camera color photosensitive materials are an example of such a process. Aldehydes such as formalin and glutaraldehyde, N-methylol compounds, hexamethylenetetramine and aldehyde/bisulfite addition compounds can be used, for example, as dye stabilizing agents.

Various chelating agents and fungicides can also be added to these stabilizing baths.

The overflow which accompanies replenishment of the above noted water washing or stabilizing baths can be reused in other processes, such as the desilvering process, for example.

Concentration correction with the addition of water is desirable in cases where the above noted processing baths become concentrated due to evaporation when processing is carried out using an automatic processor, for example.

Color developing agents can be incorporated into a silver halide color photosensitive material of the present invention to simplify and speed up processing. The incorporation of various color developing agent precursors is preferred. For example, the indoaniline based compounds disclosed in U.S. Pat. No. 3,342,597, the Schiff's base type compounds disclosed in U.S. Pat. No. 3,342,599, *Research Disclosure,* No. 14850 and *Research Disclosure,* No. 15159, the aldol compounds disclosed in *Research Disclosure,* No. 13924, the metal complex salts disclosed in U.S. Pat. No. 3,719,492 and the urethane based compounds disclosed in JP-A-53-135628 can be used for this purpose.

Various 1-phenyl-3-pyrazolidones may be incorporated, as required, into a silver halide color photosensitive material of the present invention to accelerate color development. Typical compounds are disclosed, for example, in JP-A-56-64339, JP-A-57-144547 and JP-A-58-115438.

The various processing baths in the present invention are used at a temperature of from 10° C. to 50° C. The standard temperature is generally from 33° C. to 38° C., but accelerated processing and shorter processing times can be realized at higher temperatures while, on the other hand, increased picture quality and better processing bath stability can be achieved at lower temperatures.

Furthermore, the silver halide photosensitive material of the present invention can also be used as a heat developable photosensitive material as disclosed, for example, in U.S. Pat. No. 4,500,626, JP-A-60-133449, JP-A-59-218443, JP-A-61-238056 and European Patent 120,660A2.

The present invention is described in detail below by means of the following illustrative examples, but the present invention is not to be construed as being limited by these examples.

EXAMPLE 1

An aqueous gelatin solution obtained by dissolving 30 g of inactive gelatin and 6 g of potassium bromide in 1 liter of distilled water was stirred at 75° C., and 35 cc of an aqueous solution containing 5.0 g of silver nitrate and 35 cc of an aqueous solution containing 3.2 g of potassium bromide and 0.98 g of potassium iodide were together added at a rate of 70 cc/min over a period of 30 seconds, after which the pAg value was raised to 10 to obtain a seed emulsion on ripening for a period of 30 minutes.

Next, 50 ml of an aqueous solution containing 145 g of silver nitrate in 1 liter and an equimolar amount of an aqueous solution containing a mixture of potassium bromide and potassium iodide were added at a rate of addition close to the critical growth rate at 65° C. and a pAg value of 12 to obtain a tabular core emulsion. Next, the remainder of the aqueous silver nitrate solution and an equimolar amount of an aqueous solution of a mixture of potassium bromide and potassium iodide which was different from that used to prepare the core emulsion were added at a rate of addition close to the critical growth rate. The core portions were covered to obtain core/shell type tabular silver iodobromide Emulsions 1 to 5 as indicated below.

Aspect ratio control was achieved by selecting the pAg value during the preparation of the core and the shell to obtain the emulsions shown in Table 1-1.

TABLE 1-1

| Emulsion* | Average Aspect Ratio[1)] | Average Aspect Ratio[2)] | Average Grain Diameter (μm) | Average Grain Thickness (μm) | Average Iodide Content (mol %) |
|---|---|---|---|---|---|
| 1 | 1.5/1 | 1.2/1 | 0.86 | 0.67 | 7.6 |
| 2 | 2.8/1 | 2.2/1 | 1.01 | 0.55 | 7.6 |
| 3 | 4.6/1 | 3.6/1 | 1.63 | 0.36 | 7.6 |
| 4 | 6.7/1 | 5.2/1 | 1.74 | 0.30 | 7.6 |
| 5 | 11.7/1 | 9.8/1 | 2.10 | 0.21 | 7.6 |

[1)]One thousand emulsion grains were taken and the aspect ratios of the individual grains were measured. The grains accounting for 50% of the total projected area were selected from among the grains which had a large aspect ratio, and the average value shown is the aspect ratio of these grains.
[2)]This is the average value of the aspect ratio of the grains accounting for 85% of the total projected area as in 1) above.
*The iodide content of the grains of Emulsions 1 to 5 is 0% in the core and 8 mol % in the shell.

Next, each of the layers having the compositions indicated below were multilayer coated onto a cellulose triacetate film support on which an underlayer comprising 0.05 g/m$^2$ of gelatin and 0.01 g/m$^2$ of phenol had been established to prepare the multilayer photosensitive material Sample 101.

Photosensitive Layer Composition

The numerical value corresponding to each component indicates the coated weight in units of g/m$^2$, the coated weight being shown as the calculated weight of silver in the case of a silver halide emulsion. Furthermore, in the case of a sensitizing dye the coated weight is indicated in units of mol per mol of silver halide in the same layer.

| Sample 101 | |
|---|---|
| First Layer: Antihalation Layer | |
| Black Colloidal Silver | 0.18 as silver |
| Gelatin | 1.40 |
| Second Layer: Intermediate Layer | |
| 2,5-Di-tert-pentadecylhydroquinone | 0.18 |
| EX-1 | 0.070 |
| EX-3 | 0.020 |
| EX-12 | $2.0 \times 10^{-3}$ |
| U-1 | 0.060 |
| U-2 | 0.080 |
| U-3 | 0.10 |
| HBS-1 | 0.10 |
| HBS-2 | 0.020 |
| Gelatin | 1.04 |
| Third Layer: First Red-Sensitive Emulsion Layer | |
| Emulsion A | 0.25 as silver |
| Emulsion B | 0.25 as silver |
| Sensitizing Dye I | $6.9 \times 10^{-5}$ |

-continued

| Sample 101 | |
|---|---|
| Sensitizing Dye II | $1.8 \times 10^{-5}$ |
| Sensitizing Dye III | $3.1 \times 10^{-4}$ |
| EX-2 | 0.34 |
| EX-10 | 0.005 |
| EX-14 | 0.030 |
| U-1 | 0.070 |
| U-2 | 0.050 |
| U-3 | 0.070 |
| HBS-1 | 0.060 |
| Gelatin | 0.87 |
| Fourth Layer: Second Red-Sensitive Emulsion Layer | |
| Emulsion G | 1.00 as silver |
| Sensitizing Dye I | $5.1 \times 10^{-5}$ |
| Sensitizing Dye II | $1.4 \times 10^{-5}$ |
| Sensitizing Dye III | $2.3 \times 10^{-4}$ |
| EX-2 | 0.40 |
| EX-3 | 0.050 |
| EX-10 | 0.005 |
| EX-14 | 0.030 |
| U-1 | 0.070 |
| U-2 | 0.050 |
| U-3 | 0.070 |
| Gelatin | 1.30 |
| Fifth Layer: Third Red-Sensitive Emulsion Layer | |
| Emulsion 1 | 1.60 as silver |
| Sensitizing Dye I | $9.5 \times 10^{-5}$ |
| Sensitizing Dye II | $3.0 \times 10^{-5}$ |
| Sensitizing Dye III | $5.0 \times 10^{-4}$ |
| EX-2 | 0.097 |
| EX-3 | 0.010 |
| EX-4 | 0.080 |
| EX-10 | 0.005 |
| EX-14 | 0.020 |
| Illustrative Compound (11) | $3.0 \times 10^{-4}$ |
| HBS-1 | 0.22 |
| HBS-2 | 0.10 |
| Gelatin | 1.63 |
| Sixth Layer: Intermediate Layer | |
| EX-5 | 0.040 |
| HBS-1 | 0.020 |
| Gelatin | 0.80 |
| Seventh Layer: First Green-Sensitive Emulsion Layer | |
| Emulsion A | 0.15 as silver |
| Emulsion B | 0.15 as silver |
| Sensitizing Dye IV | $3.0 \times 10^{-5}$ |
| Sensitizing Dye V | $1.0 \times 10^{-4}$ |
| Sensitizing Dye VI | $3.8 \times 10^{-4}$ |
| EX-1 | 0.021 |
| EX-6 | 0.26 |
| EX-7 | 0.030 |
| EX-8 | 0.025 |
| HBS-1 | 0.10 |
| HBS-3 | 0.010 |
| Gelatin | 0.63 |
| Eighth Layer: Second Green-Sensitive Emulsion Layer | |
| Emulsion C | 0.45 as silver |
| Sensitizing Dye IV | $2.1 \times 10^{-5}$ |
| Sensitizing Dye V | $7.0 \times 10^{-5}$ |
| Sensitizing Dye VI | $2.6 \times 10^{-4}$ |
| EX-6 | 0.094 |
| EX-7 | 0.026 |
| EX-8 | 0.018 |
| HBS-1 | 0.16 |
| HBS-3 | $8.0 \times 10^{-3}$ |
| Gelatin | 0.50 |
| Ninth Layer: Third Green-Sensitive Emulsion Layer | |
| Emulsion 1 | 1.20 as silver |
| Sensitizing Dye IV | $5.0 \times 10^{-5}$ |
| Sensitizing Dye V | $1.0 \times 10^{-4}$ |
| Sensitizing Dye VI | $4.0 \times 10^{-4}$ |
| EX-1 | 0.025 |
| EX-11 | 0.10 |

-continued

| Sample 101 | |
|---|---|
| EX-13 | 0.015 |
| Illustrative Compound (18) | $5.0 \times 10^{-4}$ |
| HBS-1 | 0.25 |
| HBS-2 | 0.10 |
| Gelatin | 1.54 |
| Tenth Layer: Yellow Filter Layer | |
| Yellow Colloidal Silver | 0.050 as silver |
| EX-5 | 0.080 |
| HBS-1 | 0.030 |
| Gelatin | 0.95 |
| Eleventh Layer: First Blue-Sensitive Emulsion Layer | |
| Emulsion A | 0.080 as silver |
| Emulsion B | 0.070 as silver |

-continued

| Sample 101 | |
|---|---|
| Emulsion F | 0.070 as silver |
| Sensitizing Dye VII | $3.5 \times 10^{-4}$ |
| EX-8 | 0.042 |
| EX-9 | 0.72 |
| HBS-1 | 0.28 |
| Gelatin | 1.10 |
| Twelfth Layer: Second Blue-Sensitive Emulsion Layer | |
| Emulsion G | 0.45 as silver |
| Sensitizing Dye VII | $2.1 \times 10^{-4}$ |
| EX-9 | 0.15 |
| EX-10 | $7.0 \times 10^{-3}$ |
| HBS-1 | 0.050 |
| Gelatin | 0.78 |
| Thirteenth Layer: Third Blue-Sensitive Emulsion Layer | |
| Emulsion H | 0.77 as silver |
| Sensitizing Dye VII | $2.2 \times 10^{-4}$ |
| EX-9 | 0.20 |
| HBS-1 | 0.070 |
| Gelatin | 0.69 |
| Fourteenth Layer: First Protective Layer | |
| Emulsion I | 0.20 as silver |
| Illustrative Compound (18) | $1.0 \times 10^{-4}$ |
| U-4 | 0.11 |
| U-5 | 0.17 |
| HBS-1 | $5.0 \times 10^{-2}$ |
| Gelatin | 1.00 |

-continued

| Sample 101 | |
|---|---|
| Fifteenth Layer: Second Protective Layer | |
| H-1 | 0.40 |
| B-1 (diameter: 1.7 μm) | $5.0 \times 10^{-2}$ |
| B-2 (diameter: 1.7 μm) | 0.10 |
| B-3 | 0.10 |
| S-1 | 0.20 |
| Gelatin | 1.20 |

Furthermore, W-1, W-2, W-3, B-4, B-5, F-1, F-2, F-3, F-4, F-5, F-6, F-7, F-8, F-9, F-10, F-11, F-12, F-13 and iron salts, lead salts, gold salts, platinum salts, iridium salts and rhodium salts were included in all of the layers to improve storage properties, processing properties, pressure resistance, fungicidal and biocidal properties, and coating properties.

| Emulsion | Average AgI Content (%) | Average Grain Size (μm) | Variation Coefficient of the Grain Size (%) | Diameter/ Thickness Ratio | Silver Weight Ratio (AgI content %) |
|---|---|---|---|---|---|
| A | 4.0 | 0.45 | 27 | 1.2 | Core/Shell = 1/3 (13/1), double structure grains |
| B | 8.9 | 0.70 | 14 | 1.2 | Core/Shell = 3/7 (25/2), double structure grains |
| C | 10 | 0.75 | 30 | 1.5 | Core/Shell = 1/2 (24/3), double structure grains |
| D | 16 | 1.05 | 35 | 1.8 | Core/Shell = 4/6 (40/0), double structure grains |
| E | 10 | 1.05 | 35 | 1.8 | Core/Shell = 1/2 (24/3), double structure grains |
| F | 4.0 | 0.25 | 28 | 1.5 | Core/Shell = 1/3 (13/1), double structure grains |
| G | 14.0 | 0.75 | 25 | 1.5 | Core/Shell = 1/2 (42/0), double structure grains |
| H | 14.5 | 1.30 | 25 | 1.9 | Core/Shell = 37/63 (34/3), double structure grains |
| I | 1 | 0.07 | 15 | 1.0 | Uniform grains |

EX-1
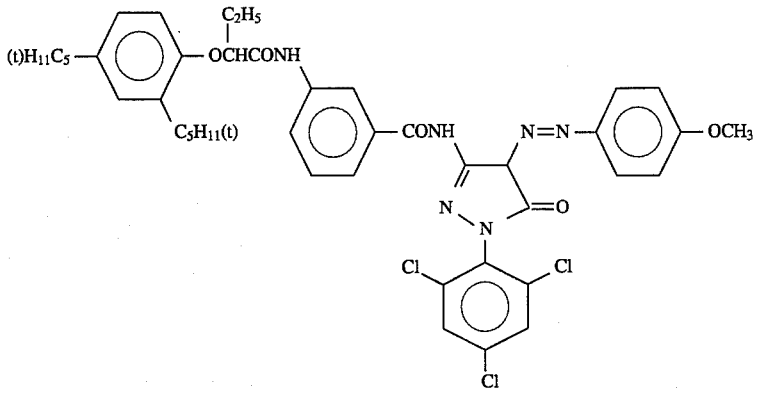
EX-2
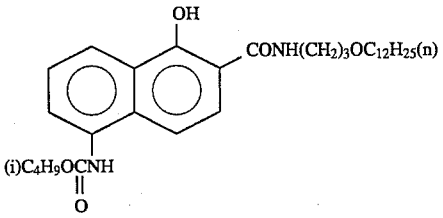
EX-3
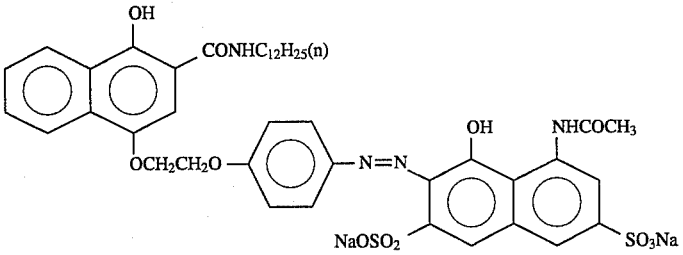
EX-4
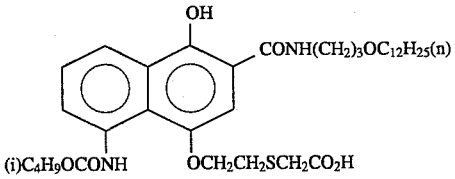
EX-5
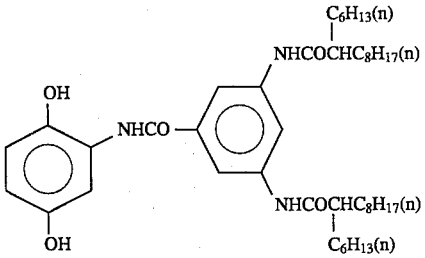
EX-6
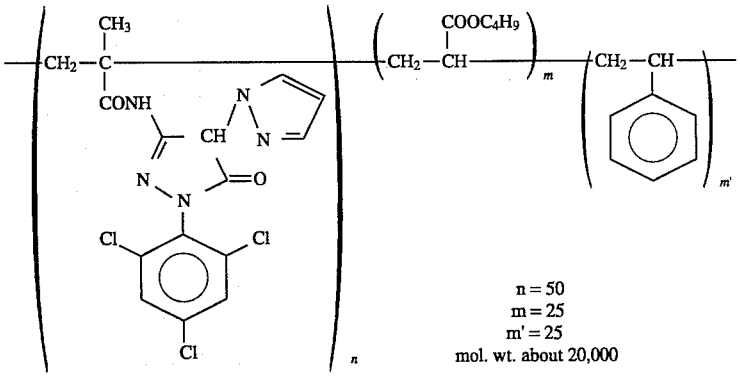
n = 50
m = 25
m' = 25
mol. wt. about 20,000

-continued
EX-7
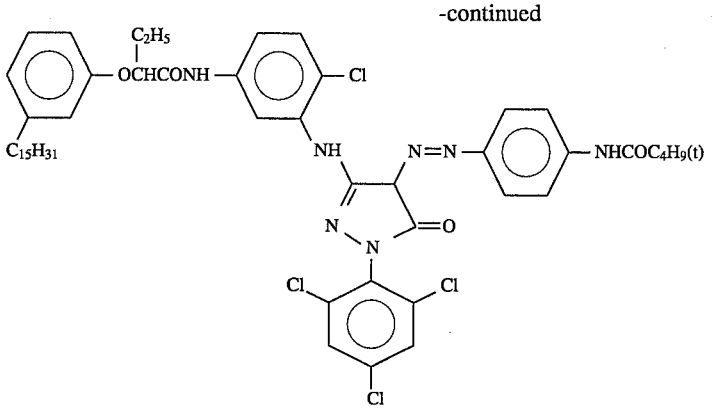
EX-8
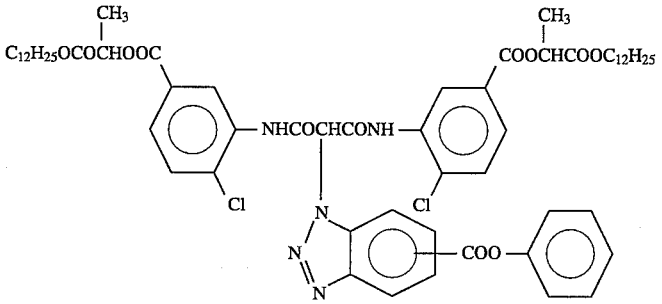
EX-9
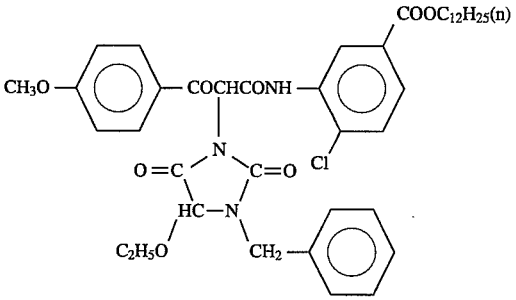
EX-10
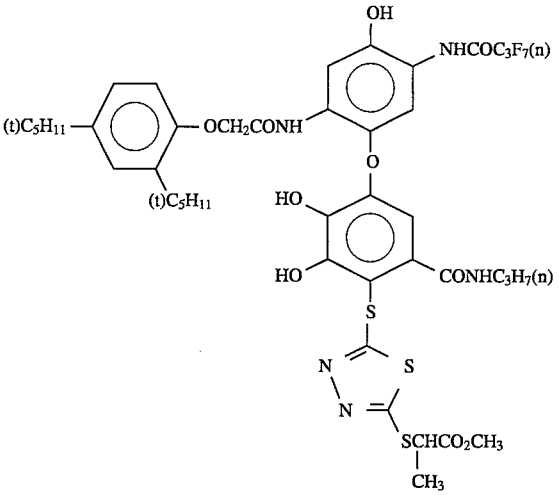

-continued
EX-11
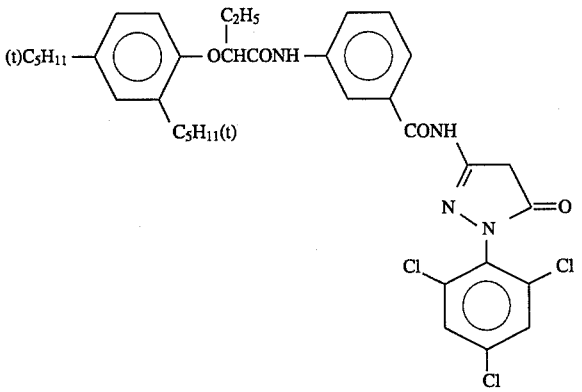
EX-12
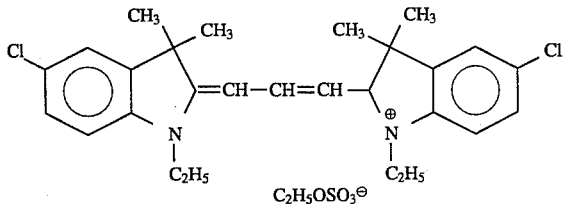
EX-13
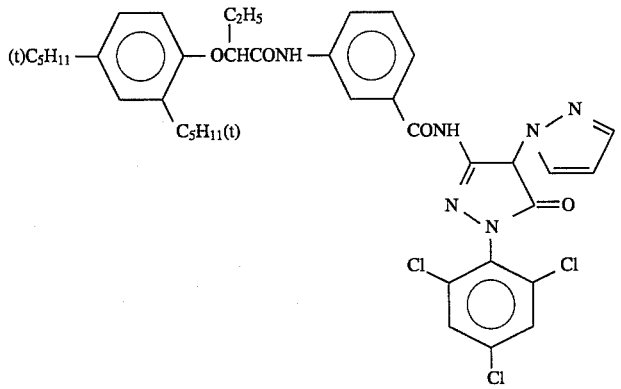
EX-14
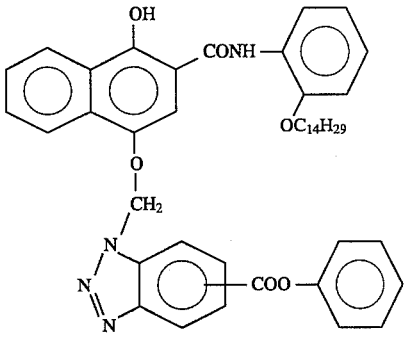
U-1
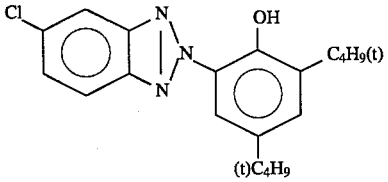
U-2
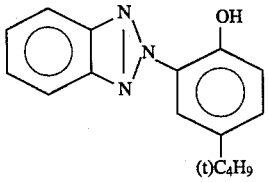

-continued
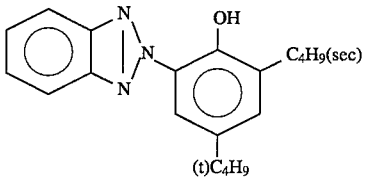
U-3
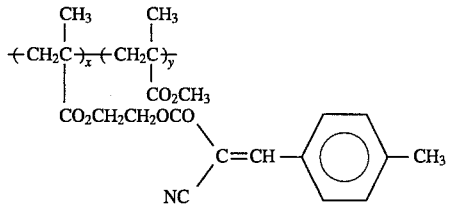
x:y = 70:30 (wt %)
mol. wt. about 30,000
U-4
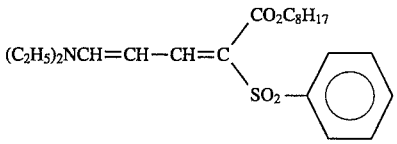
U-5
Tricresyl phosphate — HBS-1
Di-n-butyl phthalate — HBS-2
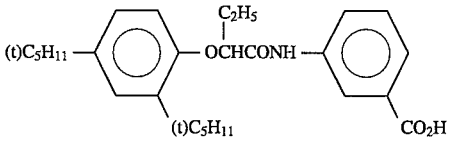
HBS-3
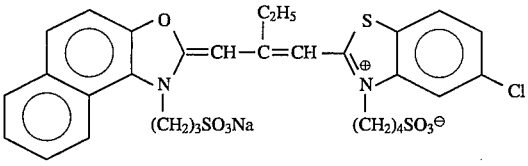
Sensitizing Dye I
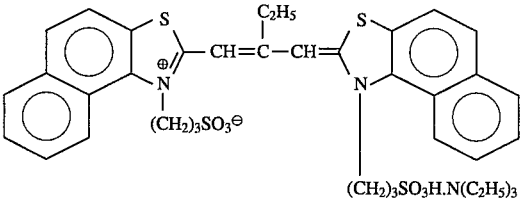
Sensitizing Dye II
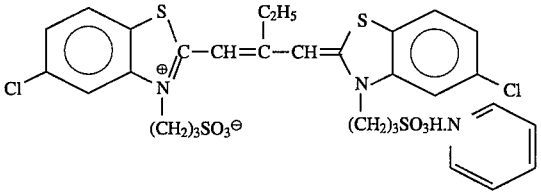
Sensitizing Dye III
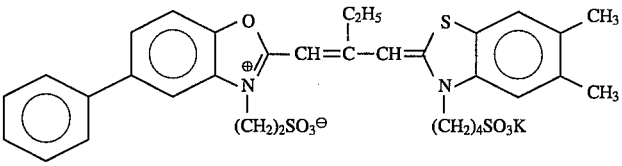
Sensitizing Dye IV -continued
Sensitizing Dye V
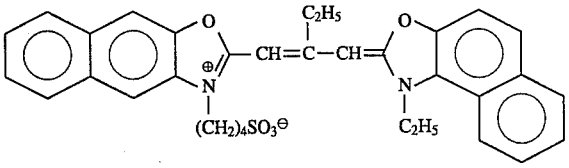
Sensitizing Dye VI
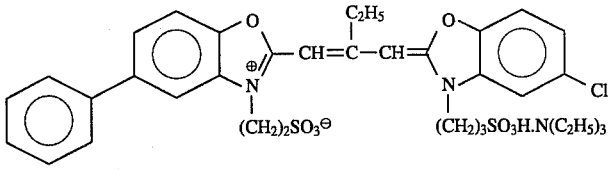
Sensitizing Dye VII
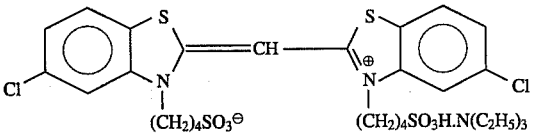
S-1
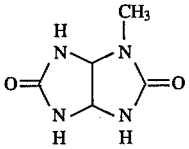
H-1
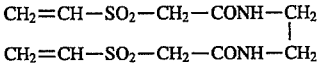
B-1
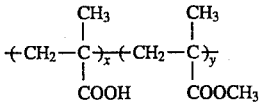
x/y = 10/90
B-2
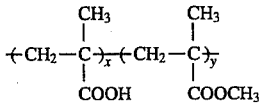
x/y = 40/60
B-3
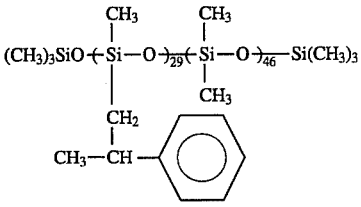
B-4
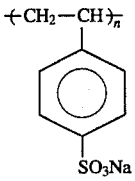
B-5
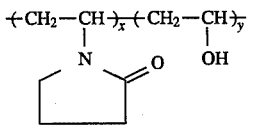
x/y = 70/30
W-1
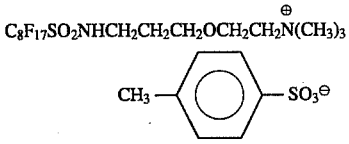

-continued
W-2
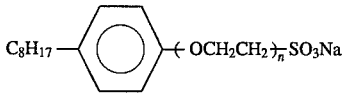
n = 2~4
W-3
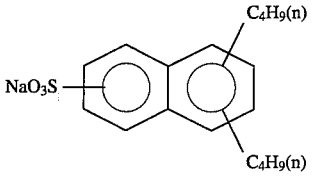
F-1
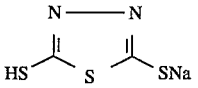
F-2
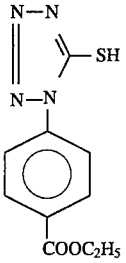
F-3
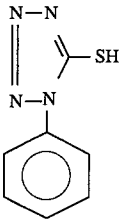
F-4
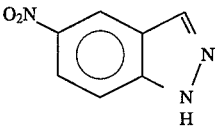
F-5
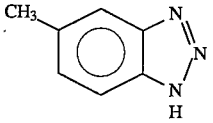
F-6
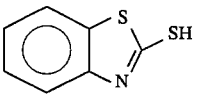
F-7
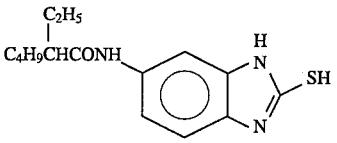
F-8
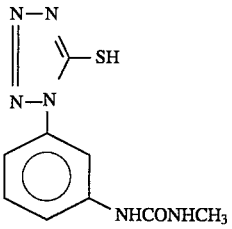

-continued

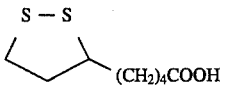

F-9

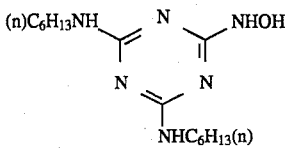

F-10

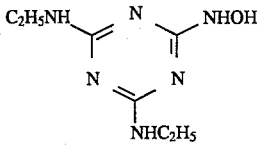

F-11

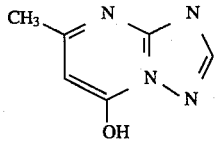

F-12

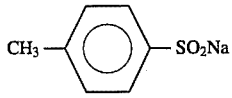

F-13

Samples 102 to 105

Samples 102 to 105 were prepared by replacing Emulsion 1 in the fifth and ninth layers of Sample 101 with Emulsions 2 to 5, respectively.

Samples 106 to 125

Samples 106 to 125 were prepared by adding Yellow Colored Cyan Coupler (YC-1), (YC-28), (YC-44) or (YC-47) of the present invention to Samples 101 to 105, respectively, as indicated in Table 1-2 below, to the third layer in an amount of 0.015 g/m$^2$, to the fourth layer in an amount of 0.030 g/m$^2$, and to the fifth layer in an amount of 0.030 g/m$^2$.

Samples 126 to 130

Samples 126 to 130 were prepared by omitting Compounds (11) and (18) represented by general formula (A) of the present invention which had been added to the fifth, ninth and fourteenth layers of Samples 111 to 115, respectively.

The method of adding (YC-28) to the fourth layer of Sample 111 involved the preparation of an emulsified dispersion as described below.

Bovine bone gelatin (60 g) and 2 g of W-3 were added to 800 ml of water and dissolved at 50° C. On the other hand, EX-2 (40 g), EX-3 (5 g), EX-10 (0.5 g), EX-14 (3 g), U-1 (7 g), U-2 (5 g), U-3 (7 g), W-2 (3 g) and YC-28 (3 g) were dissolved at 60° C. in 150 ml of ethyl acetate and mixed with the above noted aqueous gelatin solution using a domestic mixer and emulsified for 10 minutes in the mixer to provide a dispersion, and this dispersion was mixed with the emulsion.

The addition of the yellow colored cyan coupler to the other layers and the addition of other yellow colored couplers was carried out in the same manner.

The thus prepared samples were subjected to a white light imagewise exposure and color developed in the manner described below. The thus processed samples were evaluated as described below, the results of which are set forth in Table 1-2. The logarithm of the reciprocal of the exposure which gave a cyan density of (fog+0.2) is indicated as a relative speed in Table 1-2.

Furthermore, the RMS values at a cyan density of (fog+0.5) measured using an aperture of diameter 48 μm are shown in Table 1-2.

Moreover, the MTF values were obtained for a cyan image of 40 cycles/mm. Measurement of the MTF value was carried out using the method described in *The Theory of the Photographic Process,* 3rd Ed. (Mees, published by Macmillan).

Furthermore, the value obtained on subtracting the yellow density at the cyan fog density from the yellow density at an exposure which gave a cyan density of (fog+1.5) on subjecting the samples to a red imagewise exposure after being subjected to a uniform blue exposure (0.3 lux.sec through filter BPN-45 manufactured by Fuji Photo Film Co., Ltd.) is shown as the degree of color turbidity in Table 1-2.

Moreover, the samples were subjected to a 10 lux.second white light exposure and color developed and processed with a bleaching time of 30 minutes or 2 minutes. The value obtained on subtracting the magenta density with a bleaching time of 30 minutes from the density on bleaching for 2 minutes is shown as the desilvering failure density in Table 1-2.

Color development processing was carried out at 38° C. using the processing operations indicated below.

| | |
|---|---|
| Color Development | 3 minutes 15 seconds |
| Bleaching | 30 minutes (or 2 minutes) |
| Water washing | 2 minutes 10 seconds |
| Fixing | 4 minutes 20 seconds |
| Water washing | 3 minutes 15 seconds |
| Stabilization | 1 minute 05 seconds |

The compositions of the processing baths used in each process were as indicated below.

| Color Developer | |
|---|---|
| Diethylenetriaminepentaacetic Acid | 1.0 g |
| 1-Hydroxyethylidene-1,1-diphosphonic Acid | 2.0 g |
| Sodium Sulfite | 4.0 g |
| Potassium Carbonate | 30.0 g |
| Potassium Bromide | 1.4 g |
| Potassium Iodide | 1.3 mg |
| Hydroxylamine Sulfate | 2.4 g |
| 4-(N-Ethyl-N-β-hydroxyethylamino)-2-methylaniline Sulfate | 4.5 g |
| Water to make | 1.0 liter |
| pH | 10.0 |
| **Bleach** | |
| Ethylenediaminetetraacetic Acid Ferric Ammonium Salt | 100.0 g |
| Ethylenediaminetetraacetic Acid Disodium Salt | 10.0 g |
| Ammonium Bromide | 150.0 g |
| Ammonium Nitrate | 10.0 g |
| Water to make | 1.0 liter |
| pH | 6.0 |
| **Fixer** | |
| Ethylenediaminetetraacetic Acid Disodium Salt | 1.0 g |
| Sodium Sulfite | 4.0 g |
| Aqueous Ammonium Thiosulfate Solution (70 wt %) | 175.0 ml |
| Sodium Bisulfite | 4.6 g |
| Water to make | 1.0 liter |
| pH | 6.6 |
| **Stabilizer** | |
| Formalin (40 wt %) | 2.0 ml |
| Polyoxyethylene-p-monononylphenyl Ether (average degree of polymerization: 10) | 0.3 g |
| Water to make | 1.0 liter |

TABLE 1-2

| Sample | Emulsion in the Fifth and Ninth Layers | Yellow Colored Cyan Coupler | Compound Represented by Formula (A) | Relative Speed | RMS Value × 1,000 | MTF Value, Cyan Image, 40 Cycles | Degree of Color Turbidity | Desilvering Failure Density |
|---|---|---|---|---|---|---|---|---|
| 101 (Comparison) | 1 | — | (11)/(18) | 0.00 | 30.3 | 0.40 | 0.06 | 0.08 |
| 102 (Comparison) | 2 | — | (11)/(18) | 0.00 | 29.5 | 0.43 | 0.08 | 0.12 |
| 103 (Comparison) | 3 | — | (11)/(18) | 0.02 | 29.0 | 0.45 | 0.09 | 0.14 |
| 104 (Comparison) | 4 | — | (11)/(18) | 0.03 | 28.8 | 0.45 | 0.09 | 0.15 |
| 105 (Comparison) | 5 | — | (11)/(18) | 0.04 | 28.7 | 0.45 | 0.09 | 0.15 |
| 106 (Comparison) | 1 | YC-1 | (11)/(18) | 0.03 | 30.6 | 0.41 | −0.08 | 0.03 |
| 107 (Invention) | 2 | YC-1 | (11)/(18) | 0.04 | 29.7 | 0.44 | −0.06 | 0.04 |
| 108 (Invention) | 3 | YC-1 | (11)/(18) | 0.05 | 29.1 | 0.46 | −0.05 | 0.05 |
| 109 (Invention) | 4 | YC-1 | (11)/(18) | 0.06 | 28.9 | 0.46 | −0.05 | 0.05 |
| 110 (Invention) | 5 | YC-1 | (11)/(18) | 0.07 | 28.7 | 0.46 | −0.05 | 0.06 |
| 111 (Comparison) | 1 | YC-28 | (11)/(18) | 0.03 | 30.5 | 0.41 | −0.08 | 0.03 |
| 112 (Invention) | 2 | YC-28 | (11)/(18) | 0.03 | 29.6 | 0.44 | −0.06 | 0.04 |
| 113 (Invention) | 3 | YC-28 | (11)/(18) | 0.05 | 29.0 | 0.46 | −0.05 | 0.05 |
| 114 (Invention) | 4 | YC-28 | (11)/(18) | 0.06 | 28.9 | 0.46 | −0.05 | 0.05 |
| 115 (Invention) | 5 | YC-28 | (11)/(18) | 0.07 | 28.7 | 0.46 | −0.05 | 0.06 |
| 116 (Comparison) | 1 | YC-44 | (11)/(18) | 0.02 | 30.6 | 0.41 | −0.06 | 0.03 |
| 117 (Invention) | 2 | YC-44 | (11)/(18) | 0.03 | 29.7 | 0.44 | −0.04 | 0.04 |
| 118 (Invention) | 3 | YC-44 | (11)/(18) | 0.04 | 29.1 | 0.46 | −0.03 | 0.05 |
| 119 (Invention) | 4 | YC-44 | (11)/(18) | 0.05 | 29.0 | 0.46 | −0.03 | 0.05 |
| 120 (Invention) | 5 | YC-44 | (11)/(18) | 0.06 | 28.9 | 0.46 | −0.03 | 0.06 |
| 121 (Comparison) | 1 | YC-47 | (11)/(18) | 0.02 | 30.5 | 0.40 | −0.04 | 0.04 |
| 122 (Invention) | 2 | YC-47 | (11)/(18) | 0.02 | 29.6 | 0.43 | −0.02 | 0.05 |
| 123 (Invention) | 3 | YC-47 | (11)/(18) | 0.04 | 29.1 | 0.45 | −0.01 | 0.06 |
| 124 (Invention) | 4 | YC-47 | (11)/(18) | 0.04 | 29.0 | 0.45 | −0.01 | 0.06 |
| 125 (Invention) | 5 | YC-47 | (11)/(18) | 0.05 | 28.8 | 0.45 | −0.01 | 0.07 |
| 126 (Comparison) | 1 | YC-28 | — | 0.01 | 31.3 | 0.41 | −0.08 | 0.07 |
| 127 (Invention) | 2 | YC-28 | — | 0.02 | 30.2 | 0.44 | −0.06 | 0.08 |
| 128 (Invention) | 3 | YC-28 | — | 0.03 | 29.5 | 0.46 | −0.05 | 0.08 |
| 129 (Invention) | 4 | YC-28 | — | 0.04 | 29.3 | 0.46 | −0.05 | 0.09 |
| 130 (Invention) | 5 | YC-28 | — | 0.05 | 29.2 | 0.46 | −0.05 | 0.09 |

It is clear from Table 1-2 that the samples of the present invention exhibited a higher photographic speed, superior color reproduction as represented by the degree of color turbidity and a lower desilvering failure density than Samples 102 to 105 in which no yellow colored cyan coupler was used. Furthermore, the samples of the present invention exhibited higher photographic speed and were superior in terms of graininess and sharpness as compared to Comparative Samples 106, 111, 116 and 121 which contained Emulsion 1 having an aspect ratio outside the range of the present invention.

Furthermore, Samples 112 to 115 containing a compound represented by formula (A) clearly exhibited a higher photographic speed and superior graininess and sharpness as compared to Comparative Samples 127 to 130 not containing a compound represented by formula (A).

EXAMPLE 2

Emulsion 6 (The Present Invention)

A 2M aqueous silver nitrate solution which contained gelatin and a 2M aqueous potassium bromide solution which contained gelatin (25 cc of each solution) were mixed simultaneously over a period of 1 minute with vigorous agitation at 30° C. in 1 liter of 0.7 wt % gelatin solution containing 0.04M of potassium bromide. Subsequently, the temperature was raised to 75° C. and 300 cc of 10 wt % aqueous gelatin solution was added. Next, 30 cc of 1M aqueous silver nitrate solution was added over a period of 5 minutes and then 10 cc of 25 wt % aqueous ammonia was added and the mixture was ripened at 75° C. After the ripening had been completed and the ammonia had been neutralized, 1M aqueous silver nitrate solution and 1M aqueous potassium bromide solution were mixed simultaneously at accelerating flow rates (the flow rate at the end of the addition was five times that at the start of the addition) while maintaining the pBr value at 2.3. (The amount of aqueous silver nitrate solution used was 600 cc.) The emulsion was washed with water using a flocculation method, dispersed gelatin was added and 800 g of a hexagonal tabular silver halide emulsion was obtained (Seed Emulsion A). This Seed Emulsion A was comprised of monodisperse hexagonal tabular grains having an average projected area corresponding circle diameter (grain size) of 1.0 μm, an average thickness of 0.18 μm and a variation coefficient of 11%. Next, to 250 g of this Seed Emulsion A were added 800 cc of distilled water, 30 g of gelatin and 6.5 g of potassium bromide, the temperature was raised to 75° C. and a 1M aqueous silver nitrate solution and a 1M aqueous alkali metal halide solution (a mixture of 90 mol % potassium bromide and 10 mol % potassium iodide) were mixed simultaneously, with agitation, at an accelerating flow rate (the flow rate at the end of the addition was three times that at the start of the addition) while maintaining a pBr value of 1.6. (The amount of aqueous silver nitrate solution used was 600 cc.) Moreover, a 1M aqueous silver nitrate solution and a 1M aqueous potassium bromide solution were then mixed simultaneously at an accelerating flow rate (the final flow rate was 1.5 times the flow rate at the start of the addition) while maintaining a pBr value of 1.6. (The amount of aqueous silver nitrate solution used was 200 cc.)

This emulsion was washed with water as described above, dispersed gelatin was added thereto and a monodisperse hexagonal tabular silver halide emulsion (Emulsion 6) was obtained. Emulsion 6 thus obtained was such that 92% of the total projected area was accounted for by hexagonal tabular grains, the average grain size of the hexagonal tabular grains was 1.75 μm, the average grain thickness was 0.29 μm, the average aspect ratio was 6:1 and the variation coefficient was 16%.

Emulsion 7 (The Present Invention)

Seed Emulsion B was obtained in the same way as Seed Emulsion A for Emulsion 6, except that the amount of 1M aqueous silver nitrate solution added in the second addition was 20 cc and the amount of aqueous ammonia added was 8 cc. Then, Seed Emulsion B was grown in the same way as Emulsion 6, except that the pBr value during growth was maintained at 1.5. The emulsion thus obtained was such that 90% of the total projected area was accounted for by hexagonal tabular grains, the average size of the hexagonal tabular grains was 2.1 μm, the average thickness was 0.21 μm, the average aspect ratio was 10:1 and the variation coefficient was 19%.

Emulsion 8 (The Present Invention)

The amount of 1M aqueous silver nitrate used in the second addition in the preparation of Emulsion 6 was changed from 30 cc to 10 cc and the third addition was carried out without adding aqueous ammonia with the pBr value changed from 2.3 to 1.7 to obtain Seed Emulsion C. Next, Seed Emulsion C was grown using the same method as for Emulsion 6 to obtain Emulsion 8.

Emulsion 8 thus obtained was such that 62% of the total projected area was accounted for by hexagonal tabular grains, the average size of the hexagonal tabular grains was 2.0 μm, the average thickness was 0.17 μm, the average aspect ratio was 12:1 and the variation coefficient was 37%.

Sensitizing Dyes I, II, III and IV were mixed in a mol ratio of 0.2:0.05:1:0.3 and added in amounts equal to 70% of the saturation adsorption amount to each of Emulsions 6, 7, 8 and 1, and after maintaining the mixtures at 60° C. for 20 minutes, optimal chemical sensitization was carried out in each case using sodium thiosulfate, chloroauric acid and potassium thiocyanate at 60° C. and pH 6.5. (Emulsions 6-1, 7-1, 8-1 and 1-1)

TABLE 2-1

| Emulsion | Average Aspect Ratio[1)] | Average Aspect Ratio[2)] | Average Aspect Ratio[3)] | Average Grain Size (μm) | Average Grain Thickness (μm) | Variation Coefficient of Grain Size | Hexagonal Tabular Proportion[4)] (%) | Relative Standard Deviation of AgI Content between Grains[5)] (%) |
|---|---|---|---|---|---|---|---|---|
| 6-1 | 7.9/1 | 7.2/1 | 6.0/1 | 1.75 | 0.29 | 0.15 | 92 | 13 |
| 7-1 | 13/1 | 11/1 | 10/1 | 2.10 | 0.21 | 0.19 | 90 | 16 |
| 8-1 | 21/1 | 17/1 | 12/1 | 2.00 | 0.17 | 0.37 | 62 | 24 |
| 1-1 | 1.5/1 | 1.2/1 | 1.1/1 | 0.86 | 0.67 | 0.25 | 10 | 22 |

[1),2)]Values measured in the same ay as in Table 1-1.
[3)]Average value of all the grains.
[4)]The proportion of the total projected area of the emulsified grains accounted for by hexagonal grains.
[5)]Values measured on the basis specified in JP-A-60-143332.

Samples 201 to 204

Samples 201 to 204 were prepared by replacing Emulsion 1 in the fifth layer of Sample 101 with Emulsions 6-1, 7-1, 8-1 and 1-1, respectively.

Samples 205 to 220

Samples 205 to 220 were prepared by adding Yellow Colored Cyan Couplers (YC-26), (YC-27), (YC-30) or (YC-31) of the present invention to Samples 201 to 204, respectively, as indicated in Table 2-2 below, in an amount of 0.010 g/m$^2$ to the second layer, 0.015 g/m$^2$ to the third layer, 0.050 g/m$^2$ to the fourth layer, and 0.010 g/m$^2$ to the fifth layer.

The relative speed, RMS value, MTF value and degree of color turbidity of the samples thus prepared were evaluated in the same manner as in Example 1, the results of which are set forth in Table 2-2. However, the color development process used was as indicated below.

Development was carried out using a negative type automatic processor with the processing operations and processing bath compositions indicated below.

However, the samples for evaluation were processed after processing samples which had been imagewise exposed until the total amount of replenishment of the color developer had reached three times the parent bath tank capacity.

| | Processing Operations | | | |
|---|---|---|---|---|
| Process | Processing Time | Processing Temperature (°C.) | Replenishment Rate* (ml) | Tank Capacity (liter) |
| Color Development | 3 min 15 sec | 38.0 | 23 | 15 |
| Bleach | 50 sec | 38.0 | 5 | 5 |
| Bleach-Fix | 50 sec | 38.0 | — | 5 |
| Fix | 50 sec | 38.0 | 16 | 5 |
| Water Wash (1) | 30 sec | 38.0 | — | 3 |
| Water Wash (2) | 20 sec | 38.0 | 34 | 3 |
| Stabilization | 20 sec | 38.0 | 20 | 3 |
| Drying | 1 min | 55 | | |

*Replenishment rate per meter of 35 mm wide material

Water washing was carried out using a counterflow system from (2) to (1), and the overflow from the water wash was all introduced into the fixer bath. Replenishment of the bleach-fix bath was carried out by connecting pipes between the top of the bleach bath and the bottom of the bleach-fixer tank and between the top of the fixer tank and the bottom of the bleach-fixer tank in the automatic processor. All of the overflow produced by replenishment of the bleach tank and the fixer tank was introduced into the bleach-fixer tank. Moreover, the amount of carry-over of developer into the bleaching process, the amount of carry-over of bleach into the bleach-fix process, the amount of carry-over of bleach-fixer to the fixing process and the amount of carry-over from the fixer to the water washing process was 2.5 ml, 2.0 ml, 2.0 ml and 2.0 ml, per 1 meter length of photosensitive material of width 35 mm, respectively. Furthermore, the crossover time was 5 seconds in each case, and this period of time is included in the processing time of the previous bath. Each processing bath was provided with a device which caused a jet-flow of processing liquid to impinge on the photosensitive emulsion surface in accordance with the method disclosed in JP-A-62-183460.

The compositions of the processing baths were as indicated below.

| | Tank Solution | Replenisher |
|---|---|---|
| Developer: | | |
| Diethylenetriaminepentaacetic Acid | 2.0 g | 2.2 g |
| 1-Hydroxyethylidene-1,1-diphosphonic Acid | 3.3 g | 3.3 g |
| Sodium Sulfite | 3.9 g | 5.2 g |
| Potassium Carbonate | 37.5 g | 39.0 g |
| Potassium Bromide | 1.4 g | 0.4 g |
| Potassium Iodide | 1.3 mg | — |
| Hydroxylamine Sulfate | 2.4 g | 3.3 g |
| 2-Methyl-4-[N-ethyl-N-(β-hydroxyethyl)amino]aniline Sulfate | 4.5 g | 6.1 g |
| Water to make | 1.0 liter | 1.0 liter |
| pH | 10.05 | 10.15 |
| Bleach | | |
| 1,3-Propylenediaminetetraacetic Acid, Ferric Ammonium Monohydrate | 144.0 g | 206.0 g |
| Ammonium Bromide | 84.0 g | 120.0 g |
| Ammonium Nitrate | 17.5 g | 25.0 g |
| Hydroxyacetic Acid | 63.0 g | 90.0 g |
| Acetic Acid | 33.2 g | 47.4 g |
| Water to make | 1.0 liter | 1.0 liter |
| pH (adjusted with aqueous ammonia) | 3.20 | 2.80 |

Bleach-Fixer Tank Solution

A 15:85 mixture of the above described bleach tank solution and the fixer tank solution described below.

| Fixer | Tank Solution | Replenisher |
|---|---|---|
| Ammonium Sulfite | 19.0 g | 57.0 g |
| Aqueous Ammonium Thiosulfate Solution (700 g/liter) | 280 ml | 840 ml |
| Imidazole | 28.5 g | 85.5 g |
| Ethylenediaminetetraacetic Acid | 12.5 g | 37.5 g |
| Water to make | 1.0 liter | 1.0 liter |
| pH (adjusted with aqueous ammonia, acetic acid) | 7.40 | 7.45 |

Water Washing Water

Town water was passed through a mixed bed column which had been packed with an H-type strongly acidic cation exchange resin ("Amberlite IR-120B", made by the Rohm & Haas Co.) and an OH-type strongly basic anion exchange resin ("Amberlite IRA-400", made by the same company), and treated such that the calcium and magnesium ion concentration were each not more than 3 mg/liter, after which 20 mg/liter of sodium isocyanurate dichloride and 150 mg/liter of sodium sulfate were added thereto. The pH of the washing water was within the range of from 6.5 to 7.5.

| Stabilizer (tank solution equals replenisher) | |
|---|---|
| Formalin (37 wt %) | 2.0 ml |
| Polyoxyethylene-p-monononylphenyl Ether (average degree of polymerization: 10) | 0.3 g |

TABLE 2-2

| Sample | Emulsion in the Fifth Layer | Yellow Colored Cyan Coupler | Relative Speed | RMS Value × 1000 | MTF Value | Degree of Color Turbidity |
|---|---|---|---|---|---|---|
| 201 (Comparison) | 6-1 | — | 0.00 | 27.4 | 0.43 | 0.11 |
| 202 (Comparison) | 7-1 | — | 0.03 | 27.9 | 0.43 | 0.11 |
| 203 (Comparison) | 8-1 | — | −0.05 | 28.5 | 0.43 | 0.11 |
| 204 (Comparison) | 1-1 | — | −0.08 | 29.8 | 0.41 | 0.07 |
| 205 (Invention) | 6-1 | YC-26 | 0.03 | 27.6 | 0.44 | −0.02 |
| 206 (Invention) | 7-1 | YC-26 | 0.06 | 28.1 | 0.44 | −0.02 |
| 207 (Invention) | 8-1 | YC-26 | −0.02 | 28.7 | 0.44 | −0.02 |
| 208 (Comparison) | 1-1 | YC-26 | −0.05 | 30.0 | 0.42 | −0.05 |
| 209 (Invention) | 6-1 | YC-27 | 0.03 | 27.6 | 0.44 | −0.02 |
| 210 (Invention) | 7-1 | YC-27 | 0.06 | 28.0 | 0.44 | −0.02 |
| 211 (Invention) | 8-1 | YC-27 | −0.02 | 28.6 | 0.44 | −0.02 |
| 212 (Comparison) | 1-1 | YC-27 | −0.05 | 30.0 | 0.42 | −0.05 |
| 213 (Invention) | 6-1 | YC-30 | 0.04 | 27.7 | 0.44 | −0.02 |
| 214 (Invention) | 7-1 | YC-30 | 0.06 | 28.1 | 0.44 | −0.02 |
| 215 (Invention) | 8-1 | YC-30 | −0.01 | 28.7 | 0.44 | −0.02 |
| 216 (Comparison) | 1-1 | YC-30 | −0.04 | 30.1 | 0.42 | −0.05 |
| 217 (Invention) | 6-1 | | 0.03 | 27.6 | 0.44 | −0.02 |
| 218 (Invention) | 7-1 | YC-31 | 0.06 | 28.1 | 0.44 | −0.02 |
| 219 (Invention) | 8-1 | YC-31 | −0.01 | 28.6 | 0.44 | −0.02 |
| 220 (Comparison) | 1-1 | YC-31 | −0.06 | 30.0 | 0.42 | −0.05 |

It is clearly seen from Table 2-2 that the samples of the present invention exhibited a higher photographic speed and superior graininess and sharpness as compared to the comparative samples employing an emulsion outside the scope of the present invention, which comparative samples exhibited higher speed and superior color reproduction than other comparative samples not employing a yellow colored cyan coupler. The samples of the present invention exhibited higher photographic speed and superior color reproduction, graininess and sharpness as compared to all of the comparative samples. Furthermore, the samples prepared using Emulsions 6-1 and 7-1 having a high hexagonal tabular content were advantageous with respect to photographic speed and graininess.

While the invention has been described in detail and with reference to specific embodiments thereof, it will be apparent to one skilled in the art that various changes and modifications can be made therein without departing from the spirit and scope thereof.

What is claimed is:

1. A silver halide color photographic photosensitive material comprising a support having thereon at least one hydrophilic colloid layer, at least one layer of which is a photosensitive silver halide emulsion layer, wherein at least 50% of the total projected area of the silver halide grains constituting the at least one silver halide emulsion layer is accounted for by silver iodobromide tabular hexagonal grains having two parallel planes as outer surfaces, and the ratio of the length of the side having the shortest length to the length of the side having the longest length is not more than 2 and having an average aspect ratio of at least 2:1 and a silver iodide content of 4 to 12 mol %, and the relative standard deviation of the silver iodide content between the tabular silver iodobromide grains is not more than 20%, and a yellow colored cyan coupler is contained in at least one hydrophilic colloid layer, wherein the yellow colored cyan coupler is a cyan coupler which upon coupling with the oxidized form of a primary aromatic amine developing agent releases a residual compound containing a water-soluble 6-hydroxy-2-pyridon-5-ylazo group, a water-soluble 2-acylaminophenylazo group, or a water-soluble 2-sulfonamidophenylazo group.

2. A silver halide color photographic photosensitive material as in claim 1, wherein at least 85% of the total projected area of the silver halide grains constituting the at least one silver halide emulsion layer is accounted for by tabular grains having an aspect ratio of at least 2:1.

3. A silver halide color photographic photosensitive material as in claim 1, wherein at least 90% of the total projected area of the silver halide grains constituting the at least one silver halide emulsion layer is accounted for by said hexagonal tabular silver halide grains.

4. A silver halide color photographic photosensitive material as in claim 1, further comprising a compound represented by formula (A):

$$Q—SM^1 \qquad (A)$$

wherein Q represents a heterocyclic group bonded to at least one member selected from the group consisting of $—SO_3M^2$, $—COOM^2$, —OH and $—NR^1R^2$ directly or indirectly through a divalent group; $M^1$ and $M^2$ each independently represents a hydrogen atom, an alkali metal, quaternary ammonium or quaternary phosphonium; and $R^1$ and $R^2$ each represents a hydrogen atom or a substituted or unsubstituted alkyl group.

5. A silver halide color photographic photosensitive material as in claim 1, wherein the variation coefficient of the grain size of the tabular silver halide grains constituting the at least one silver halide emulsion layer is not more than 0.25.

6. A silver halide color photographic photosensitive material as in claim 1, wherein said yellow colored cyan coupler is represented by formula (CI) or (CII):

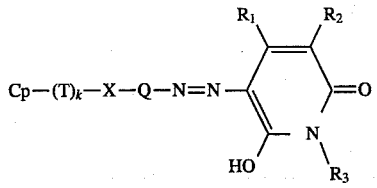

(CI)

-continued

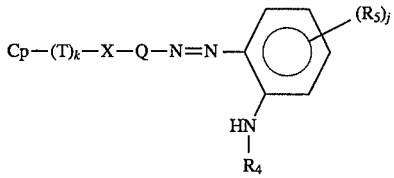

(CII)

wherein Cp represents a cyan coupler residual group; T represents a timing group; k represents an integer of 0 or 1; X represents a divalent linking group bonded to $(T)_k$ via N, O or S contained in X and connected with Q; Q represents an arylene group or a divalent heterocyclic group; $R_1$ and $R_2$ each independently represents a hydrogen atom, a carboxyl group, a sulfo group, a cyano group, an alkyl group, a cycloalkyl group, an aryl group, a heterocyclic group, a carbamoyl group, a sulfamoyl group, a carboxamido group, a sulfonamido group or an alkylsulfonyl group; $R_3$ represents a hydrogen atom, an alkyl group, a cycloalkyl group, an aryl group or a heterocyclic group, with the proviso that at least one of T, X, Q, $R_1$, $R_2$ and $R_3$ contains a water-soluble group selected from a hydroxyl group, a carboxyl group, a sulfo group, an amino group, an ammoniumyl group, a phosphono group, a phosphino group and a hydroxysulfonyloxy group; $R_4$ represents an acyl group or a sulfonyl group; $R_5$ represents a substitutable group; j represents an integer of from 0 to 4, when j is 2 or more, the $R_4$ groups may be the same or different, with the proviso that at least one of $R_4$ and $R_5$ contains a water-soluble group selected from a hydroxyl group, a carboxyl group, a sulfo group, an amino group, an ammoniumyl group, a phosphono group, a phosphino group and a hydroxysulfonyloxy group.

7. A silver halide color photographic photosensitive material as in claim 1, wherein said at least one silver halide emulsion layer further comprises at least one other tabular emulsion having an aspect ratio of at least 2 but differing in average grain size or silver halide composition, or said at least one silver halide emulsion layer comprises silver halide grains other than tabular grains in the same photosensitive layer.

8. A silver halide color photographic photosensitive material as in claim 5, wherein said at least one silver halide emulsion layer further comprises at least one other tabular emulsion having an aspect ratio of at least 2 but differing in average grain size or silver halide composition, or the at least one silver halide emulsion layer comprises silver halide grains other than tabular grains in the same photosensitive layer.

9. A silver halide color photographic photosensitive material as in claim 1, wherein said at least one silver halide emulsion layer further comprises at least one other tabular emulsion having an aspect ratio of at least 2 but differing from the hexagonal tabular emulsion in grain structure, average grain size or silver halide composition, or said at least one silver halide emulsion layer comprises silver halide grains other than tabular grains.

10. A silver halide color photographic photosensitive material as in claim 1, wherein said yellow colored cyan coupler is represented by formula (CI):

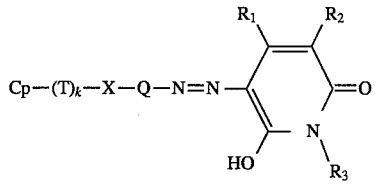

(CI)

wherein Cp represents a cyan coupler residual group; T represents a timing group; k represents an integer of 0 or 1; X represents a divalent linking group bonded to $(T)_k$ via N, O or S contained in X and connected with Q; Q represents an arylene group or a divalent heterocyclic group; $R_1$ and $R_2$ each independently represents a hydrogen atom, a carboxyl group, a sulfo group, a cyano group, an alkyl group, a cycloalkyl group, an aryl group, a heterocyclic group, a carbamoyl group, a sulfamoyl group, a carboxamido group, a sulfonamido group or an alkylsulfonyl group; and $R_3$ represents a hydrogen atom, an alkyl group, a cycloalkyl group, an aryl group or a heterocyclic group, with the proviso that at least one of T, X, Q, $R_1$, $R_2$ and $R_3$ contains a water-soluble group selected from a hydroxyl group, a carboxyl group, a sulfo group, an amino group, an ammoniumyl group, a phosphono group, a phosphino group and a hydroxysulfonyloxy group.

11. A silver halide color photographic photosensitive material as in claim 10, wherein $-(T)_k-X-Q-$ represents

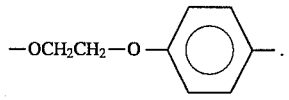

12. A silver halide color photographic photosensitive material as in claim 1, wherein the said yellow colored cyan coupler is contained in an amount of from 0.005 to 0.30 $g/m^2$ of the photosensitive material.

13. A silver halide color photographic photosensitive material as in claim 1, wherein the yellow colored cyan coupler has a peak absorption in the visible range between 400 nm and 500 nm, which yellow colored cyan coupler forms a cyan dye having a peak absorption in the visible region between 630 nm and 750 nm upon coupling with the oxidized form of a primary aromatic amine developing agent.

14. A silver halide color photographic photosensitive material as in claim 1, comprising a red-sensitive silver halide emulsion layer containing said yellow colored cyan coupler.

15. A silver halide color photographic photosensitive material as in claim 4, wherein said compound represented by formula (A) is contained in an amount of from $1\times10^{-7}$ to $1\times10^{-3}$ $mol/m^2$ of the photosensitive material.

* * * * *